US006938843B2

(12) United States Patent
Johansson

(10) Patent No.: US 6,938,843 B2
(45) Date of Patent: Sep. 6, 2005

(54) REFINER CONTROL METHOD AND SYSTEM

(75) Inventor: Ola M. Johansson, Brookfield, WI (US)

(73) Assignee: J & L Fiber Services, Inc., Waukesha, WI (US)

( * ) Notice: Subject to any disclaimer, the term of this patent is extended or adjusted under 35 U.S.C. 154(b) by 10 days.

(21) Appl. No.: 10/164,473

(22) Filed: Jun. 5, 2002

(65) Prior Publication Data

US 2003/0065453 A1 Apr. 3, 2003

Related U.S. Application Data

(63) Continuation-in-part of application No. 09/799,109, filed on Mar. 6, 2001, now Pat. No. 6,752,165.

(60) Provisional application No. 60/296,358, filed on Jun. 5, 2001, and provisional application No. 60/297,057, filed on Jun. 7, 2001.

(51) Int. Cl.[7] ..... B02C 25/00

(52) U.S. Cl. ..... 241/21; 241/30; 241/34

(58) Field of Search ..... 241/30, 34, 28, 241/21, 36, 37, 261.2, 261.3

(56) References Cited

U.S. PATENT DOCUMENTS

| | | | |
|---|---|---|---|
| 1,151,131 | A | 8/1915 | Starliper |
| 2,116,584 | A | 5/1938 | Shelby |
| 2,335,358 | A | 11/1943 | Ray |
| 2,353,444 | A | 7/1944 | Conradty et al. |

(Continued)

FOREIGN PATENT DOCUMENTS

| | | |
|---|---|---|
| CA | 1303191 | 6/1992 |
| CA | 2183700 | 2/1997 |
| CH | 546 600 | 6/1972 |
| DE | 2145096 | 1/1973 |
| EP | 0 371 066 B1 | 5/1992 |
| EP | 0640395 A1 | 3/1995 |
| FR | 2339703 | 8/1977 |
| GB | 1 468 649 | 12/1975 |
| GB | 28667 | 1/2001 |

(Continued)

OTHER PUBLICATIONS

Allison, B.J., Isaksson, A.J., and Karlstrom, A., "Distributed Parameter Model of a TMP Refiner," Dept. of Signals, Sensors and Syst., R. Inst. Of Technol., Stockholm, Sweden, 1996.

Allison, B.M., Isaksson, A.J., and Karlstrom, A., "Grey–Box Identification of a TMP Refiner," 1995 International Mechanical Pulping Conference, Ottawa, Ontario, Canada, Jun. 12–15,–1995.

Dahlqvist, G., "Refiner Configuration and Sizing—an Economic Question or a Quality Problem," International Mechanical Pulping Conference, Stockholm, Sweden, 1985.

(Continued)

*Primary Examiner*—Mark Rosenbaum

(74) *Attorney, Agent, or Firm*—Michael Best & Friedrich LLP

(57) ABSTRACT

A system and method for monitoring and control operation of a rotary disk refiner. A characteristic of stock in the refining zone is monitored and used to adjust a parameter, such as dilution water, feed screw speed and/or refiner gap to keep some variable substantially constant, close to a setpoint, within a range of the setpoint, close to a setpoint profile based on a distribution of a characteristic over the refining zone or a setpoint profile range. Refiner disk bar angle can be optimized to reduce refining zone temperature and energy use. Thereafter, the control method can be employed. One control method attempts to keep specific energy substantially constant by keeping a ratio between load and production substantially constant. Load is kept substantially constant by regulation dilution flow to keep refining zone temperature substantially constant. The feed screw is regulated to keep production substantially constant.

3 Claims, 25 Drawing Sheets

U.S. PATENT DOCUMENTS 2,843,646 A 7/1958 Conant
3,069,752 A 12/1962 Sherning
3,091,844 A 6/1963 Laine
3,309,031 A 3/1967 McMahon et al.
3,379,578 A 4/1968 McTaggart et al.
3,466,200 A 9/1969 Mellor et al.
3,539,400 A 11/1970 Pustell
3,553,827 A 1/1971 Baker et al.
3,604,645 A 9/1971 Keyes, IV
3,617,006 A 11/1971 Jones
3,617,717 A 11/1971 Smith
3,650,891 A 3/1972 Dahlin
3,711,687 A 1/1973 Stout et al.
3,847,359 A 11/1974 Holmes et al.
3,867,205 A 2/1975 Schley
3,947,668 A 3/1976 Al-Shaikh et al.
4,023,739 A 5/1977 Lampe et al.
4,060,716 A 11/1977 Pekrul et al.
4,070,761 A 1/1978 Collins
4,071,451 A 1/1978 Wood
4,148,439 A 4/1979 Flodén
4,184,204 A 1/1980 Flohr
4,211,324 A 7/1980 Ohlbach
4,227,927 A 10/1980 Black et al.
4,268,381 A 5/1981 Hooper
4,313,465 A 2/1982 Holzem et al.
4,314,878 A 2/1982 Lee
4,430,221 A 2/1984 Spiewok
4,454,991 A 6/1984 Brenholdt
4,498,137 A 2/1985 Flohr
4,581,300 A 4/1986 Hoppin
4,581,813 A 4/1986 Terhune
4,582,568 A 4/1986 Iyengar
4,587,707 A 5/1986 Nishida et al.
4,614,296 A 9/1986 Lesgourgues
4,626,318 A 12/1986 Prough et al.
4,627,578 A 12/1986 Whyte
4,661,911 A 4/1987 Ellery, Sr.
4,670,215 A 6/1987 Morishita et al.
4,672,529 A 6/1987 Kupersmit
4,673,875 A 6/1987 Kjellzvist et al.
4,688,726 A 8/1987 Brenholdt
4,730,252 A 3/1988 Bradshaw
4,745,254 A 5/1988 Funk
4,820,980 A 4/1989 Dodson-Edgars
4,837,417 A 6/1989 Funk
4,858,103 A 8/1989 Takeuchi et al.
4,878,020 A 10/1989 Kärnä et al.
4,887,208 A 12/1989 Schneider et al.
4,920,488 A 4/1990 Filley
4,943,347 A 7/1990 Floden
4,950,986 A 8/1990 Guerrero
4,972,318 A 11/1990 Brown et al.
4,980,123 A 12/1990 Gedeon et al.
4,994,971 A 2/1991 Poelstra
5,007,985 A 4/1991 Engstrand et al.
5,009,774 A 4/1991 LeBlanc
5,011,065 A 4/1991 Musselmann
5,011,088 A 4/1991 Savonjousi
5,011,090 A 4/1991 Savonjousi
5,016,824 A 5/1991 Pietinen et al.
5,042,726 A 8/1991 Reinhall
5,063,380 A 11/1991 Wakura
5,064,536 A 11/1991 Bratten
5,067,660 A 11/1991 Reinhall
5,071,514 A 12/1991 Francis
5,081,039 A 1/1992 Buttke et al.
5,091,713 A 2/1992 Horne et al.
5,233,542 A 8/1993 Hohner et al.
5,425,508 A 6/1995 Chaney
5,445,328 A 8/1995 Musselman
5,491,340 A 2/1996 Saarinen
5,500,088 A 3/1996 Allison et al.
5,500,735 A 3/1996 Bentley et al.
5,544,819 A 8/1996 Shepherd
5,555,171 A 9/1996 Sonehara et al.
5,581,019 A 12/1996 Minor et al.
5,586,305 A 12/1996 Eidson et al.
5,600,058 A 2/1997 Preikschat et al.
5,601,690 A 2/1997 Gauld et al.
5,638,284 A 6/1997 Helmer et al.
5,666,493 A 9/1997 Wojcik et al.
5,680,320 A 10/1997 Helmer et al.
5,682,473 A 10/1997 Carson et al.
5,684,247 A 11/1997 Preikschat
5,687,098 A 11/1997 Grumstrup et al.
5,691,636 A 11/1997 Allshouse et al.
5,718,389 A 2/1998 Finken et al.
5,745,365 A 4/1998 Parker
5,747,707 A 5/1998 Johansson et al.
5,758,329 A 5/1998 Wojcik et al.
5,823,453 A 10/1998 Garasimowicz
5,825,653 A 10/1998 Huovila et al.
5,966,679 A 10/1999 Snowbarger et al.
5,975,438 A 11/1999 Garasimowicz
5,991,636 A 11/1999 Won et al.
6,024,309 A 2/2000 Karlström
6,092,003 A 7/2000 Hagart-Alexander et al.
D431,826 S 10/2000 Karlström
6,157,916 A 12/2000 Hoffman
6,200,421 B1 3/2001 Meinander
6,206,309 B1 3/2001 Danielsson et al.
6,290,816 B1 9/2001 Graf
6,314,381 B1 11/2001 Johansson
6,317,701 B1 11/2001 Pyotsia et al.
6,324,490 B1 11/2001 Johansson et al.
6,502,774 B1 1/2003 Johansson et al.
2001/0032898 A1 10/2001 Bankes et al.
2002/0013635 A1 1/2002 Gotou et al.

FOREIGN PATENT DOCUMENTS

WO WO 83/01969 6/1983
WO WO 89/00624 1/1989
WO WO 96/14156 5/1996
WO WO 97/23018 6/1997
WO WO 97/24596 7/1997
WO WO 97/38792 10/1997
WO WO 98/48936 11/1998
WO WO 98/58243 12/1998

OTHER PUBLICATIONS

Eriksson, Karin, Karlstrom, Anders, Rosenqvist, Fredrik, and Berg, Daniel, "The Impact of Different Input Variables in a Twin–Disc Refiner Line," Control Systems, Stockholm, Sweden, Jun. 2002.

Harkonen, E., Tienvieri, T., "The Influence of Production Rate on Refining in a Specific Refiner," International Mechanical Pulping Conference, Ottawa, Canada, Jun. 12–15, 1995.

Hoglund, H., Tistad, G., "Frequency and Temperature in Chip Refining,," No. 3, 19977, Paperi ja PUU—Papper och Tra.

Horch, A., Isaksson, A., Allison, B., Karlstrom, A., and Nilsson, L., "Dynamic Simulation of a Thermomechanical Pulp Refiner," Nordic Pulp and Paper Research Journal, vol. 12, No. 4, 1997.

Horch, A., Isaksson, A., Allison, B., Karlstrom, A., and Nilsson, L., "Dynamic Simulation of a TMP Refiner," Fourth International Refining Conference, Sweden, Mar. 18–20, 1997.

Isaksson, A.J., Horch, A., Allison, B.J., Karlstrom, A., and Nilsson, L., "Modelling of Mechanical Thrust in TMP Refiners," 1997 International Mechanical Pulping Conference, Stockholm, Sweden, Jun. 9–13, 1997.

Jackson, M., Danielsson, O., Falk B., "Thermopulp—a new energy efficient mechanical pulping process," SPCI, Stockhom, 1996.

Johansson, O., "Controlling high consistency refining conditions through refining zone temperature optimization," $6^{th}$ Pira International refining conference, Toronto, Canada, Mar. 28–29, 2001.

Karlstrom, A., "Modeling of Wood–Chip Refining Process," Nordic Pulp & Paper Research Journal, vol. 8, No. 4, Dec. 1993.

Karnis, A., "The Mechanism of Fibre Development in Mechanical Pulping," Journal of Pulp and Paper Science: vol. 20, No. 10, Oct. 1994.

Kure, K.–A., Dalhqvist, G., "Development of Structural Fiber Properties in High Intensity Refining," Pulp & Paper Canada, 1998.

Kure, K.–A., "On the relationship between process input variables and fibre characteristics in thermomechanical pulping." PhD–thesis 45:99. Dept. of Chemical Engineering, Norwegian University of Science and Technology, 1999.

Kure, K.–A., Sabourin, M.J., Dalhqvist, G., and Helle, T., "Adjusting Refining Intensity By Changing Refiner Plate Design and Rotational Speed—Effects on Structural Fibre Properties," $85^{th}$ Annual Meeting, Pulp and Paper Technical Association of Canada, 1999.

Murton, K.D., Corson, S.R., "Production Rate Effect on TMP Pulp Quality and Energy Consumption," Journal of Pulp and Paper Science, vol. 23, No. 8, Aug. 1997.

Rosenqvist, F., Eriksson, K., and Karlstrom, A., "Modelling a Thermomechanical Wood–Chip Refiner," In M.H. Hamza, editor, IASTED Conference, Modelling, Identification and Control, pp. 763–768, Innsbruck, Austria, Feb. 2002.

Rosenqvist, F., Eriksson, K., and Karlstrom, A., "Time–Variant Modelling of TMP Refining," IEEE IAS Workshop on Advanced Process Control, pp. 37–42, May 2001.

Rosenqvist, Fredrik, Berg, Daniel, Karlstrom, Anders, Eriksson, Karin, and Breitholtz, Claes, "Internal Interconnections in TMP Refining," IEEE Conference on Control Applications, Glasgow, UK, Aug. 2002.

Stationwala, M.I., Miles, K.B., Karnis, A., "Effect of Feed Rate on Refining," Journal of Pulp and Paper Science, vol. 20, No. 8, 1994.

Strand, B.C., Mokvist, A., Falk, B., Jackson, M., "The Effect of Production Rate on Specific Energy Consumption in High Consistency Chip Refining," The $18^{th}$ International Mechanical Pulping Conference, Oslo, Norway, Jun. 15–17, 1993.

Sundholm, J., "Can We Reduce Energy Consumption in Mechanical Pulping?" 1993 International Mechanical Pulping Conference, Oslo, Norway, Jun. 15–17, 1993, pp. 133–142.

Sundholm, J., Heikkurinen, A., and Mannstrom, B., "The Role of Rate of Rotation and Frequency in Refiner Mechanical Pulping," 1987 International Mechanical Pulping Conference, Vancouver, British Columbia, Canada, Jun. 2–5, 1987.

Uhmeier, A. and Salmen, L., "Repeated Large Radial Compression of Heated Spruce," PhD dissertation TRISTA PMT–Report 1995, Nordic Pulp and Paper Research Journal No. 3, 1996.

Uhmeier, A., Moroka, T., and Norimoto, M., Influence of Thermal Softening and Degradation on Radial Compression Behavior of Wet Spruce, STFI report, Holzforschung, vol. 52, Issue 1, 1998, pp. 77–81.

W.E. Lunan, K.B. Miles and W.D. May, *The Effect of Differential Pressure on Energy Consumption in Thermomechanical Pulping*, Journal of Pulp and Paper Science: vol. 11, No. 5, Sep. 1985, pp. J129–J135.

K.B. Miles and W.D. May, Pulp and Paper Research Institute of Canada, *Predicting the Performance of a Chip Refiner; A Constitutive Approach*, 1991 International Mechanical Pulping Conference, pp. 295–301.

H.R. Dana, W.D. May, K.B. Miles and B.G. Newman, Pulp and Paper Research Institute of Canada, Pointe Claire, P.Q., *A Study of Steam Flow and Self–Pressurization in Chip Refiners*, Transactions, vol. 1, No. 3, Sep. 1975, pp. 82–88.

K.B. Miles and W.D. May, Pulp and Paper Research Institute of Canada 1989 Annual Meeting, *The Flow of Pulp in Chip Refiners*, pp. A177–A188.

William Herbert and P.G. Marsh, *Mechanics and Fluid Dynamics of a Disk Refiner*, Tappi, vol. 51, No. 5, May 1968, pp. 235–239.

A Master's thesis by Alexander Horch, *Modeling and Control of a Thermo Mechanical Pulp Refiner*, Dec. 7, 1995.

Helmut Becker, Hans Höglund and Göran Tistad, *Frequency and temperature in chip refining*, Paperi ja Puu–Papper och Trä, No. 3, 1977.

D. Atack and M.I. Stationwala, Pulp and Paper Research Institute of Canada, *On the Measurement of Temperature and Pressure in the Refining Zone of an Open Discharge Refiner*, Transactions, vol. 1, No. 3, pp. 71–76, Sep. 1975.

Esko Härkönen, Seppo Ruottu, Ari Ruotu and Ola Johansson, *A Theoretical Model for a TMP–Refiner*, Jun. 9–13, 1997, pp. 95–102, 1997 International Pulping Conference, Stockholm, Sweden.

B.G. Newman, M.I. Stationwala and D. Atack, Pulp and Paper Research Institute of Canada, *Analysis of Steam Flow in Disc Refining*, SPCI International Mechanical Pulping Conference, May 6–10, 1985, pp. 60–67.

Per A Gradin, Ola Johansson, Jan–Erik Berg and Staffan Syström, *Measurement of the Power Distribution in a Single Disc Refiner*, J. Pulp Paper Science 25, No. 11: 384–387 (1999).

M.I. Stationwala, D. Atack, J.R. Wood, D.J. Wild, and A. Karnis, Pulp and Paper Research Institute of Canada, *The Effect of Control Variables on Refining Zone Conditions and Pulp Properties*, Pap. Puu 73, No. 1: 62–69 (Jan. 1991).

Marc. J. Sabourin, Eric Xu, j. Brad Cort, Ivan Boileau and Andrew Waller, *Optimizing Residence Time, Temperature and Speed to Improve TMP Pulp Properties and Reduce Energy*, Pulp Pap. Can. 98, No. 4: 38–45, Apr. 1997.

K.B. Miles, H.R. Dana and W.D. May, *The Flow of Steam in Chip Refiners*, CCPA Conf. Technol. E. Stivale 55–60 (Jun. 2–5, 1982), pp. 30–42.

REFINER CONTROL METHOD AND SYSTEM

CROSS-REFERENCE TO RELATED APPLICATIONS

This application is a continuation-in-part of presently U.S. patent application Ser. No. 09/799,109, filed Mar. 6, 2001 now U.S. Pat. No. 6,752,165. This application also claims priority under 35 U.S.C. § 119(e) to U.S. Provisional Patent Application No. 60/296,358, entitled "Method and Apparatus for Controlling Refiner Operation," filed in the U.S. Patent Office on Jun. 5, 2001, and U.S. Provisional Patent Application No. 60/297,057, entitled "Refiner Control Method and System," filed in the U.S. Patent Office on Jun. 7, 2001, the disclosures of which are expressly incorporated herein.

FIELD OF THE INVENTION

The present invention relates to a method and system for controlling operation of a rotary disk refiner that processes fiber. In particular, the invention relates to a method and system of regulating operation of a rotary disk refiner in response to a refiner process variable that is driven toward a set point or profile.

BACKGROUND OF THE INVENTION

Many products we use every day are made from fibers. Examples of just a few of these products include paper, personal hygiene products, diapers, plates, containers, and packaging. Making products from wood fibers, cloth fibers and the like, involves breaking solid matter into fibrous matter. This also involves processing the fibrous matter into individual fibers that become fibrillated or frayed so they more tightly mesh with each other to form a finished fiber product that is desirably strong, tough, and resilient.

In fiber product manufacturing, refiners are devices used to process the fibrous matter, such as wood chips, pulp, fabric, and the like, into fibers and to further fibrillate existing fibers. The fibrous matter is transported in a liquid stock slurry to each refiner using a feed screw driven by a motor. Each refiner has at least one pair of circular ridged refiner discs that face each other. During refining, fibrous matter in the stock to be refined is introduced into a gap between the discs that usually is quite small. Relative rotation between the discs during operation causes the fibrous matter to be fibrillated as the stock passes radially outwardly between the discs.

One example of a refiner that is a disc refiner is shown and disclosed in U.S. Pat. No. 5,425,508. However, many different kinds of refiners are in use today. For example, there are counterrotating refiners, double disc or twin refiners, and conical disc refiners. Conical disc refiners are often referred to in the industry as CD refiners.

Each refiner has at least one motor coupled to a rotor carrying at least one of the refiner discs. During operation, the load on this motor can vary greatly over time depending on many parameters. For example, as the mass flow rate of the stock slurry being introduced into a refiner increases, the load on the motor increases. It is also known that the load on the motor will decrease as the flow rate of dilution water is increased.

During refiner operation, a great deal of heat is produced in the refining zone between each pair of opposed refiner discs. The refining zone typically gets so hot that steam is produced, which significantly reduces the amount of liquid in the refining zone. This reduction of liquid in the refining zone leads to increased friction between opposed refiner discs, which increases the load on the motor of the refiner. When it becomes necessary to decrease this friction, water is added to the refiner. The water that is added is typically referred to as dilution water.

One problem that has yet to be adequately solved is how to control refiner operation so that the finished fiber product has certain desired characteristics that do not vary greatly over time. For example, paper producers have found it very difficult to consistently control refiner operation from one hour to the next so that a batch of paper produced has consistent quality. As a result, it is not unusual for some paper produced to be scrapped and reprocessed or sold cheaply as job lot. Either way, these variations in quality are undesirable and costly.

Another related problem is how to control refiner operation to repeatedly obtain certain desired finished fiber product characteristics in different batches run at different times, such as different batches run on different days. This problem is not trivial as it is very desirable for paper producers be able to produce different batches of paper having nearly the same characteristics, such as tear strength, tensile strength, brightness, opacity and the like.

In the past, control systems and methods have been employed that attempt to automatically control refiner operation to solve at least some of these problems. One common control system used in paper mills and fiber processing plants throughout the world is a Distributed Control System (DCS). A DCS communicates with each refiner in the mill or fiber processing plant and often communicates with other fiber product processing equipment. A DCS monitors operation of each refiner in a particular fiber product processing plant by monitoring refiner parameters that typically include the main motor power, the dilution water flow rate, the hydraulic load, the feed screw speed, the refiner case pressure, the inlet pressure, and the refiner gap. In addition to monitoring refiner operation, the DCS also automatically controls refiner operation by attempting to hold the load of the motor of each refiner at a particular setpoint. In fact, many refiners have their own motor load setpoint. When the motor load of a particular refiner rises above its setpoint, the DCS adds more dilution water to the refiner to decrease friction. When the motor load decreases below the setpoint, dilution water is reduced or stopped.

During refiner operation, pulp quality and the load on the refiner motor vary, sometimes quite dramatically, over time. Although the aforementioned DCS control method attempts to account for these variations and prevent the aforementioned problems from occurring, its control method assumes that the mass flow of fibrous matter in the stock entering the refiner is constant because the speed of the feed screw supplying the stock is constant. Unfortunately, as a result, there are times when controlling the dilution water flow rate does not decrease or increase motor load in the desired manner. This disparity leads to changes in refining intensity and pulp quality because the specific energy inputted into refining the fibrous matter is not constant. These changes are undesirable because they ultimately lead to the aforementioned problems, as well as other problems.

Hence, while some refiner process control methods have proven beneficial in the past, they in no way have resulted in the type of control over finished fiber product parameters and the repeatability of these parameters that is desired. Thus, additional improvements in refiner process control are needed.

SUMMARY OF THE INVENTION

A system for and method of monitoring and controlling operation of a disc refiner. The method regulates operation of a refiner in response to a refiner process variable preferably in relation to a setpoint. In one preferred implementation, the process variable is based on a temperature. In another implementation, the process variable is based on a pressure. In still another preferred implementation, the process variable is based on a stock consistency. In a further preferred implementation, operation of the refiner can be regulated in response to a refiner energy parameter or a parameter related thereto.

In one implementation, the volumetric flow rate of stock entering the refiner is regulated. In another implementation, the flow rate of dilution water entering the refiner is regulated. In still another implementation, both the stock volumetric flow rate and the dilution water flow rate are regulated.

In one preferred implementation, the volumetric flow rate of stock is regulated in response to a measured or calculated refiner temperature. In another preferred implementation, the dilution water to the refiner is regulated based on the refiner temperature.

In one preferred implementation, the volumetric flow rate of stock is regulated in response to a measured or calculated refiner pressure. In another preferred implementation, the dilution water to the refiner is regulated based on the refiner pressure.

In another preferred implementation, the dilution water to the refiner is regulated based on stock consistency. In still another preferred method, the volumetric flow rate of the stock is regulated based on stock consistency.

If desired, two or more of these parameters can be regulated based on the same process variable. For example, regulation of volumetric flow rate and dilution water can both be based on refiner temperature. Regulation of volumetric flow rate and dilution water can also both be based on refiner pressure. If desired, regulation of volumetric flow rate and dilution water can also both be based on stock consistency.

The refiner temperature is a temperature of stock inside the refiner or adjacent its inlet or outlet. In one preferred implementation, the refiner temperature is a temperature of stock in the refining zone. Where there is more than one sensor in the refining zone, the temperature can be provided by a particular selected sensor or calculated based on the sensor data from more than one sensor. In one preferred embodiment, temperature measurements from multiple sensors are averaged.

The refiner pressure preferably is a pressure of stock inside the refiner, such as a pressure in the refining zone, or a pressure inside the refiner adjacent the refiner inlet or outlet. Where there is more than one sensor in the refining zone, the pressure can be provided by a particular selected sensor or calculated based on the sensor data from more than one sensor. In one preferred embodiment, pressure measurements from multiple sensors are averaged.

Stock consistency can be determined using a consistency sensor upstream or downstream of the refiner. Where a consistency sensor is used, the sensor is located upstream of the refiner, preferably adjacent the refiner inlet.

Stock consistency can also be determined using a novel method that is based on a temperature or a pressure (or both) inside the refiner, preferably inside the refining zone. In one preferred implementation, the method uses temperature or pressure measured inside the refining zone along with other refiner parameters in determining the consistency of stock in the refining zone as a function of time and location in the refining zone. This method advantageously permits consistency of stock to be determined in real time in the refining zone.

A refiner energy related parameter includes refiner energy or power measured in real time. Other refiner energy related parameters include motor load, refiner gap, refiner plate force, hydraulic energy input, or another refiner energy related parameter. Where volumetric stock flow is regulated, it preferably is regulated by controlling the speed of a feed screw that provides the refiner with stock. Where dilution water flow is regulated, it preferably is regulated by controlling operation of the dilution pump. Other refiner parameters can be controlling using the method of this invention.

So that the process can be controlled despite changes in refiner operation not due to regulation using the method, one preferred implementation pauses to permit refiner operation to stabilize before resuming regulation of refiner operation. For example, where an operator manually changes refiner operation, regulation is paused preferably until refiner operation stabilizes. The same is true where a refiner is also subject to control of a processing device, such as a Distributed Control System (DCS).

In one preferred embodiment, the method is implemented in the form of a controller that preferably is a PI or a PID controller. If desired, a proportional controller can be used. The controller can be a digital or analog controller and can be configured to operate with a digital processor such as a personal computer, a DCS, a programmable controller or the like.

The system includes a processor that receives data related to refiner operation. Suitable data includes data related to the process variable or variables used in regulating refiner operation. In one preferred embodiment, the processor receives data related to one or more of the following parameters: the power inputted into the refiner, the feed screw speed (or volumetric stock flow or feed rate), the temperature of the stock before it enters the refiner, the temperature of stock after it leaves the refiner, a refiner temperature, a refiner pressure, the force exerted on the refiner disks urging them together, the dilution motor power of the dilution pump, the chip washing water temperature, the dilution water temperature, the gap between the refiner disks, as well as other parameters.

In carrying out the method, the processor outputs at least one control signal. Each control signal can be directly provided to the refiner or a component related to the refiner, such as the feed screw or dilution water pump. If desired, each control signal can be provided to another processor, such as a DCS, that causes the DCS to regulate the desired parameter. For example, a control signal can be provided to the DCS that causes the DCS to change feed screw speed. Another control signal can be provided to the DCS that causes the dilution water flow rate to change.

One preferred embodiment of the system uses one or more sensors in the refining zone to provide sensor data from which a process variable calculation or measurement can be made. In one preferred embodiment, the one or more sensors are temperature sensors but can be pressure sensors or a combination of temperature and pressure sensors.

In one preferred embodiment, each sensor is carried by a refiner disk or segment of the disk. In one preferred sensor disk or sensor disk segment, each sensor is imbedded in the refining surface of the disk or segment.

In a preferred sensor embodiment, the sensor has a sensing element carried by a spacer that spaces the sensing element from the material of the disk or segment in which it is imbedded. One preferred spacer is made from an insulating material that preferably thermally insulates the sensing element from the thermal mass of the refiner disk material.

In a control method, operation of a refiner is controlled by controlling operation of a parameter in response to a process variable used in control that relates to a characteristic of stock in a refining zone of the refiner. In one embodiment, dilution water flow rate, stock mass flow, and/or gap is regulated in response to a process variable used for control that relates to the characteristic. In one preferred implementation, the characteristic is a temperature, heat flux and/or temperature in the refining zone that preferably is a temperature, heat flux and/or pressure of stock in the refining zone measured or sensed in real time during refiner operation.

In a method of optimizing operation, refiner disks with varying bar angles are trialed and a profile of a characteristic of stock in the refining zone is measured and compared against an optimum profile. The disks having the bar angle that produces a profile closest to optimum is selected and implemented in the refiner.

In one preferred control method, refiner operation is controlled to maintain a substantially constant specific energy preferably by maintaining substantially constant a ratio of production versus load. Load is preferably kept substantially constant by regulating dilution water flow rate to keep a characteristic of stock in the refining zone, preferably temperature, substantially constant. Production preferably is kept substantially constant by regulating feed screw speed to regulate stock mass flow rate.

Other objects, features, and advantages of the present invention include: a monitoring and control system and method that is simple, flexible, reliable, and robust, and which is of economical manufacture and is easy to assemble, install, and use.

Other objects, features, and advantages of the present invention will become apparent to those skilled in the art from the detailed description and the accompanying drawings. It should be understood, however, that the detailed description and accompanying drawings, while indicating at least one preferred embodiment of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout and in which.

DETAILED DESCRIPTION OF AT LEAST ONE PREFERRED EMBODIMENT

Figure 1:
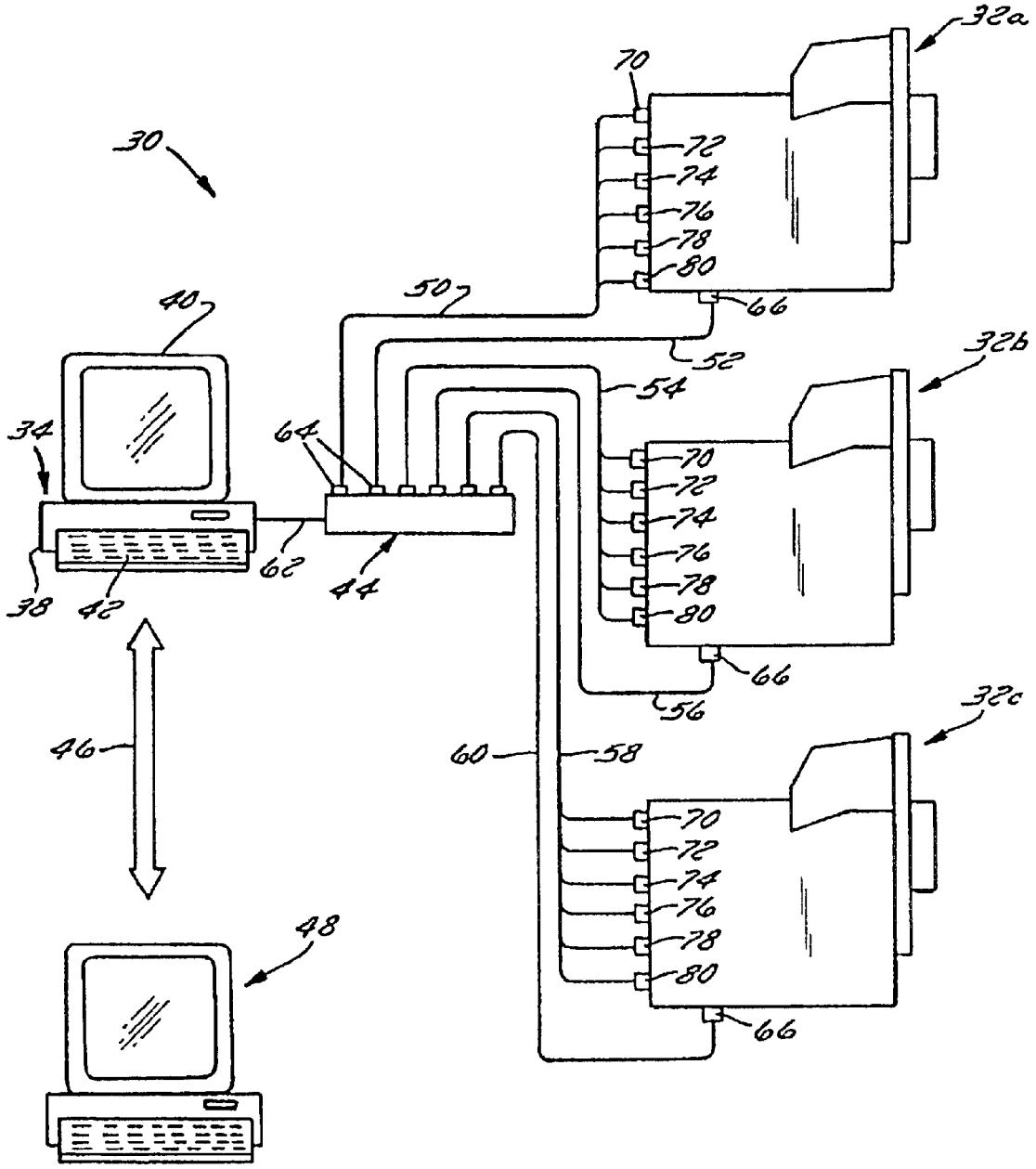
FIG. 1 is a schematic view of a first embodiment of a refiner monitoring and control system.

FIG. 1 schematically illustrates a system 30 for controlling operation of one or more disc refiners 32*a*, 32*b*, or 32*c*. The system includes a control processor 34 that regulates the mass flow of stock entering the refiner in response to one or more monitored or calculated parameters, at least one of which preferably is related to conditions inside a refining zone of the refiner. In one preferred embodiment, the control processor 34 controls operation of a feed screw 66 that supplies the refiner with stock. The control processor 34 can also be used to control the flow rate of dilution water to the refiner. The mass flow is regulated to help keep a process variable at or desirably close to a setpoint that can change during operation. When some aspect of refiner operation is changed, the control processor 34 stops regulating mass flow for a period of time to allow the change to take effect and cause a new setpoint to be reached. The control processor 34 then resumes regulating mass flow using the new setpoint.

In a preferred embodiment of the system 30, the processor 34 comprises a computer 38 that can include a display 40, and one or more input/output devices 42, such as a keyboard and/or a mouse. Input/output devices can also include I/O ports such as parallel, serial, Firewire, slots, and USB, to name a few. Such a computer 38 can be a personal computer, a mainframe computer, a programmable controller, or another type of processing device. If desired, the computer 38 can have on-board memory and can have an on-board storage device. If desired, the computer can be a portable computer, such as a laptop or notebook computer. The computer can be equipped with or connected to a communications device, such as a modem, a router, a LAN connection or other device, that enables it to communicate over a computer network and which can permit FTP or Internet access. Access can be provided, for example, via cable, DSL, telephone line, wireless, or another communications means.

In the preferred embodiment shown in FIG. 1, the processor 34 preferably also has, includes or is connected to an input/output device 44 that comprises at least one data acquisition device, or a data acquisition system capable of receiving data from one or more of the refiners 32*a*, 32*b*, and 32*c*. For example, in the embodiment of FIG. 1, at least three refiners 32*a*, 32*b*, and 32*c* are linked to the processor 34. This device 44 can be a separate component linking the processor 34 and the refiners 32*a*, 32*b*, and 32*c* in the manner depicted in FIG. 1, or it can be an integral part of the processor 34.

The processor 34 and input/output device 44 can be housed in a cabinet 82 (FIG. 3), box or module that can be located in a fiber processing plant, such as a paper mill, a pulp processing plant, or the like. The display 40 can be remotely located, such as in a control room of the fiber processing plant. If desired, the processor 34 can be a Distributed Control System (DCS) at the fiber processing plant or it can be a component of the DCS. If desired, the processor 34 can work in conjunction with a DCS at the plant.

The processor 34 can communicate via a link 46 with an off-site computer 48 that is used for troubleshooting and downloading updates or changes to the method of refiner control carried out by the processor 34. Such a link 46 can be a wireless link or a wire link between computers 38 and 48. Examples of suitable links 46 include a link via the Internet, such as an FTP or TCP/IP link, or a direct telephone link. Access can be provided in the manner previously mentioned.

The processor 34 is directly or indirectly connected by links, indicated by reference numerals 50–60 in FIG. 1, to each one of refiners 32*a*, 32*b* and 32*c*. For example, one or more of the links 50–60 can comprise a cable or a wireless communication link or the like.

The processor 34 is shown in FIG. 1 as being connected by a link 62 to the input/output device 44. In one preferred embodiment, the device 44 is a data acquisition and control system that includes ports or modules 64. Where data acquisition is needed, each port or module can comprise a data acquisition card. If desired, the device 44 can be comprised of one or more data acquisition cards installed in slots inside computer 38. While FIG. 1 depicts a link from each one of the refiners 32*a*, 32*b*, and 32*c* running to a single card or module, a dedicated card or module can accept two or more such links.

Each refiner 32*a*, 32*b*, and 32*c* has a plurality of sensors that provide data to the processor 34. For example, data from at least one sensor 70 relating to temperature, pressure or a combination of temperature and pressure can be communicated via link 50 to processor 34. Data from other sensors 72–80 can also be directly or indirectly utilized. For example, sensors 72–80 can provide data relating to one or more of the following parameters: refiner main motor power, refiner plate force, the refiner gap, the rate of flow of dilution water added during refining, conveyor screw rotation, the flow rate of fibrous matter being introduced into the refiner, as well as consistency. Where the processor 34 is a DCS, all of this sensor data is obtained during refiner operation. Where the processor 34 is connected to a DCS, it can obtain at least some of this data from the DCS, preferably during refiner operation.

Where refiner main motor power is monitored, an example of a suitable sensor is one that senses the voltage or current from a current transformer coupled to the refiner motor. Where main motor power is monitored, an example of a suitable sensor is one that senses the voltage or current from a current transformer coupled to the refiner motor. Where refiner plate force is monitored, examples of suitable sensors include one or more of the following: an accelerometer, a strain gauge, or a pressure sensor that senses the pressure or force urging the refiner plates toward each other. Where refiner gap is monitored, examples of sensors include one or more of the following: an inductive sensor carried by at least one of the refiner plates or a Hall effect sensor. Where rate of flow of dilution water is monitored, a flow meter can be used. Where conveyor screw rotation is monitored, a sensor on the conveyor screw motor can be used to provide, for example, the rate of screw rotation. Other methods and means can be used. For example, the motor itself can be monitored to determine rate of screw rotation. A flow meter is an example of a sensor that can be used to provide data from which a flow rate of fibrous matter into the refiner can be obtained. Where a flow meter is used, suitable examples include, a paddle-wheel type sensor, an optical sensor, a viscosity meter, or another type of flow meter or sensor from which flow can be derived. Sensor data from one or more sensors, including the aforementioned sensors, can be used in making a consistency measurement that can be used as a setpoint by the processor 34.

A number of these refiner-related sensors and other sensors that can be monitored by the system 30 of this invention are disclosed in more detail in one or more of U.S. Pat. Nos. 4,148,439; 4,184,204; 4,626,318; 4,661,911; 4,820,980; 5,011,090; 5,016,824; 5,491,340; and 5,605,290, the disclosures of each of which are expressly incorporated herein by reference.

Figure 2:
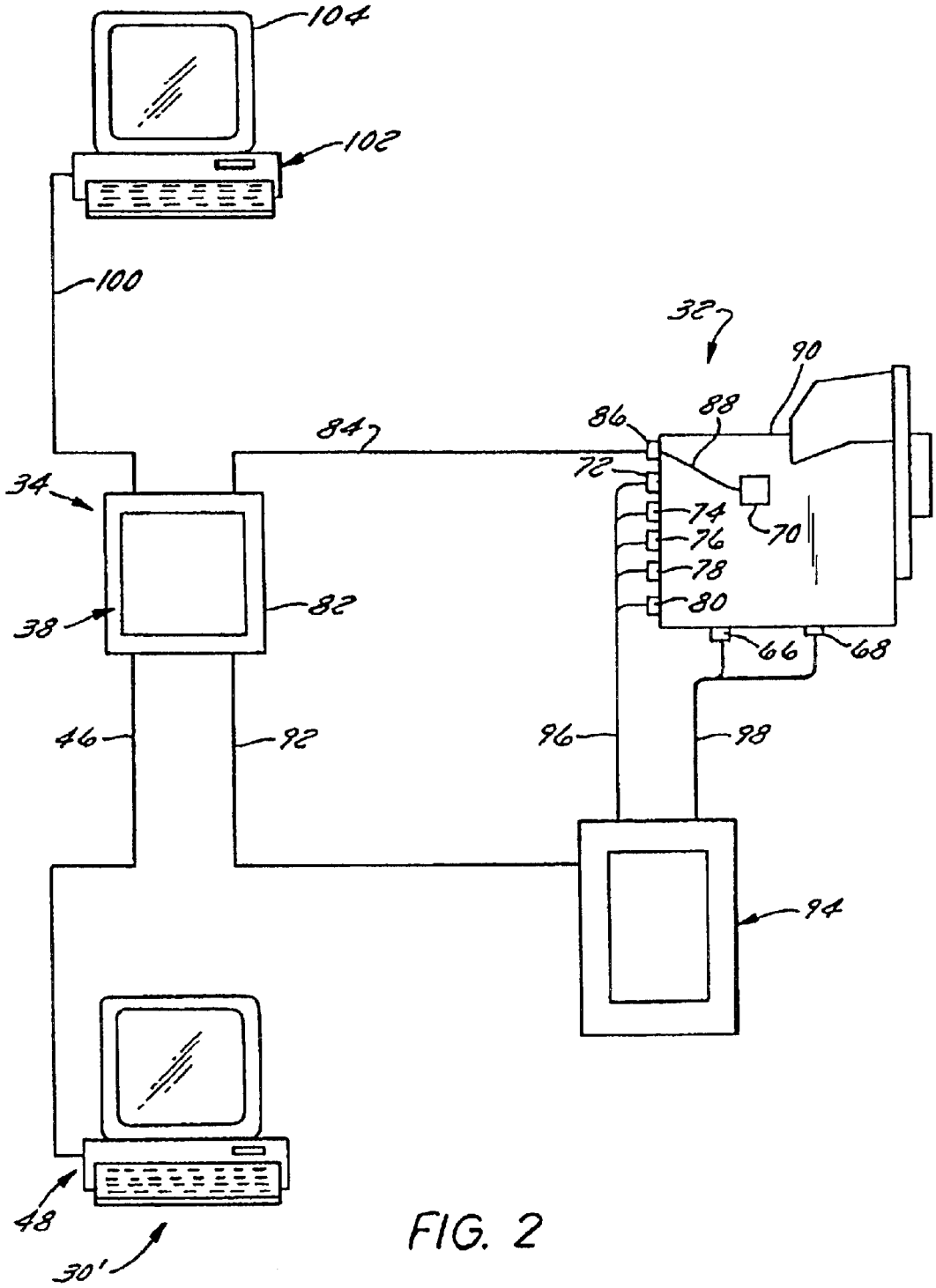
FIG. 2 is a schematic view of a second embodiment of a refiner monitoring and control system.

FIG. 2 schematically illustrates another preferred embodiment of system 30'. The control processor 34 is a computer 38 that is located in a cabinet 82 that is located on site. There is a link 84 from the processor 34 to a signal conditioner 86 carried by the refiner 32. The signal conditioner 86 is attached by another link 88 to each sensor 70.

The signal conditioner 86 connects with each sensor 70 and converts the sensor output to a signal, such as an electrical signal, that is transmitted to the processor 34. For example, one preferred signal conditioner 86 typically outputs a current (e.g., for each sensor) in the range of between four and twenty milliamperes. The magnitude of the signal depends upon the input to the sensor (and other factors including the type of sensor or sensors) and provides the processor the information from which it can determine a sensor measurement. If desired, more than one signal conditioner can be mounted to the casing or housing of the refiner 32. As is depicted in FIG. 2, the signal from each sensor 70 can first be communicated by a link 84 to a DCS 94 before being communicated to processor 34. In some instances, a signal conditioner 86 may not be needed.

The processor 34 is connected by a communications link 100, such as a phone line, to a device 102 located in a control room that preferably is located in the fiber processing plant. The device 102 can be a computer and includes a display 104 upon which graphical information and/or other information or data is shown that relates to refiner operation and control.

The processor 34 is depicted in FIG. 2 as being connected by another communications link 92 to a DCS 94 that preferably is located on site. The DCS 94 is connected by a second link 96 to one or more of refiner sensors 72, 74, 76, 78, and 80 that provide the DCS 94 with information about a number of parameters that relate to refiner operation. A third link 98 connects the DCS 94 to each feed screw motor (or feed screw motor controller) 66 and each dilution water motor (or feed screw motor controller) 68, only one of which is schematically depicted in FIG. 2. The link 98 can include a separate link to each feed screw motor (or motor controller) 66 and each dilution water motor (or motor controller) 68 for that particular refiner 32. At least one of the purposes of link 98 is to convey control signals from the DCS 94 to each feed screw motor (or motor controller) 66 and each dilution water motor (or motor controller) 68 to control their operation. Another purpose of link 98 can be to provide feedback about motor speed so that the mass flow rate of the feed screw and flow rate of dilution water can be determined.

The link 92 provides the processor 34 with information from the DCS 94 that preferably includes the main motor power of the refiner 32, the force exerted on the refiner disks urging them together (e.g., hydraulic pressure or force), the dilution motor power of the refiner for each dilution pump, DCS ready status, several other DCS signals, the refiner case pressure, the refiner inlet pressure, the chip washing water temperature, the dilution water temperature, as well as the gap between refiner disks. The link 92 also enables the processor 34 to communicate with the DCS 94 to cause the DCS 94 to change the mass flow rate of stock entering the refiner 32. The link 92 can also be used by the processor 34 to communicate with the DCS 94 to change the rate of flow of dilution water entering the refiner 32. The link 92 preferably comprises a bidirectional communications link. Communication preferably is in the form of a digital or analog control signal sent by the processor 34 to the DCS 94.

Figure 3:
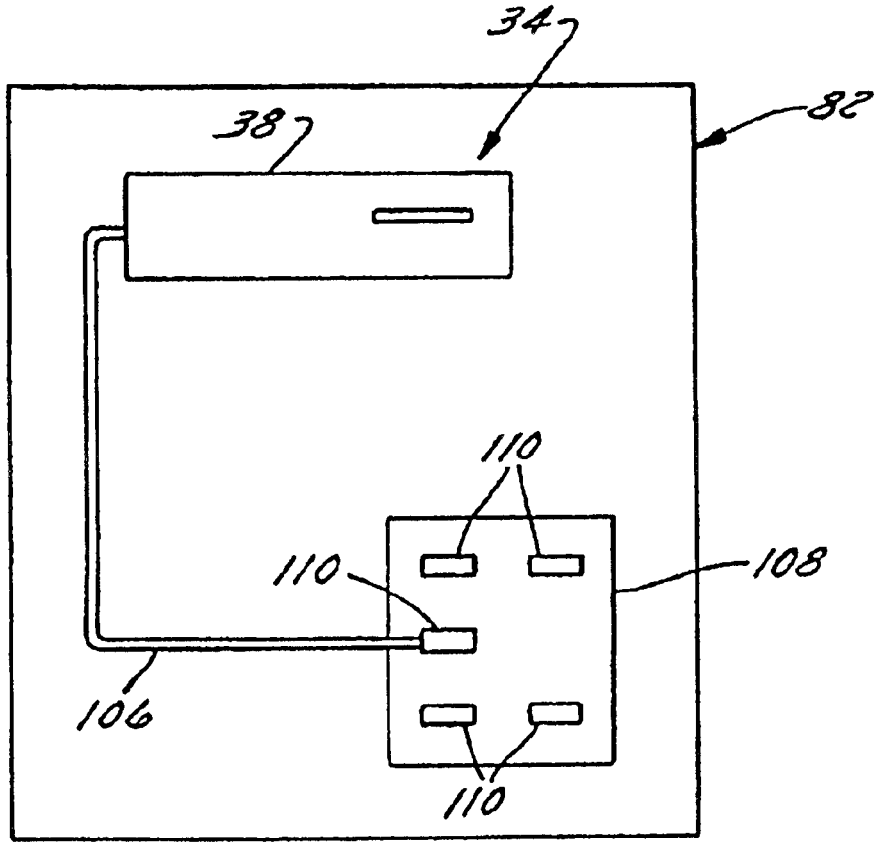
FIG. 3 is front plan view of a cabinet housing a control computer of the refiner monitoring and control system.

FIG. 3 depicts the contents of a cabinet 82 that houses the processor 34. In addition to any needed data acquisition modules, cards, or data acquisition system(s) (not shown in FIG. 3), the processor 34 can communicate via a link 106 with a connector box 108 that includes a plurality of calibration storage modules 110. Each calibration module 110 provides storage to hold calibration data for a particular sensor or a particular set of sensors 70. Each calibration module 110 has on board storage or memory, such as an EPROM, EEPROM, or the some other storage media, that holds sensor calibration data. When data is read from a particular sensor or a particular set of sensors 70, the calibration data that relates to that particular sensor or that particular group of sensors 70 is applied to make the resultant sensor measurement more accurate.

In another preferred embodiment where it is not desired to employ calibration modules, the processor 34 can be used to download the calibration data via the Internet or FTP using a corresponding communications link. For example, where a particular sensor or set of sensors is delivered to the fiber processing plant for installation, an associated identification indicia, such as a set of numbers of alphanumeric characters, that is assigned to the sensor or sensors, can be used to retrieve the calibration data from a manufacturer, shipper, distributor or calibrator of the sensors.

The refiner 32 can be a refiner of the type used in thermomechanical pulping, refiner-mechanical pulping, chemithermomechanical pulping, or another type of pulping or fiber processing application where a rotary disk refiner is used. The refiner 32 can be a counterrotating refiner, a double disc or twin refiner, or a conical disc refiner known in the industry as a CD refiner.

Figure 4:
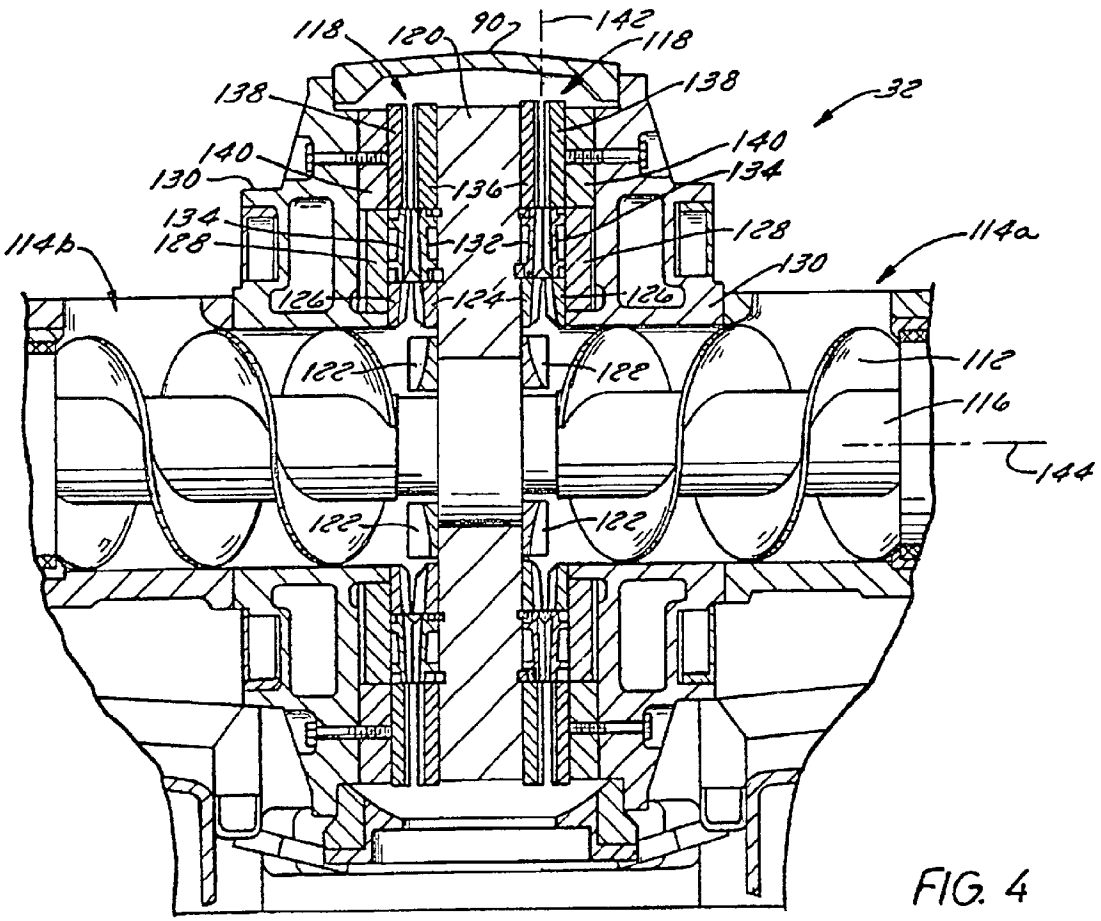
FIG. 4 is a fragmentary cross sectional view of an exemplary twin refiner.

An example of a refiner 32 that is a double disc or twin refiner is shown in FIG. 4. The refiner 32 has a housing or casing 90 and an auger 112 mounted therein which urges a stock slurry of liquid and fiber introduced through stock inlets 114*a* and 114*b* into the refiner 32. The auger 112 is a fiber transport device that is carried by a shaft 116 that rotates during refiner operation to help supply stock to an arrangement of treating structure 118 within the housing 90. An annular flinger nut 122 is generally in line with the auger 112 and directs the stock radially outwardly to a plurality of opposed sets of breaker bar segments 124 and 126.

Each set of breaker bar segments 124 and 126 preferably is in the form of sectors of an annulus, which together form an encircling section of breaker bars. One set of breaker bar segments 124 is carried by a rotor 120. The other set of breaker bar segments 126 is carried by another portion of the refiner 32, such as a stationary mounting surface 128, e.g., a stator, of the refiner or another rotor (not shown). The stationary mounting surface 128 can comprise a stationary part 130 of the refiner frame, such as the plate shown in FIG. 4.

Stock flows radially outwardly from the breaker bar segments 124 and 126 to a radially outwardly positioned set of opposed refiner discs 132 and 134. This set of refiner discs 132 and 134 preferably is removably mounted to a mounting surface. For example, disc 132 is mounted to the rotor 120 and discs 134 are mounted to mounting surface 128.

The refiner 32 is depicted as having a second set of refiner discs 136 and 138 positioned radially outwardly of the first set of discs 132 and 134. The refiner discs 136 and 138 preferably are also removably mounted. For example, disc 136 is mounted to the rotor 120 and disc 138 is mounted to a mounting surface 140. Each pair of discs of each set are spaced apart so as to define a small gap between them that typically is between about 0.005 inches (0.127 mm) and about 0.125 inches (3.175 mm). Each disc can be of unitary construction or can be comprised of a plurality of segments.

The first set of refiner discs 132 and 134 is disposed generally parallel to a radially extending plane 142 that typically is generally perpendicular to an axis 144 of rotation of the auger 112. The second set of refiner discs 136 and 138 can also be disposed generally parallel to this same plane 142. This plane 142 passes through the refiner gap and refining zone between each pair of opposed refiner disks. Depending on the configuration and type of refiner, different sets of refiner discs can be disposed in different planes.

During operation, the rotor 120 and refiner discs 132 and 136 rotate about axis 144 causing relative rotation between refiner discs 132 and 136 and refiner discs 134 and 138. Typically, each rotor 120 is rotated at a speed of between about 400 and about 3,000 revolutions per minute. During operation, fiber in the stock slurry is refined as it passes between the discs 132, 134, 136, and 138.

Figure 5:
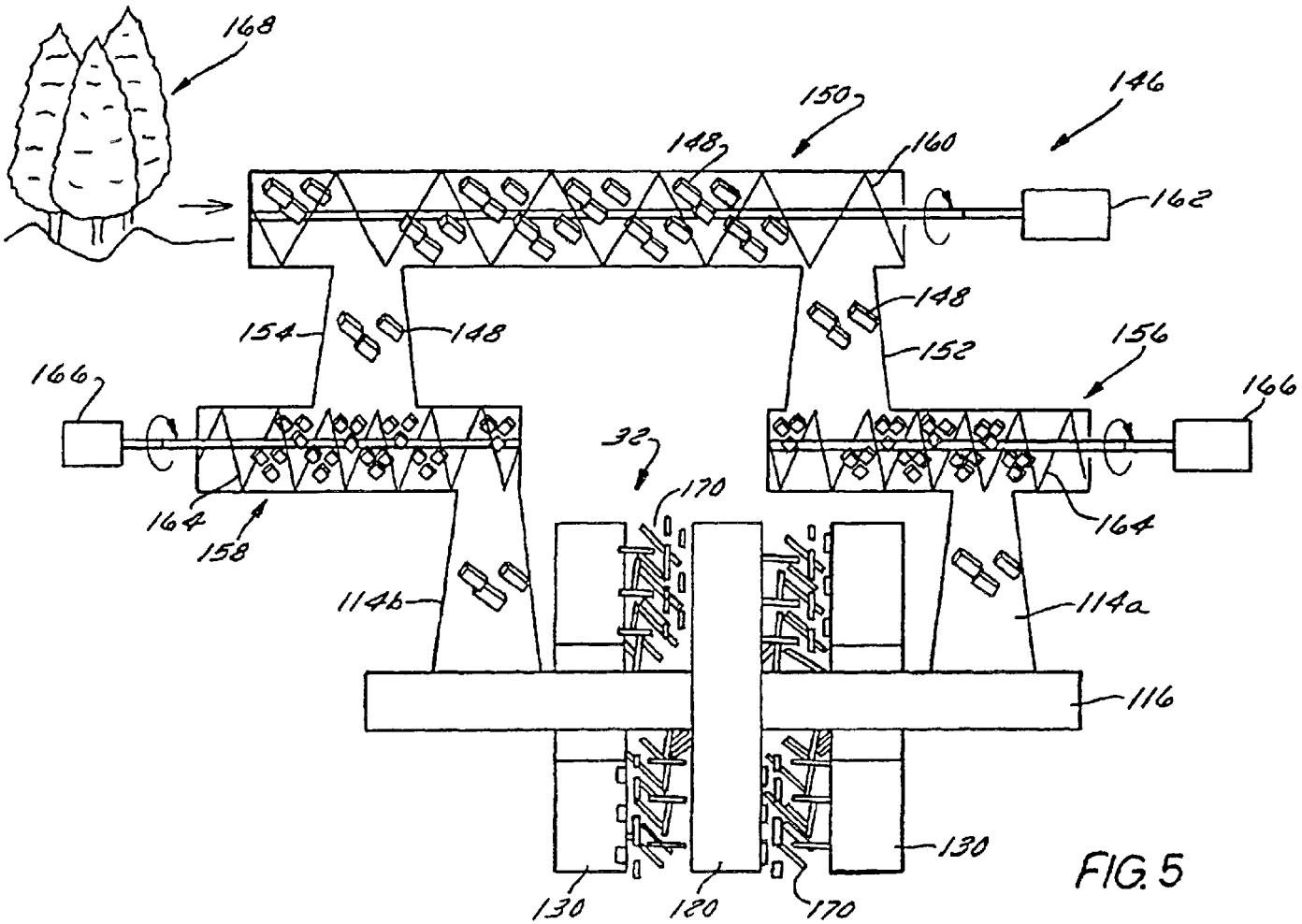
FIG. 5 is a schematic of a system for supplying the refiner with stock.

FIG. 5 schematically depicts the refiner 32 and includes a fiber delivery system 146 for delivering fibrous matter or fiber to be refined 150 to each inlet 114*a* and 114*b* of the refiner 32. The fibrous matter or fiber 148 can be in the form of wood chips, pulp, fabric, or another fiber used in the manufacturing of products made from, at least in part, fiber. The fiber 148 preferably is carried by or entrained in a liquid to form a stock slurry.

In the exemplary preferred embodiment shown in FIG. 5, the fiber 148 is transported along a fiber transport conveyor 150 that urges fiber (preferably in a stock slurry) along its length until it reaches an outlet that can be connected directly or indirectly to a refiner. In the embodiment shown in FIG. 5, the fiber transport conveyor 150 has outlets 152 and 154 that are each connected to a metering conveyor 156 and 158. Each metering conveyor, in turn, is connected to one of the refiner inlets 114*a* and 114*b*. This arrangement advantageously enables mass flow to be separately and more precisely metered to each refiner inlet 114*a* and 114*b* of a double disc refiner or the like. This arrangement can also be used to distribute and meter fiber 148 to two, three, four, or more refiners using a common conveyor 150 and a separate metering conveyor for each refiner.

In one preferred embodiment, the fiber transport conveyor 150 includes an auger or screw 160 driven by a motor 162 that can be, for example, an electric motor or a hydraulic motor. The motor 162 can be controlled by the DCS 94 or directly controlled by control processor 34, if desired, in regulating mass flow. Where a metering conveyor is used, each metering conveyor 156 and 158 preferably includes an auger or screw 164 driven by a motor 166. Each motor 166 of each metering conveyor 156 and 158 is controlled by the DCS 94 or by processor 34.

As is shown in FIG. 5, trees (e.g., logs) 168 typically are processed into chips 148 that are transported by conveyor 150 to an outlet 152 or 154. Chips 148 pass from one of the outlets to one of the metering conveyors 156 or 158. The metering rate of each metering conveyor 156 and 158 is controlled by processor 34 to regulate the mass flow rate of stock entering each refiner inlet 114*a* and 114*b*. After being refined by the refiner 32, the refined fiber 170 can be transported to another refiner for further refining, a screen or other filter, or to the fiber processing machine, such as a paper machine, that processes the refined fiber 140 into a product.

Figure 6:
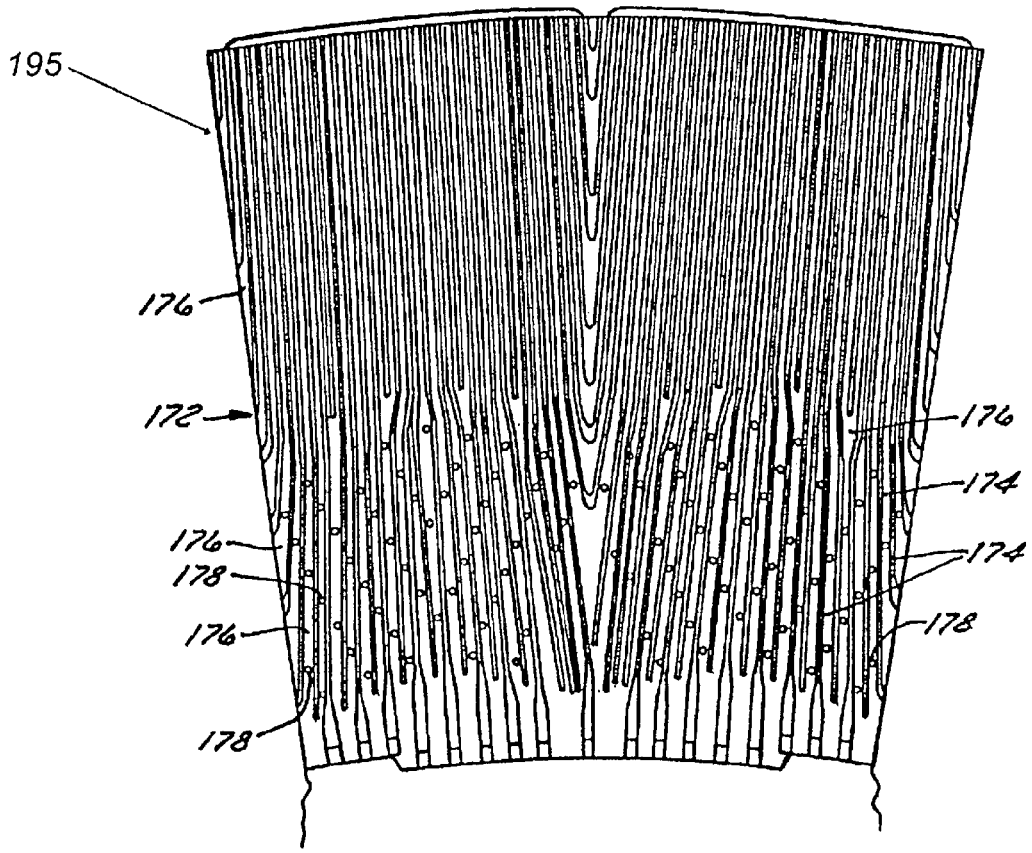
FIG. 6 is a front plan view of an exemplary refiner disk segment.

FIG. 6 depicts an exemplary segment 172 of a refiner disk that preferably is removable so it can be replaced, such as when it becomes worn. The segment 172 comprises a refining surface 195 that includes a plurality of pairs of spaced apart and upraised bars 174 that define grooves or channels 176 therebetween. The pattern of bars 174 and grooves 176 is an exemplary pattern as any pattern of bars 174 and grooves 176 can be used. If desired, surface or subsurface dams 178 can be disposed in one or more of the grooves 176. It is contemplated that the method and apparatus of the invention will work with refiner disks and refiner disk segments that have a refining surface that lacks bars and/or grooves.

During refining, fiber in the stock that is introduced between opposed refiner disks is refined by being ground, abraded, or mashed between opposed bars 174 of the disks preferably thereby fibrillating the fiber. Stock disposed in the grooves 176 and elsewhere between the disks flows radially outwardly and can be urged in an axial direction by dams 178 to further encourage refining of the fiber. Depending on the construction, arrangement and pattern of bars 174 and grooves 176, differences in angle between the bars 174 of opposed disks due to relative movement between the disks can repeatedly occur. Where and when such differences in angle occur, radial outward flow of stock between the opposed disks is accelerated or pumped. Where and when the bars 174 and grooves 176 of the opposed disks are generally aligned, flow is retarded or held back.

Figure 7A:
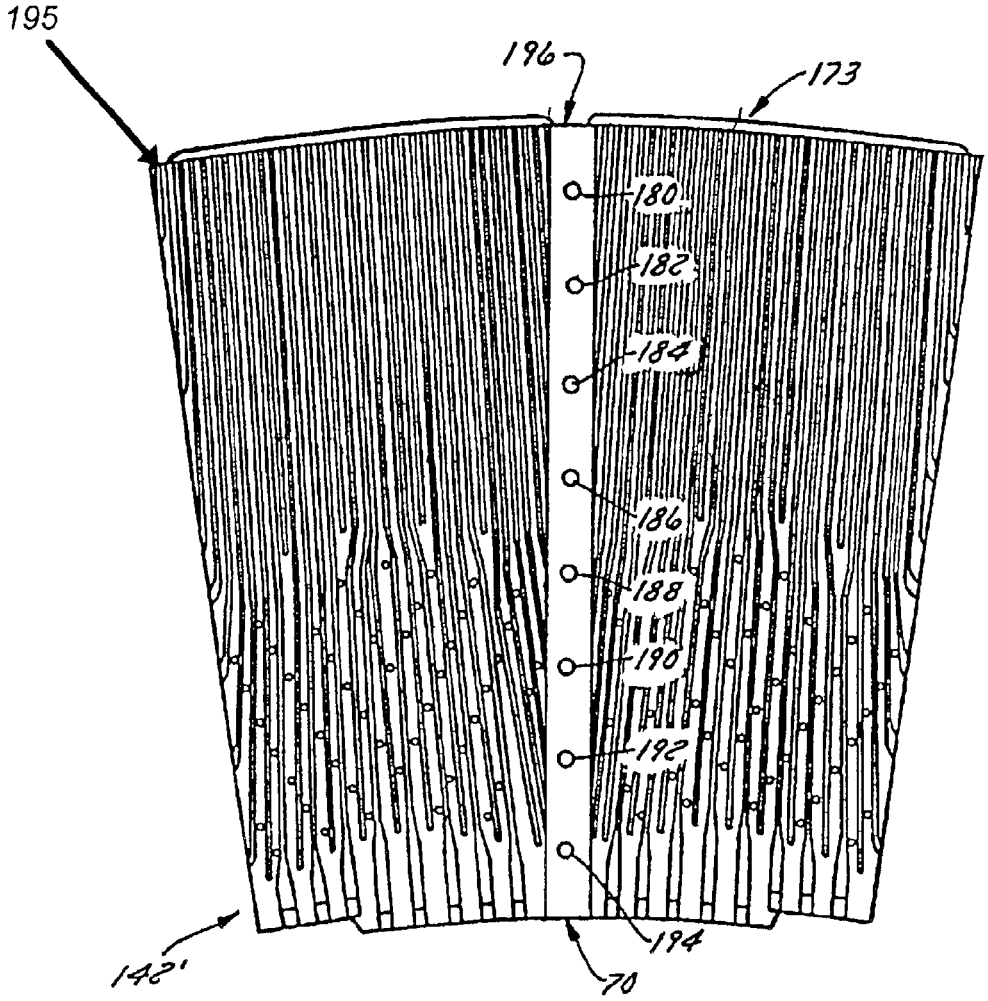
FIG. 7A is a front plan view of a preferred sensor refiner disk segment that has a bar or plate equipped with sensors used to sense a parameter, such as a process variable, in the refining zone.

Referring to FIG. 7A, a portion of a refiner disk, such as a refiner disk segment 173, contains a sensor device 70. The sensor device 70 includes at least one sensor capable of sensing at least one parameter in a refining zone during refiner operation. The sensed parameter can be used as the setpoint or can be used in its determination. In the embodiment shown in FIG. 7A, the sensor device 70 is comprised of a sensor assembly 196 that has a plurality of spaced apart sensors 180, 182, 184, 186, 188, 190 192, and 194. If desired, the sensor assembly 196 can have at least three sensors, at least four sensors, at least five sensors and can have more than eight sensors, if desired. Preferably, at least one refiner disk of each refiner 32 being monitored by processor 34 is equipped with a sensor device 70 and, where segmented, is equipped with at least one sensor refiner disk segment 173.

In the sensor refiner disk segment embodiment shown in FIG. 7A, the sensors 180, 182, 184, 186, 188, 190, 192, and 194 are carried by a bar 198 received in a radial channel or pocket in the refining surface 195 of the segment. The bar 198 can be, for example, frictionally retained, affixed by an adhesive, welded, or retained in the disk or disk segment using fasteners. If desired, the sensor bar 198 can be located in a space between two adjacent refiner disk segments, such as a pair of the segments 172 shown in FIG. 6. Each sensor 180, 182, 184, 186, 188, 190, 192, and 194 has at least one wire (not shown) to enable a signal to be communicated to signal conditioner and/or a data acquisition device. Where the sensor refiner disk segment 173 is carried by a rotor 120, a slip ring (not shown) can be connected to the wires connected to the sensors 180, 182, 184, 186, 188, 190, 192, and 194. Telemetry can also be used to communicate sensor signals.

Figure 7B:
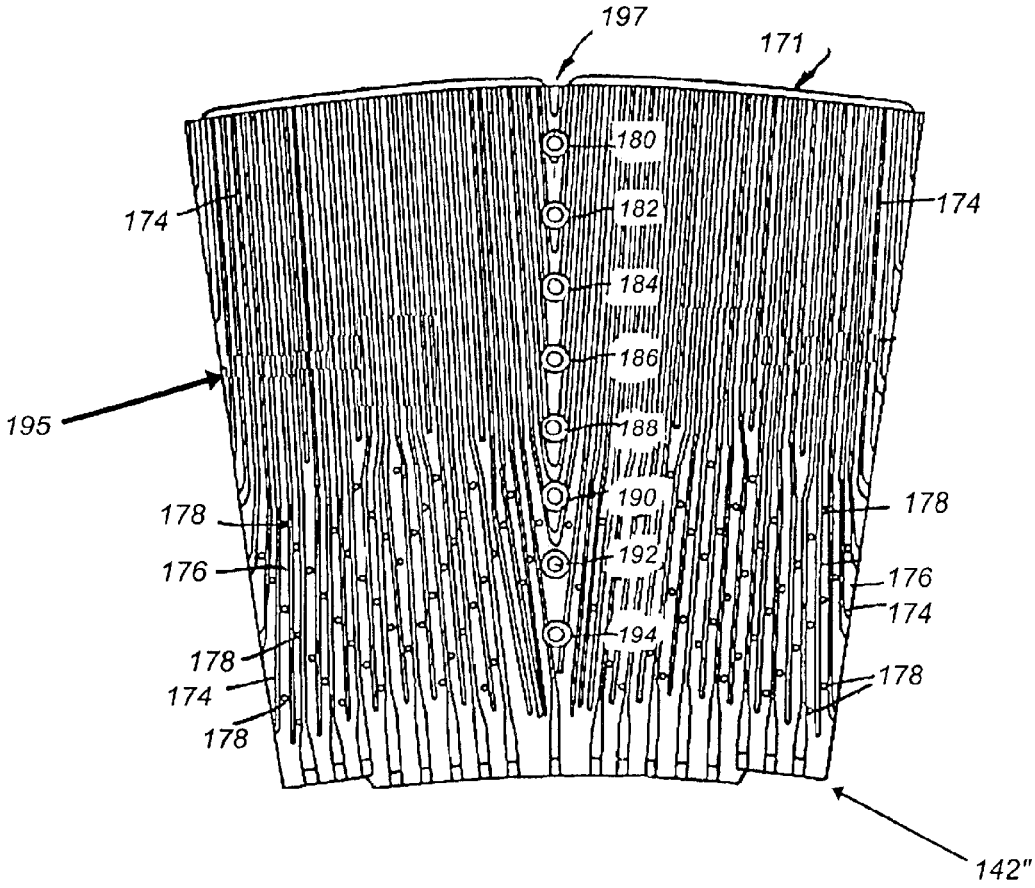
FIG. 7B is a front plan view of another preferred sensor refiner disk segment equipped with sensors embedded in a refining surface of the segment.

FIG. 7B illustrates another preferred embodiment of a sensor refiner disk segment 171. The segment 171 includes a sensor assembly 197 that includes at least one sensor embedded in the refining surface 195 of the segment. In the preferred embodiment shown in FIG. 7B, the sensor assembly 197 comprises a plurality of pairs of sensors 180, 182, 184, 186, 190, 192, and 194.

Figure 8:
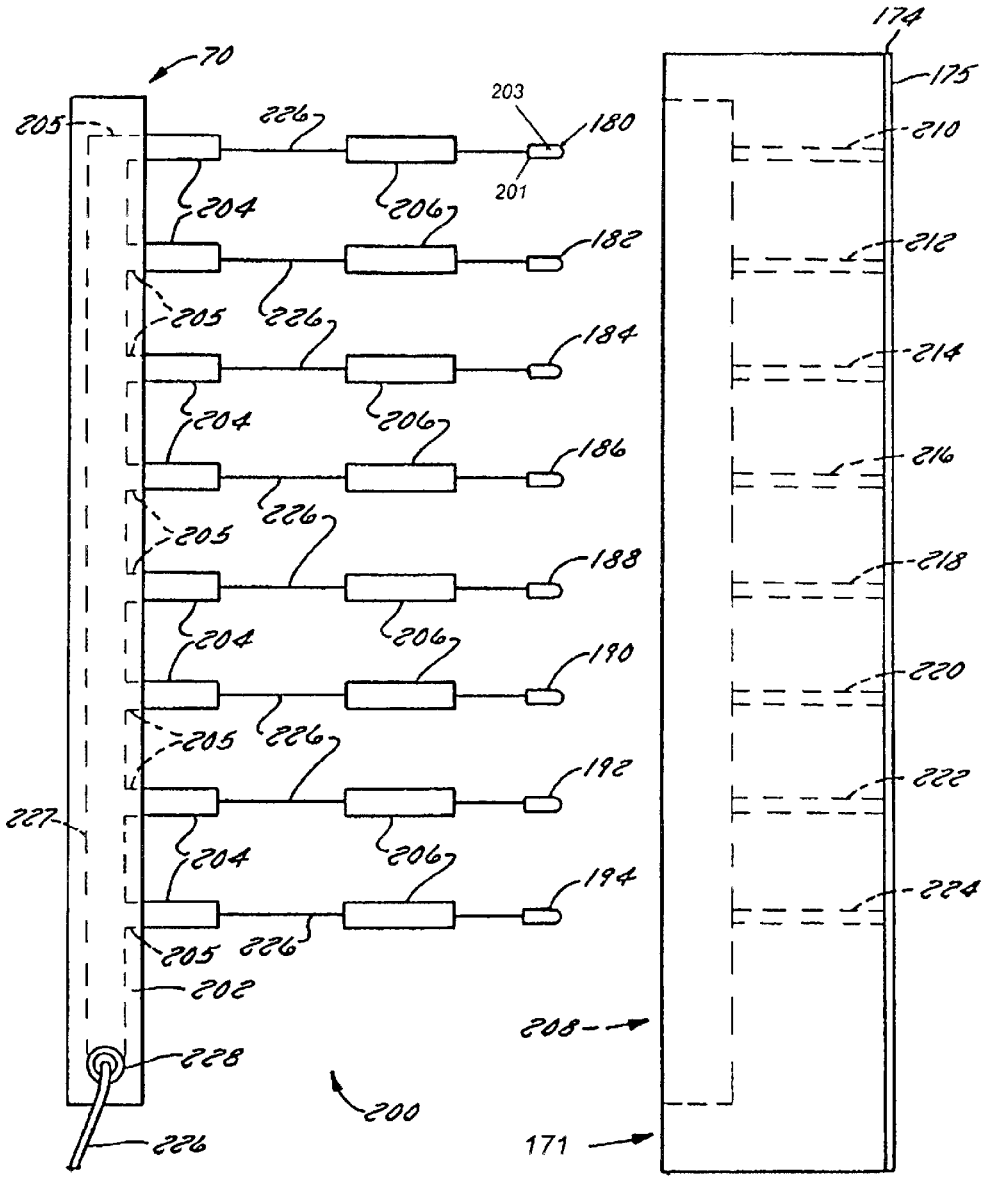
FIG. 8 is an exploded side view of a second refiner disk with sensors embedded in the refining surface of the disk.

In another preferred embodiment, FIG. 8 illustrates a sensing assembly 200 that includes a manifold-like fixture 202 that can have a plurality of outwardly extending and tubular sensor holders 204. In one preferred embodiment, there are no sensor holders as at least part of each sensor 180, 182, 184, 186, 188, 190, 192, and 194 is received in a bore 205 (shown in FIG. 8 in phantom) in the fixture 202. The fixture 202 is disposed in a pocket 208 (shown in phantom in FIG. 8) in the rear of a sensor refiner disk segment, such as segment 171.

When the sensor refiner disk segment is assembled, each sensor 180, 182, 184, 186, 188, 190, 192, and 194 is received in its own separate bore 210, 212, 214, 216, 218, 220, 222, and 224 in the segment 171 such that an axial end portion of each sensor is exposed to the refining zone during refiner operation. In the preferred embodiment shown, each sensor 180, 182, 184, 186, 188, 190, 192, and 194 is at least partially received in a spacer 206 that spaces the sensor from the surrounding refiner disk material. At least where the sensor is a temperature sensor, the spacer 206 is an insulator that thermally insulates the sensor from the thermal mass of the refiner disk segment 173. A preferred insulating spacer 206 is made of ceramic, such as alumina or mullite.

In another preferred embodiment, the spacer 206 comprises a layer of a high temperature potting compound, or the like, that can be comprised of an epoxy. If desired, the spacer 206 can be composed of a high temperature epoxy. Focusing only on sensor 180 shown in FIG. 8, the layer 206 is disposed between each sensor 180 and the refiner disk segment 171, when assembly is completed. In a preferred sensor embodiment, each sensor 180 comprises a housing 201 that at least partially encloses a sensing element 203 (shown in phantom) such that the layer 206 of material preferably is disposed between a portion of the housing 201 and the segment 171. The housing 201 preferably is tubular and at least partially encloses the sensing element 203. Where the sensor 180 is intended to sense temperature or a heat related parameter, such as heat flux, the housing 201 encloses the sensing element 203 and includes at least a portion that is constructed of a thermally conductive material, such as stainless steel or the like. At least a portion of the housing 201, typically its axial end, is exposed to stock in the refining zone during refiner operation.

When assembled to a sensor refiner disk segment, an axial end of each sensor 180, 182, 184, 186, 188, 190, 192, and 194 preferably is disposed no higher than the axial surface 175 of the bars 174 of the disk segment 173. Preferably, the axial end of each sensor 180, 182, 184, 186, 188, 190, 192, and 194 is disposed at least about fifty thousandths of an inch below the axial surface 175 of the portion of the bar 174 adjacent the sensor. In one preferred embodiment, each sensor 180, 182, 184, 186, 188, 190, 192, and 194 is disposed at least one-hundred thousandths of an inch below the axial surface of the portion of the bar 174 adjacent the sensor.

In a preferred embodiment, the sensing element 203 is located between a bottom of an adjacent refiner disk groove 176 and the top of an adjacent refiner bar 174. If desired, the sensing element 203 can be located such that it is recessed below the bottom of an adjacent groove.

When assembled, each sensor is telescopically received in one of the spacers 206, and the spacer 206 is at least partially telescopically received in one of the bores 205 in fixture 202. Where each spacer 206 is comprised of potting material and/or epoxy, the material is placed around the sensor housing 201 between the sensor refiner disk segment and allowed to set or harden. Each sensor has at least one wire 226 that passes through one of the insulating tubes 206, one of the sensor holders 204, and through a hollow in the bar 202 until it reaches outlet 228 located adjacent one end of the bar 202. Although not shown, a sealant, such as silicone or a high temperature refiner plate potting compound, can be disposed in a hollow 227 in the fixture 202 to protect the wires 226 and prevent steam and stock from leaking from the refining zone. In another preferred embodiment, the fixture 202 is eliminated and replaced by a high temperature potting compound that seals and holds the wires 226 in place. Where a fixture 202 is used, it preferably is anchored to the segment 173 by an epoxy or potting compound. If desired, some other type of mechanical fastening means also can be used together with or instead of epoxy and/or potting compound.

In one preferred embodiment, at least one of the sensors 180, 182, 184, 186, 188, 190, 192, and 194 includes a temperature sensing element 203 that is a temperature sensor, such as an RTD, a thermocouple, or a thermistor. Where measurement of absolute temperature in the refining zone is desired, a preferred temperature sensor is a platinum RTD that has three wires.

Where only the relative difference in temperature is needed, other kinds of temperatures sensing elements can also be used. Suitable examples include platinum RTD temperature sensors; nickel, copper, and nickel/iron RTD temperature sensors; and thermocouples, such as J, K, T, E, N, R, and S thermocouples.

If desired, thermopiles and heat flux sensors can also be used. Heat flux sensors, such as thin film, thermopile-based, and thermocouple based heat flux sensors are believed to be suitable for use. Routine testing and experimentation may be performed to select and/or adapt such sensors for sensing heat flux, or a heat related parameter, of a portion of a refining surface of a refiner disk segment or to sense heat flux, or a heat related parameter, in the refining zone, such as to sense heat flux, or some other heat related parameter, of stock in the refining zone.

In another preferred embodiment, each of the sensors 180, 182, 184, 186, 188, 190, 192, and 194 includes a pressure sensing element, such as a ruggedized pressure transducer, which can be of piezoresistive or diaphragm construction, and that is used to sense pressure in the refining zone. An example of a pressure transducer that can be used is a Kulite XCE-062 series pressure transducer marketed by Kulite Semiconductor Products, Inc. of One Willow Tree Road, Leonia, N.J.

In still another preferred embodiment, the sensing assembly 196 or 200 is comprised of a combination of sensors, such as a combination of pressure and temperature sensors. For example, sensing assembly 196 or 200 can be comprised of a single temperature sensor that senses temperature in the refining zone and a single pressure sensor that senses pressure in the refining zone. The sensing assembly 196 or 200 can also be comprised of a plurality of temperature sensors and a plurality of pressures that sense temperature and pressure at different locations in the refining zone.

Figure 9:
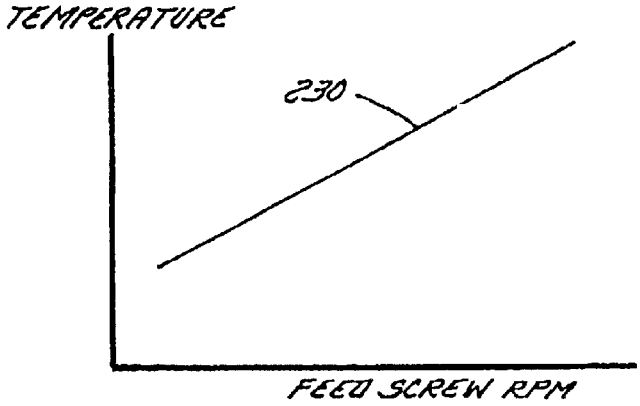
FIG. 9 is a graph showing a generally linear relationship between a process variable, namely refiner temperature, and the controlled variable, namely feed screw speed.
Figure 10:
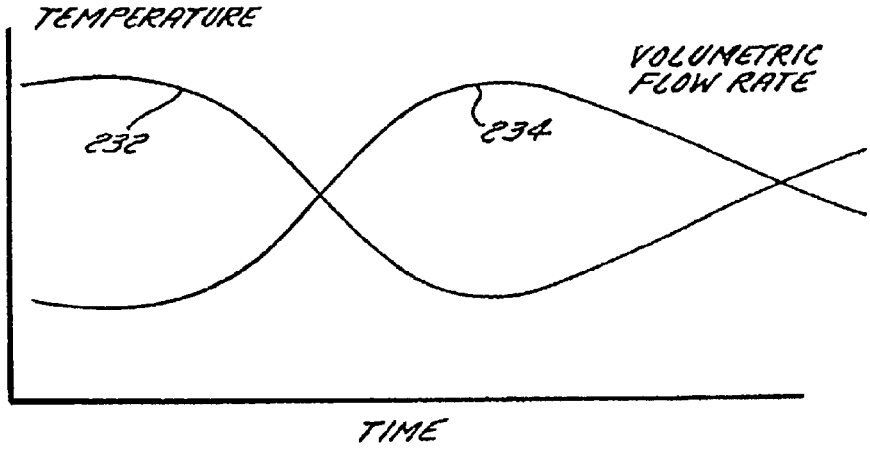
FIG. 10 is a graph depicting controlling the process variable, namely refiner temperature, by regulating the controlled variable, namely volumetric flow rate of stock entering the refiner.
Figure 11:
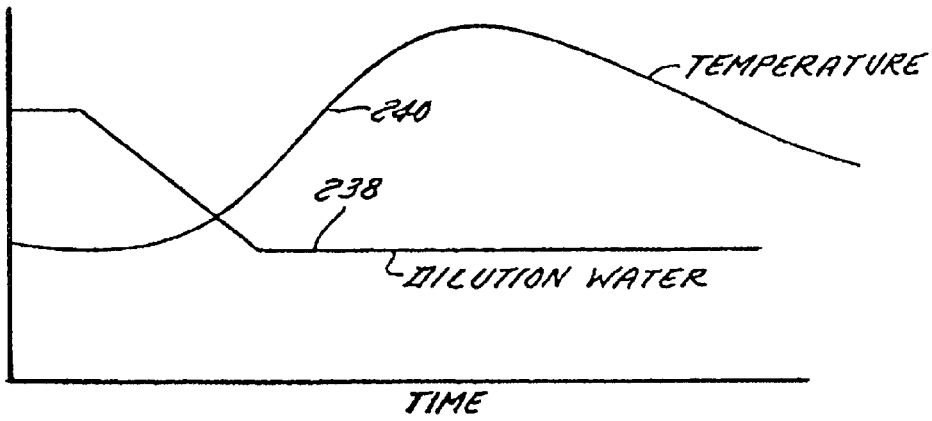
FIG. 11 is a graph illustrating the relationship between a process variable, namely refiner temperature, and a controlled variable, namely dilution water flow rate.

FIGS. 9–11 are directed to a method of controlling refiner operation. It has been long been assumed that a constant feed screw speed results in a constant volumetric flow rate of stock into a refiner and that that a constant stock volumetric flow rate produces a constant mass flow rate of fiber into the refiner. However, it has been discovered that the fiber mass flow rate can vary even when the feed screw speed and volumetric flow rate of stock remain constant. It is believed that these variations in fiber mass flow rate that occur when the feed screw speed is constant are caused by variations in the density of the fiber in the stock, namely changes in wood density, by variations in chip size, by variations in chip moisture content, by feed screw wear over time, by process upsets that occur upstream of the refiner, and by other reasons that are often specific to the mill in which the refiner is installed.

In one preferred control method, refiner operation is affected by controlling the volumetric flow rate of stock entering the refiner in accordance with a process variable that, in one preferred implementation of the control method, is based on, at least in part, at least one parameter that relates to conditions in the refining zone. Refiner process control is achieved by adjusting the volumetric flow rate of stock in response to changes in a process variable relative to its setpoint.

In another preferred control method, refiner operation is affected by controlling the flow rate of dilution water entering the refiner in accordance with a process variable that, in one preferred implementation of the control method, preferably is also based on, at least in part, at least one parameter that relates to conditions in the refining zone. Refiner process control is achieved by adjusting the rate of flow of dilution water in response to changes in a process variable relative to its setpoint.

In another preferred implementation of the control method, refiner operation is regulated in response to a refiner energy parameter or a parameter related thereto that can be used as the process variable. In one preferred implementation, the refiner energy parameter includes refiner energy sensed or determined in some manner and/or refiner power sensed or determined in some manner. Examples of preferred parameters that can also be used as a refiner energy related process variable include motor load, refiner energy, refiner power, refining gap (measured, sensed and/or calculated), refiner plate force, and hydraulic energy input.

By regulating the volumetric flow rate of the stock to keep the fiber mass flow more stable, the fiber bundles in the stock are impacted with a more constant specific energy. This leads to more consistent refining intensity, which greatly reduces variations in motor load and pulp quality. Because variations in motor load are reduced, less energy is used during refining.

When either or both control methods are implemented in a primary refiner, variation in pulp quality measured as freeness, long fiber content, shives, etc. (CSF) can be reduced, the occurrence of shives can be reduced, load swings can be decreased, clashing of refiner disks can be lessened, and a more uniform fiber distribution preferably is produced. When implemented in a secondary refiner, refiner load is more stable, the energy required for a given CSF target can be reduced, and the reject rate can be decreased. The result is lower Kraft usage and more consistent pulp quality that produces a fiber product with better and more consistent tear, tensile, burst, and drainage characteristics.

FIG. 9 is a graph with a line 230 that shows a generally linear correlation between a process variable and the volumetric flow rate of stock entering the refiner. In the case of the graph shown in FIG. 9, the process variable is a temperature in the refining zone. The correlation strongly shows that, for all else remaining the same, the temperature in the refining zone substantially linearly increases with increasing volumetric flow rate of the stock resulting from increasing the speed of the feed screw. This correlation also holds true for pressure in the refining zone, as well as for the temperature at the refiner inlet and outlet.

There is also a generally linear correlation between the dilution water flow rate and consistency. As dilution water flow rate is increased, consistency decreases and vice versa.

FIG. 10 is a second graph of a pair of curves that depicts an inverse relationship between a process variable 232 and volumetric flow rate 234. In the case of the graph shown in FIG. 10, the process variable is temperature. FIG. 10 illustrates that when temperature drops, it can be increased by increasing the speed of the feed screw rate to increase the volumetric flow rate of stock entering the refiner. If it is assumed that the consistency of the stock entering the refiner remains constant, increasing the volumetric flow rate will generally increase the temperature (and pressure) in the refining zone. This will also have the affect of increasing the temperature (and pressure) at the refiner inlet and the refiner outlet.

FIG. 11 is a third graph of a pair of curves that shows the relationship between the flow rate of dilution water 238 and a process variable 240 (e.g., temperature) that preferably is a refining zone temperature. Preferably, the process variable 240 is a temperature of stock in the refining zone. As dilution water flow rate is reduced, the temperature in the refining zone rises and vice versa when it is increased. Thus, dilution water flow rate can be controlled to regulate refiner temperature. Dilution water flow rate can be controlled in addition to or in combination with the feed screw speed.

Figure 12:
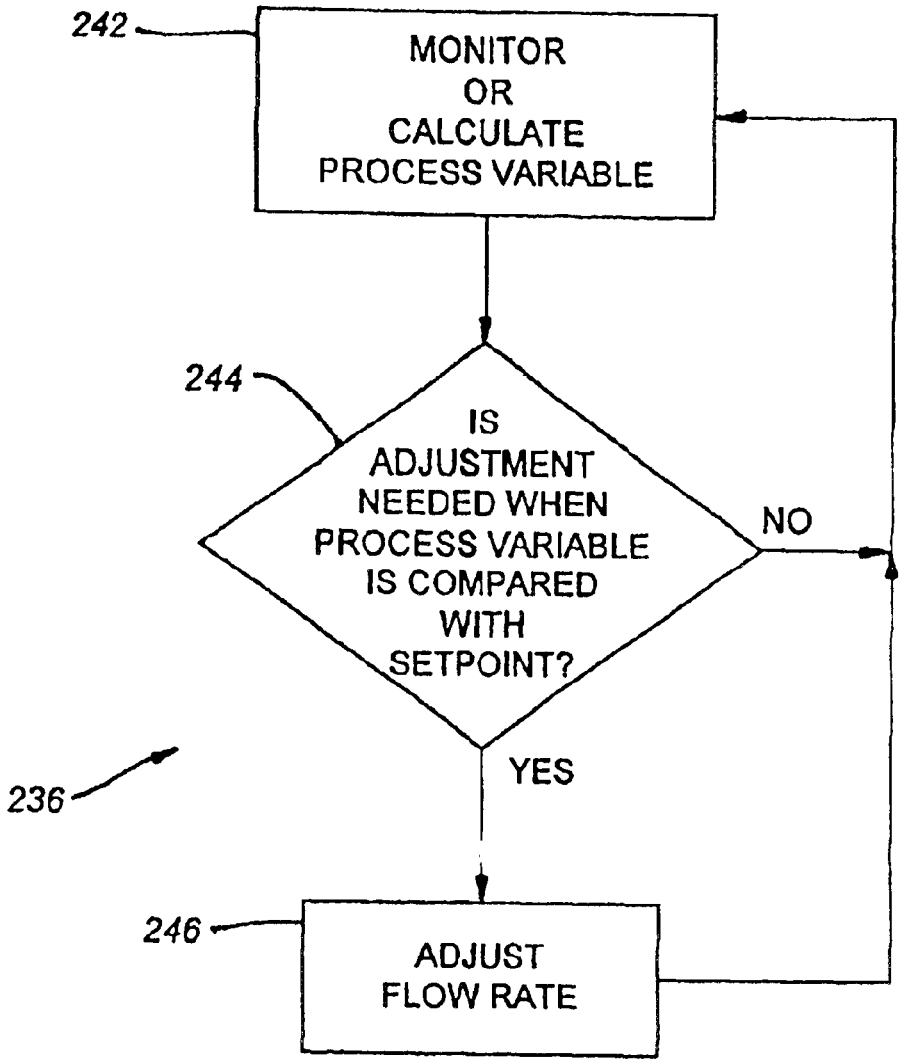
FIG. 12 is a flowchart illustrating a preferred method of controlling refiner operation.

FIG. 12 schematically depicts a preferred embodiment of the refiner control method 236. During operation, processor 34 monitors a number of refiner parameters including, for example, main motor power, dilution water flow rate, and refiner disk pressure (e.g., hydraulic pressure). At least one parameter that is monitored is a parameter that relates to conditions in the refining zone. One preferred parameter is a temperature in the refining zone that can be an absolute or relative temperature. Another preferred parameter is a pressure in the refining zone that can be an absolute pressure. Another parameter can be heat flux. If desired, other parameters can also be monitored including refiner inlet and outlet temperatures and/or pressures. If desired, pressures and temperatures can both be monitored.

In one preferred embodiment, the process variable is a monitored parameter, such as a refining zone temperature and/or pressure. In another preferred embodiment, the process variable can be or can include a heat flux that preferably is a heat flux of stock in the refining zone. If desired, the process variable can relate to a temperature or a heat flux of stock in the refining zone. If desired, the process variable can relate to a temperature or a heat flux of a part of the refining surface 195 of a refiner disk or a segment thereof located in the vicinity of the sensor. The process variable can also be a refiner inlet or outlet temperature or pressure. In another preferred embodiment, the process variable is calculated using one of these monitored parameters.

In another preferred embodiment, the process variable is a parameter related to refiner energy, such as refiner energy, refiner power, motor load, refiner gap, refiner plate force, or hydraulic load or energy input. If desired, the process variable can be motor load, refiner gap, refiner plate force, hydraulic load or hydraulic energy input.

In step 244, the process variable is compared with a setpoint to determine whether to adjust the volumetric flow rate of stock in step 246. In another preferred embodiment, the process variable is compared in step 244 with a setpoint to determine whether to adjust the flow rate of dilution water in step 246. In one preferred implementation, the process variable is compared with the setpoint, and the flow rate is adjusted up or down depending on whether the process variable is greater than or less than the setpoint.

Figure 13:
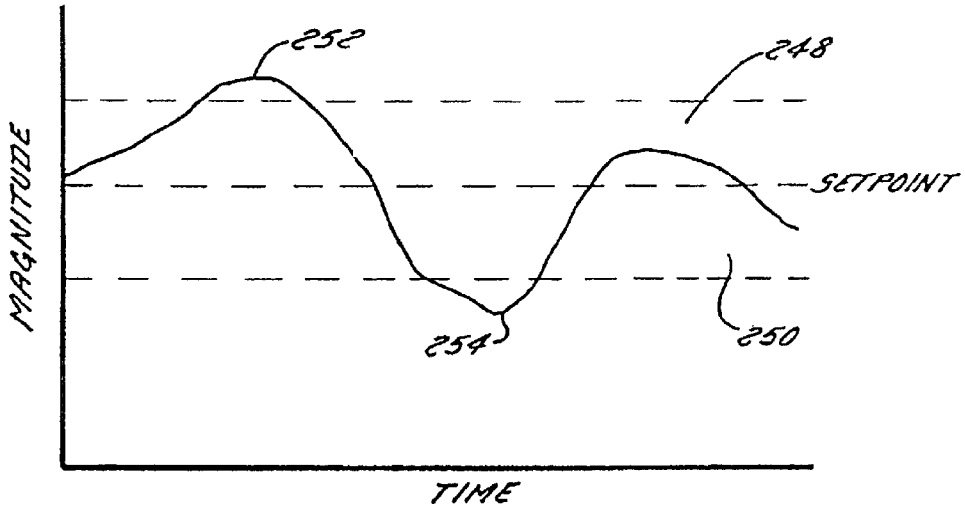
FIG. 13 is a graph depicting a tolerance or band around a process variable setpoint used in controlling refiner operation.

Referring to FIG. 13, in another preferred implementation, the process variable is compared with the setpoint and the volumetric flow rate is adjusted if the process variable falls outside a first band 248 that lies above the setpoint and a second band 250 that lies below the setpoint. Where the process variable falls outside upper band 248, such as where indicated by reference numeral 252, the volumetric flow rate of stock is appropriately increased or decreased until the process variable has been brought back within the band 248. This new flow rate can be maintained until real time monitoring of the process variable and comparison, such as per step 244, shows that the process variable is brought back within the desired band 248 or within a region defined by both bands 248, 250. Thereafter, the new flow rate can be maintained or a new one can be set based upon the process variable such that the chosen flow rate preferably keeps the process variable within the region of one or both bands 248, 250.

Likewise, where the process variable falls outside the lower band 250, such as indicated by reference numeral 254, the flow rate is conversely increased or decreased to bring the process variable back within the band 250. This new flow rate can be maintained until real time monitoring of the process variable and comparison, such as per step 244, shows that the process variable is brought back within the desired band 250 or within a region defined by both bands 248, 250. Thereafter, the new flow rate can be maintained or a new one can be set based upon the process variable such that the chosen flow rate helps to keep the process variable within the region of one or both bands 248, 250.

Figure 14:
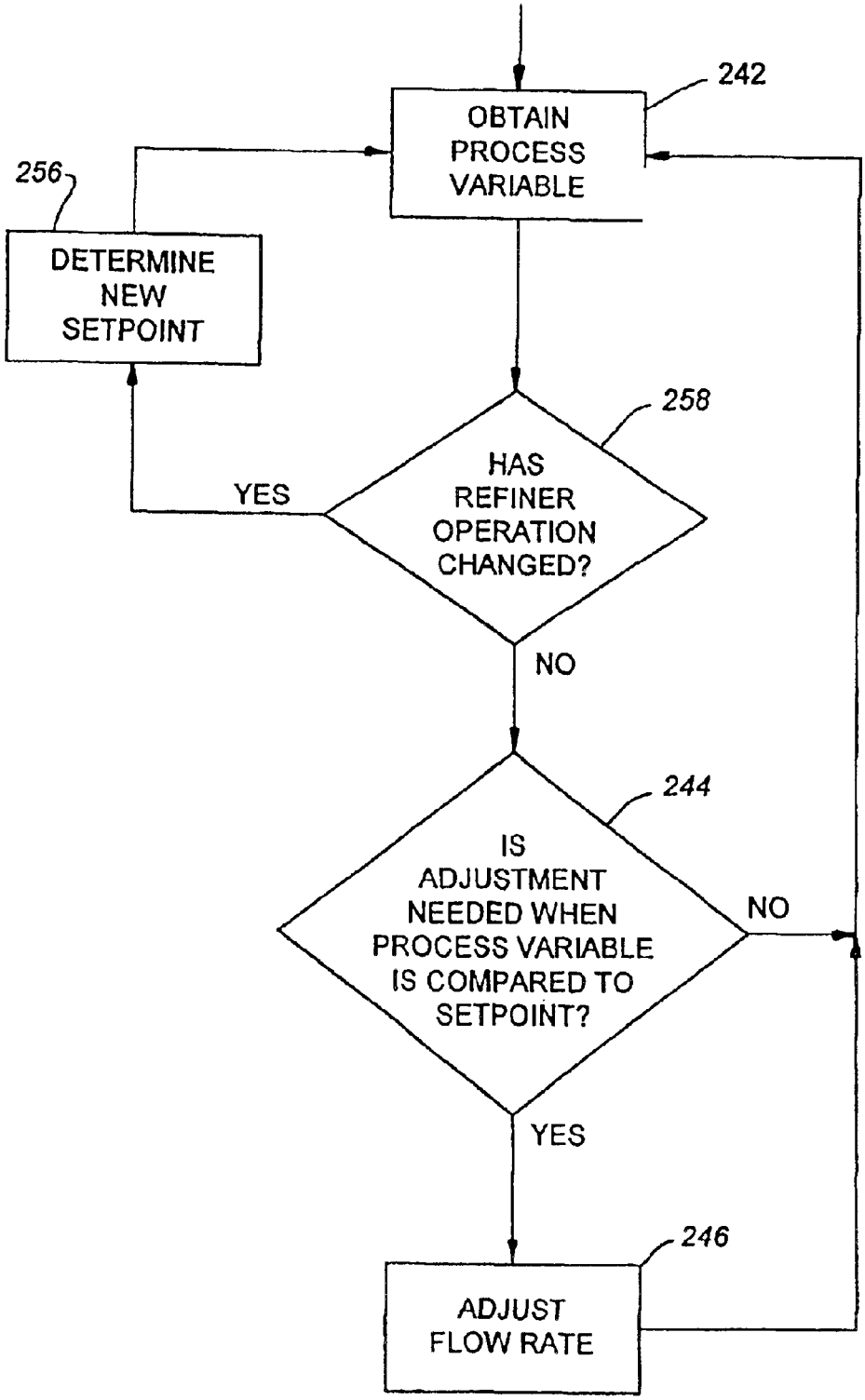
FIG. 14 depicts one preferred implementation of the control method.

FIG. 14 depicts an implementation of the control method where a new setpoint is determined at step 256 when it has been determined that refiner operation has been changed in step 258. For example, should a human operator change some particular aspect of refiner operation, a new setpoint will be determined. A new setpoint will also be determined if the aspect of refiner operation that was changed was done so automatically. For example, where there is a DCS linked to the refiner, the DCS can change some aspect of operation, such as main motor speed, that will cause a new setpoint to be determined. For example, where the DCS is linked to the refiner, the DCS can change some aspect of refiner operation, such as main motor speed, that can require a new setpoint to be determined.

Setpoint recalculation or determination can also be precipitated by a refiner controller, e.g., a processor 34 and/or or a DCS implemented with one or more of the control methods disclosed herein, in response to a change made by the controller. For example, a change in fiber or stock flow and/or a change in dilution water flow rate made by a controller can trigger setpoint recalculation/determination. For example, in one preferred embodiment, where the controller makes a change to fiber, stock, or dilution water delivery and/or flow in an attempt to keep a process variable at or within a certain range of a previously determined setpoint, a new setpoint preferably is recalculated, determined or obtained after the change is made. If desired, one or more bands or a range that relates to the setpoint can also be recalculated, determined or obtained, preferably during or after step 256.

After the new setpoint has been determined at step 256, the controller 236 will resume obtaining the process variable and the rest of the method depicted in FIG. 14 will be carried out. So that refiner operation stabilizes, it can take some time for the new setpoint to be determined. In one preferred embodiment, setpoint determination is performed only after a certain period of time elapses in order to allow operation to stabilize so that the setpoint is based on steady state operation. Routine experimentation and testing may be needed to determine the period of time and may be needed on a refiner-by-refiner basis.

Figure 15:
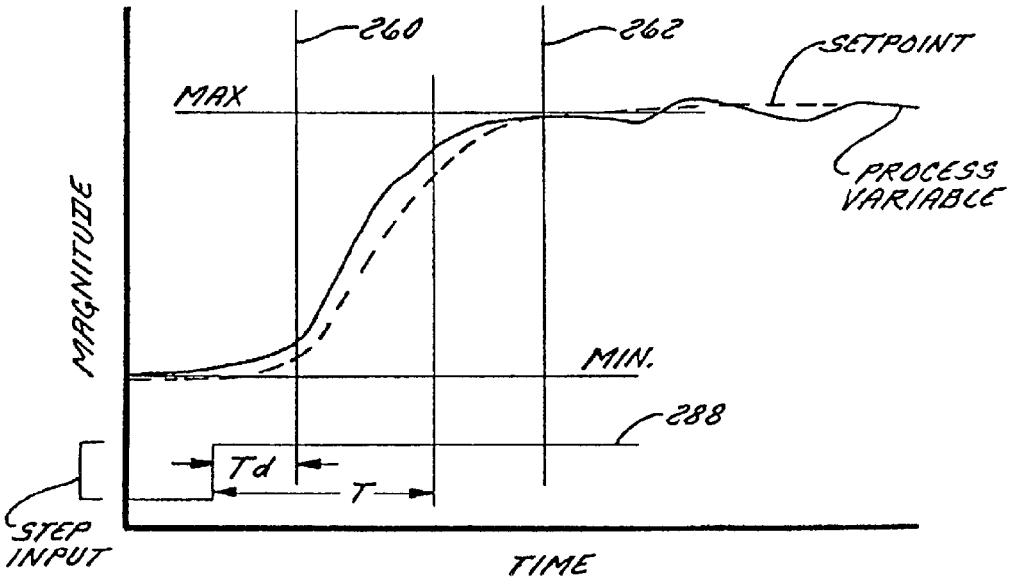
FIG. 15 is a graph illustrating a method of changing a process variable setpoint in response to a change in refiner operation.
Figure 16:
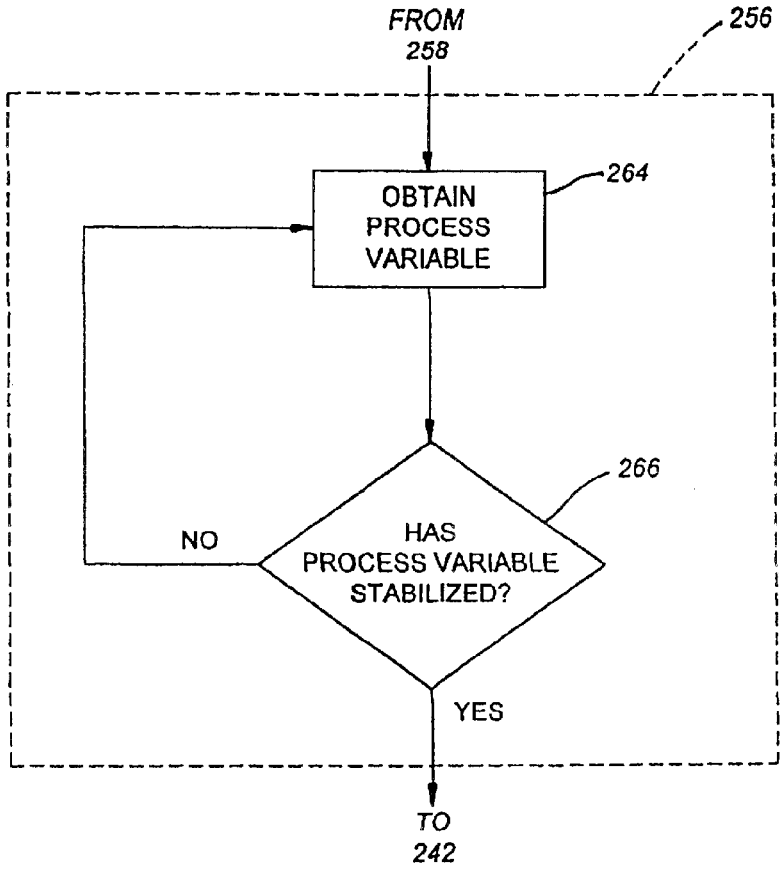
FIG. 16 is a schematic of a method of changing the setpoint in response to a change in refiner operation.

FIGS. 15 and 16 illustrate a preferred method of determining a new setpoint. The first vertical line labeled reference numeral 260 represents when refiner operation has been changed. The second vertical line labeled reference numeral 262 represents when refiner operation has stabilized after the change and the new setpoint has been determined. Referring to FIG. 16, in one preferred implementation, the process variable is obtained in step 264, and the process variable obtained is analyzed to determine whether its magnitude over time has stabilized in step 266. In determining whether refiner operation has stabilized, successive process variables are analyzed to determine whether their change in slope is less than 5%. For example, where the value of a process variable varies less than about 5% from one cycle to the next, stabilization of refiner operation will have been deemed to occur.

In another method of determining whether refiner operation has stabilized, each process variable of a current cycle is compared to its value from the prior cycle for at least two cycles in number. For example, it can be two cycles in number, three cycles in number, or more, as needed or determined, such as through routine testing and experimentation. If the absolute value of the average of the current process variable value and its prior value for at least two cycles is compared, the process will have been deemed converged, i.e., indicative of steady state refiner operation, if the averages fall within some acceptable tolerance.

For example, where three cycles are used with three corresponding consecutive temperatures are 171.5°, 170.5°, and 170.0° obtained for the three cycles, and the predetermined steady state test tolerance is 0.5°, convergence will not yet have occurred because the absolute value of the running average temperature calculated after each cycle will not have fallen within the 0.5° tolerance. In another example, where the three consecutive temperatures are 170.5°, 170.0°, and 170.0°, and the tolerance 0.5°, convergence will have occurred because the absolute value of the averages will have fallen within the 0.5° tolerance. When it has been determined that refiner operation has stabilized, the controller is released, and its control over refiner operation resumes.

For example, where fiber, e.g., wood chip, or stock mass flow is being controlled, controller release causes the controller, i.e. the processor, to resume monitoring the process variable(s) and making flow adjustments in response thereto as needed. Similarly, where dilution water flow is being controlled, controller release causes the controller, to resume monitoring the process variable(s) and making dilution water flow adjustments as needed in the manner previously discussed.

Figure 17:
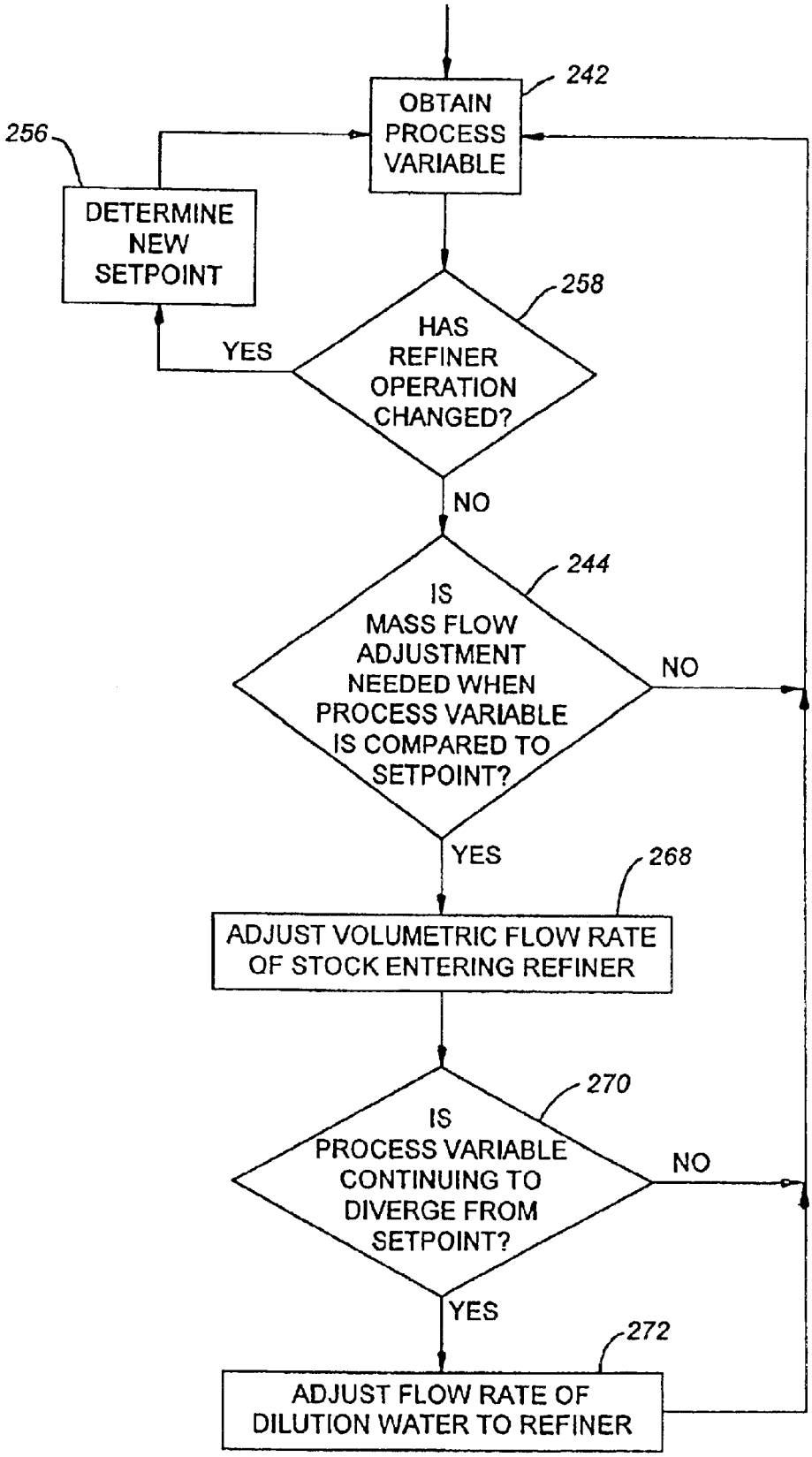
FIG. 17 is a schematic depicting a second preferred implementation of the control method.

FIG. 17 illustrates another flow chart of another preferred controller or refiner control method implementation. If it is determined in step 244 that an adjustment to mass flow is needed, the volumetric flow rate of the stock entering the refiner 32 is adjusted in step 268. For example, if the process variable has dropped below the setpoint such that adjustment is needed, the volumetric flow rate of stock entering the refiner 32 can be appropriately increased or decreased. If the process variable has risen above the setpoint such that adjustment is needed, the volumetric flow rate of stock entering the refiner 32 can be appropriately conversely increased or decreased. Where a range or band is used, ff the process variable has risen above a range or band around the setpoint such that adjustment is needed, the volumetric flow rate of stock entering the refiner 32 can be appropriately conversely increased or decreased in the manner previously discussed.

As an example, where the process variable is a refiner temperature, such as a temperature in the refining zone, the volumetric flow rate will be increased if the temperature has risen far enough above a setpoint temperature such that adjustment is needed. The volumetric flow rate will be decreased if the temperature has dropped far enough below the setpoint temperature such that adjustment is needed. Where a range or band is used, the volumetric flow rate will be increased if the temperature has risen enough above an upper limit of an upper band that is based on the setpoint temperature. The volumetric flow rate will be decreased if the temperature has dropped below a lower limit of a lower band that is based on the setpoint temperature.

Changing the volumetric flow rate preferably is accomplished by speeding up or slowing down the feed screw. Increasing the feed screw speed will increase the volumetric flow rate, and decreasing the feed screw speed will decrease the volumetric flow rate.

In some instances, changing the volumetric flow rate of stock entering the refiner will not have the desired affect of converging the process variable to its setpoint. This failure can be caused by changes in the mass flow rate of fiber entering the refiner that occur independently of the volumetric flow rate of the stock. It is believed that this occurs because the density of the fiber in the stock has changed, chip size has changed, chip moisture content has changed, the feed screw has become worn over time, process upsets have occurred upstream of the refiner that affect fiber mass flow, or due to some other reason that is often specific to the mill in which the refiner is installed.

To account for the possibility of the fiber mass flow rate changing independent of the volumetric flow rate of the stock, step 270 determines whether the process variable continues to diverge from the setpoint despite the volumetric flow rate of the stock having been adjusted in step 268. If it is determined that the process variable is diverging from the setpoint too much, the flow rate of the dilution water is adjusted in step 272.

For example, where the process variable continues to diverge despite adjustment of the stock mass flow rate by a certain amount or by a certain percentage, the dilution water flow rate will be changed. The amount or percentage of adjustment preferably is determined through routine experimentation and testing and may well be refiner dependent. For example, if the process variable continues to diverge and goes outside of an acceptable band, the dilution water flow rate can be changed. Hence, if the process variable is greater than or less than the setpoint by a certain percentage, such as 5%, the dilution water flow rate can be adjusted. When such a condition occurs, the dilution water flow rate preferably is adjusted as a means to help bring the process variable into convergence.

The dilution water flow rate is increased or decreased depending on the direction of convergence of the process variable. Where the process variable is a refiner temperature, such as a temperature in the refining zone, the dilution water flow rate is increased if the temperature increases above the setpoint and continues to diverge from the setpoint such that dilution water flow rate adjustment is needed. In another preferred embodiment, the dilution water flow rate is increased if the temperature goes outside of an upper limit of a setpoint band and continues to stay above the limit. Conversely, the dilution water flow rate is decreased or stopped if the temperature decreases below the setpoint and continues to diverge unacceptably from the setpoint. In another preferred embodiment, the dilution water flow rate is decreased or stopped if the temperature goes below a lower limit of a setpoint band and continues to stay below the limit. This relationship also holds true for refiner pressure, such as a pressure in the refining zone, and heat flux.

Figure 18:
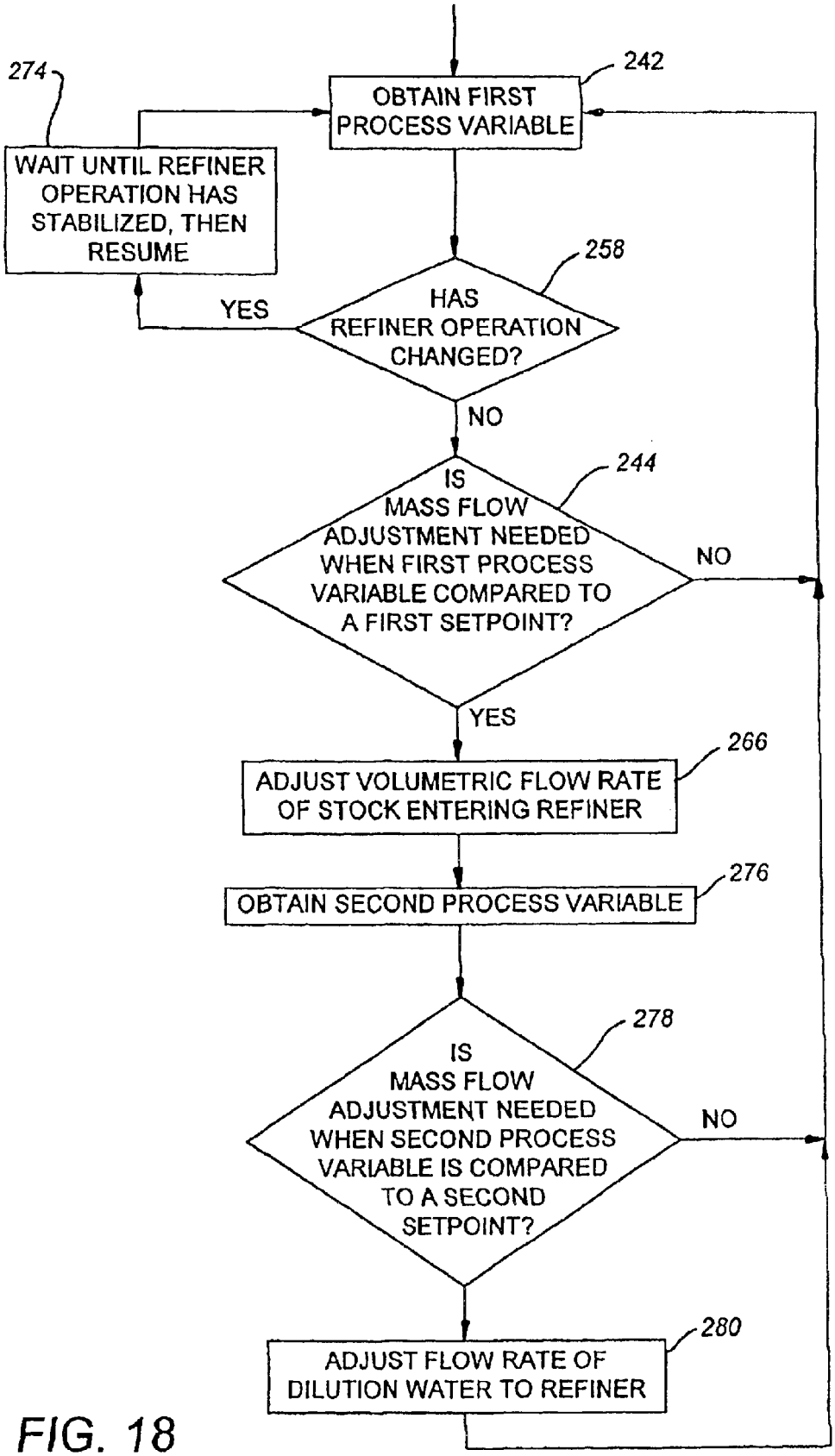
FIG. 18 is a schematic depicting a preferred implementation of the control method using two control loops that have two process variables that can be different.

FIG. 18 illustrates a still further preferred implementation of the control method. A first process variable is obtained in step 242. It is determined whether refiner operation has changed in step 258. If so, control is put on hold in step 274 until refiner operation stabilizes. Step 258 is not order dependent and can be performed anytime during execution of the control method depicted in FIG. 18.

The first process variable and/or a second process variable can both be monitored to determine when one, the other, or both have reached a steady state value, such as in the manner depicted in FIGS. 15 and 16. When it has been determined that one or both process variables have reached a steady value, the steady state value is taken as the new setpoint and control resumes.

If refiner operation has not changed, the first process variable is compared against its setpoint in step 244 to determine whether the volumetric flow rate of stock entering the refiner should be adjusted. If so, the volumetric flow rate of the stock is changed in step 266. If not, the control algorithm branches to step 242 where the first process variable is once again obtained.

If the volumetric flow rate of the stock has been adjusted, a second process variable is obtained in step 276. If desired, both process variables can be determined at the same time or in a common control method step.

The second process variable is compared against its setpoint in step 278 to determine whether an additional flow rate adjustment is needed. If so, the additional flow rate adjustment is performed in step 280. Preferably, the flow rate adjustment performed is an adjustment of the flow rate of dilution water to the refiner. If no flow rate adjustment is required, the control algorithm returns to obtain one or both process variables.

Figure 19:
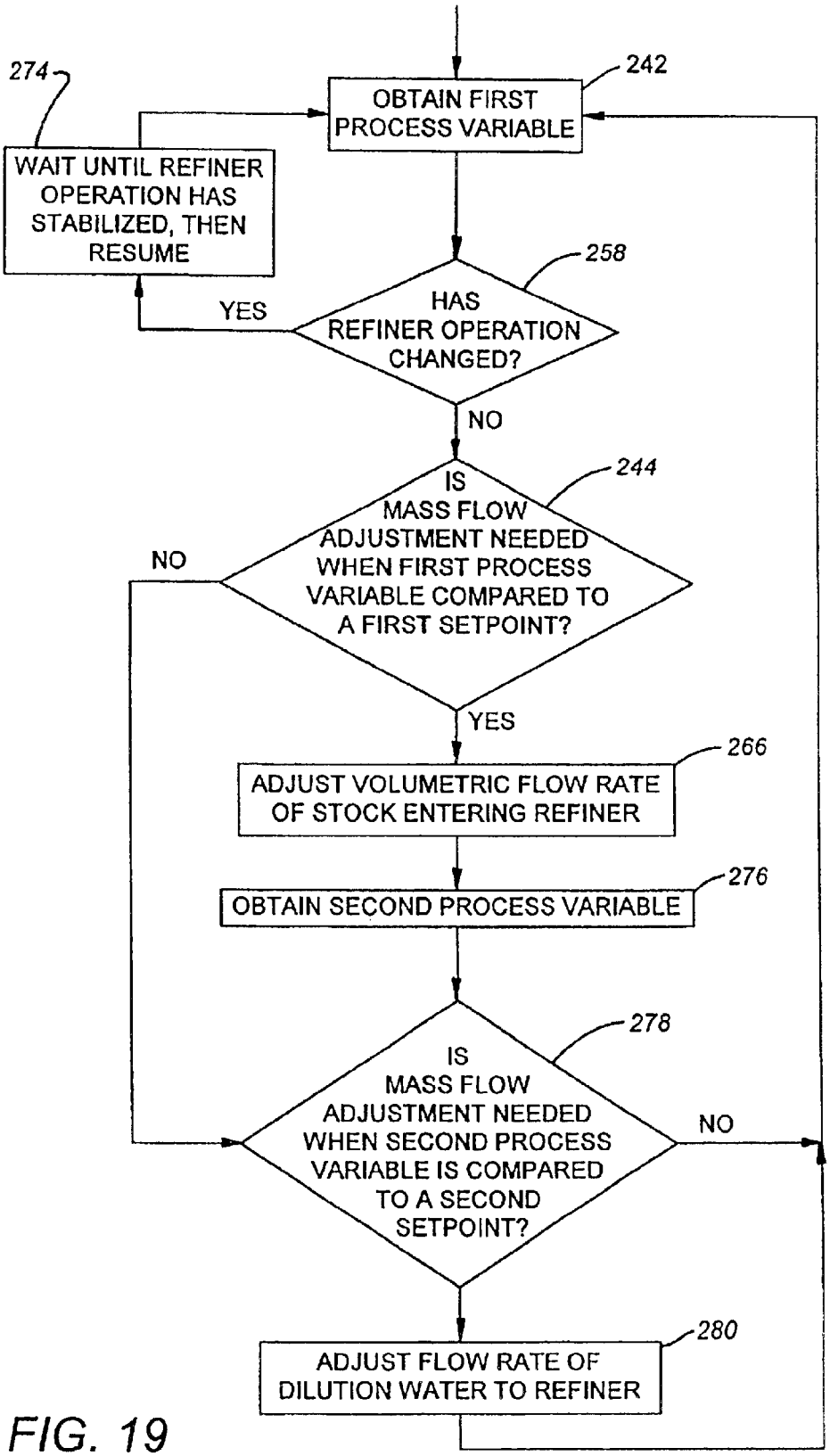
FIG. 19 is a schematic depicting a second preferred implementation of the control method using two control loops.

The control algorithm implementation depicted in FIG. 19 is similar to the control algorithm depicted in FIG. 18 except that the second process variable is compared against its setpoint in step 278 even if it has been determined that no mass flow rate adjustment is needed in step 244. This arrangement enables, for example, two control loops to be executed at the same time. It also enables the two loops to be completely independent of each other.

In one preferred implementation of the control algorithms depicted in FIGS. 18 and 19, the first process variable preferably is a refiner temperature or a refiner pressure and the second process variable preferably is consistency. Where refiner temperature and/or pressure are used as a process variable, a temperature or pressure in the refining zone preferably is obtained.

Figure 20:
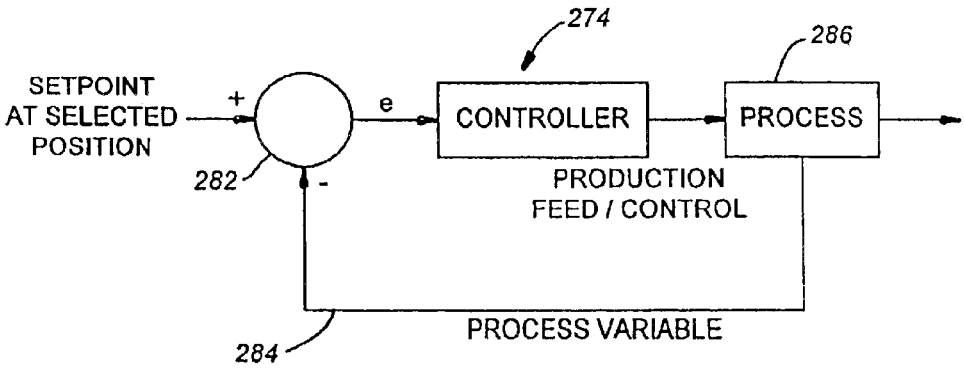
FIG. 20 is a control block diagram depicting one preferred implementation of the control method.

FIG. 20 illustrates a control block diagram of a preferred controller 274 that can be used with any of the preferred implementations previously discussed. While the controller can be a proportional controller, it preferably has at least a proportional component and an integral component. Where it is desirable to use, for example, feedforward control, the controller 274 can also have a derivative component.

At summing junction 282, the setpoint at the selected set of refiner operation conditions is summed with a process variable from a feedback loop 284 that is obtained from some parameter relating to the process 286 being controlled, namely refiner operation. The result of the summing junction produces e, which is set forth below:

$$e=SP-PV \quad \text{(Equation I)}$$

where e is the error, SP is the value of the setpoint, and PV is the value of the process variable.

The equation that expresses the controller action is as follows:

$$u(t) = K_c\left(e + \frac{1}{T_i}\int_0^t e\,dt + T_d\frac{de}{dt}\right) \quad \text{(Equation II)}$$

where u(t) is the controller output, $K_c$ is the controller gain, $T_i$ is the integral time constant in minutes, and $T_d$ is the derivative time constant in minutes. The proportional action of the controller can be expressed by the equation:

$$u_p(t)=K_c e \quad \text{(Equation III)}$$

where $u_p(t)$ is the output of this portion of the controller. The integral action of the controller can be expressed by the equation:

$$u_I(t) = \frac{K_c}{T_i}\int_0^t e\,dt \quad \text{(Equation IV)}$$

where $u_I(t)$ is the output of this portion of the controller. Where present, the derivative action of the controller can be expressed by the equation:

$$u_D(t) = K_c T_d\frac{de}{dt} \quad \text{(Equation V)}$$

where $u_D(t)$ is the output of this portion of the controller.

The controller output, u(t), gets communicated as a control signal to the particular component being regulated by the controller. For example, where the component being regulated is the volumetric flow rate of stock, the control signal can be sent directly to a feed screw motor or motor controller that controls the feed screw speed. Where the system includes a DCS, the signal preferably is sent to the DCS and causes the DCS to adjust the feed screw speed. Where the component is dilution water flow rate, the signal can be sent directly to a dilution water pump motor or motor controller that controls the dilution water pump. Where the system includes a DCS, the signal preferably is sent to the DCS and causes the DCS to adjust the dilution water flow rate. If desired, the output, u(t), can be processed further to produce the control signal or otherwise used in obtaining the control signal.

Because each refiner, stock system arrangement, and fiber processing plant is different, it is believed very likely that the controller will have to be tuned for the particular refiner it will be used to control. One preferred tuning method subjects the refiner to a step input and analyzes the response. More specifically, the controller is tuned to determine the controller gain, $K_c$, the integral time constant, $T_i$, and, where a derivative component is used, the derivative time constant, $T_d$, by analyzing system response in response to a step input. In one preferred controller, the controller is a proportional-integral controller that has no derivative control component.

For example, where the controller output, u(t), is used to control the volumetric flow rate of stock entering the refiner and the refiner temperature is the process variable, the parameters $K_c$, $T_d$, and $T_i$, can be determined by increasing the volumetric flow rate of stock by a step input of a specific magnitude and then monitoring how fast it takes for the refiner temperature to begin increasing, as well as how long it takes until before the temperature reaches a steady state condition and its magnitude at steady state. In one preferred embodiment, the refiner temperature is a temperature of stock disposed in the refining zone. This information is used in determining the dead time, $T_{DEAD}$, of the system, the time constant, $T_i$, the process gain, K, and the controller gain, $K_c$. The dead time, $T_{DEAD}$, is used to determine the controller gain, $K_c$, and can be used to determine the time constant, $T_i$.

Where the output, u(t), is used to control the dilution water flow rate entering the refiner and consistency is the process variable, the parameters $K_c$, $T_d$, and $T_i$, can be determined by increasing the dilution water flow rate by a step input of a specific magnitude and then monitoring how fast it takes for the consistency to begin decreasing, as well as how long it takes until before the consistency reaches a steady state condition. The magnitude of the consistency at steady state is also determined. This information is used in determining the dead time, $T_{DEAD}$, of the system, the time constant, $T_i$, the process gain, K, and the controller gain, $K_c$.

In one preferred embodiment, the process variable is refiner temperature and the output of the controller is used to set the speed of the feed screw to control the volumetric flow rate of stock entering the refiner. One preferred refiner temperature is a temperature of stock measured in the refining zone. The controller must be tuned for the specific refiner and/or fiber processing plant in which the refiner is installed.

In one preferred method of tuning the controller, the system dead time, $T_{DEAD}$, the time constant, $T_i$, of the system, and the process gain, K, are determined. In tuning the controller, the refiner is operated normally at a particular set of operating conditions until steady state operation is achieved. Referring to FIG. 15, where the feed screw speed is the controlled variable 288, the speed is then adjusted upwardly or downwardly by an amount (represented by the step depicted in FIG. 15) that preferably is measured or otherwise known. Then, the time it takes from the moment of the adjustment for the change in feed screw speed (i.e., the controlled variable) until temperature (i.e., the process variable) is affected is measured. This amount of time, the lag between changing the output and the change affecting the process variable, is the dead time, $T_{DEAD}$.

Where refiner temperature is the process variable and the feed screw speed is being controlled, $T_{DEAD}$ can be as little as one second to as much as about two minutes, depending on the refiner, how far the feed screw is located from the refiner, and other factors. Typically, $T_{DEAD}$ is between about five seconds and about fifty seconds. Where consistency is the process variable and the dilution water flow rate is being controlled, $T_{DEAD}$ is less and typically is between one half second and five seconds. Determining the dead time is advantageous as it enables the controller to maximize how fast it can cause the refiner to respond.

Referring once again to FIG. 15, the time constant, $T_i$, is determined by measuring the time it takes for the process variable to reach about ⅔ (about 63.2%) of the difference between its minimum value and its maximum steady state value. Where temperature is the process variable and volumetric flow rate (feed screw speed) is the controlled variable, the time constant, $T_i$, ranges between 0.3 minute and 1.1 minute. Typically, the time constant, $T_i$, ranges between about 0.4 minute and about 0.75 minute. Where consistency is the process variable and dilution flow rate is the controlled variable, the time constant, $T_i$, is smaller and typically less than about 0.3 minute. Determination of these variables is also advantageous as it tailors operation of the controller to the refiner to maximize response by helping to minimize response time.

The controller gain, $K_c$, is determined or selected. $K_c$ preferably ranges between about 0.25 and about 2. Where the controller is a PID controller, the derivative time constant, $T_d$, can be set approximately equal to a rate of change of the process variable after the dead time has passed but before it has reached steady state.

In one preferred method of determining $K_c$, the process gain, K, is first determined and then used, along with the dead time, $T_{DEAD}$, and the time constant, $T_i$, to determine $K_c$. Referring to FIG. 15, K is the ratio of the change (or percent change) in the magnitude of the step input over the change (or percent change) in the magnitude of the output, i.e., max−min.

Where the controller is a PI controller, the following equation can be used to determine the proportional band, PB, in percent:

$$PB = 110\frac{KT_{DEAD}}{T_i} \quad \text{(Equation VI)}$$

The coefficient of 110 can be varied depending on the characteristics of the controller desired. The controller gain, Kc, is then determined using the following equation:

$$K_c = \frac{100}{PB} \quad \text{(Equation VII)}$$

Where this method is used, the following equation can be used to determine the time constant, $T_i$, in minutes:

$$T_i = 3.33T_{DEAD} \quad \text{(Equation VIII)}$$

Where the controller is a PID controller, the following equation can be used to determine the proportional band, PB, in percent:

$$PB = 80\frac{KT_{DEAD}}{T_i} \quad \text{(Equation IX)}$$

The coefficient of 110 can be varied depending on the characteristics of the controller desired. The controller gain, Kc, is determined in the manner set forth above in Equation VII. The following equation can be used to determine the integral time constant, $T_i$, in minutes:

$$T_i = 2.00T_{DEAD} \quad \text{(Equation X)}$$

The following equation can be used to determine the derivative time constant, $T_d$, in minutes:

$$T_d = 0.50T_{DEAD} \quad \text{(Equation XI)}$$

Figure 21:
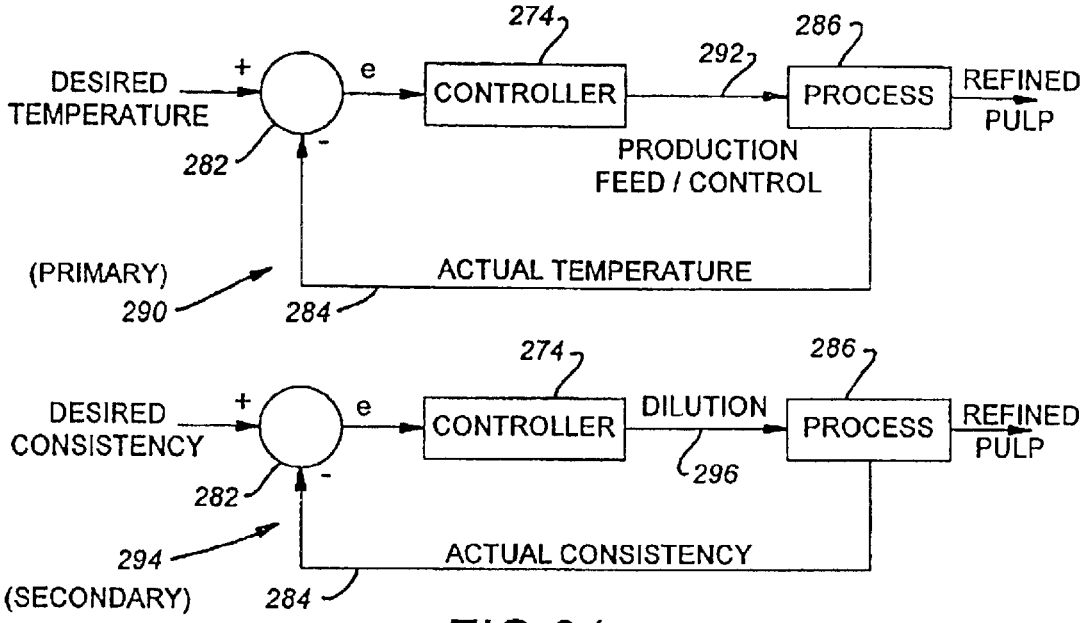
FIG. 21 is a control block diagram depicting a second preferred implementation of the control method having two control loops.

FIG. 21 depicts a pair of the controllers that control the same refiner. The process of the refiner being monitored in one controller arrangement, referred to by reference numeral 290, is an actual refiner temperature, preferably a temperature in the refining zone. Where there is more than one sensor, such as sensors 78, 180, 182, 184, 186, 188 and 190, from which an actual refining zone temperature can be obtained and used as the process variable 284, the refining zone temperature can be an average temperature, the temperature of a single selected sensor, or a temperature of the refining zone obtained using another method.

The actual temperature is summed at 282 with a desired temperature setpoint to obtain the process error value, e. The process error value, e, is fed into the controller 274. The controller 274 outputs a signal that is used to regulate the speed of the feed screw to regulate the volumetric flow rate of stock entering the refiner. Where the actual temperature has risen above the desired temperature, the controller 274 will output a signal 292, labeled "Production Feed/Control" in FIG. 21, that will decrease the speed of the feed screw to lessen the volumetric flow rate. Where the actual temperature has dropped below the desired temperature, the controller 274 will output a signal 292 that increases the speed of the feed screw to increase the volumetric flow rate.

The process variable of the refiner being monitored in the other controller arrangement, referred to by reference numeral 294, is a consistency measurement, referred to in FIG. 21 as "Actual Consistency." The measured consistency is summed at 282 with a desired consistency setpoint to obtain the process error value, e. The process error value, e, is fed into the controller 274. The controller 274 outputs a signal 296 that is used to control operation of the dilution water pump to regulate the flow rate of dilution water entering the refiner. Where the measured consistency has risen above the desired consistency, the controller 274 will output a signal 296, labeled "Dilution" in FIG. 21, that will increase the dilution water pump output to increase the dilution water flow rate. Where the actual consistency has dropped below the desired consistency, the controller 274 will output a signal 296 that decreases or stops the dilution water pump to thereby reduce the dilution water flow rate.

In another preferred method, the measured consistency is the process variable and the controller output is a control signal that controls or is used to control the feed screw speed to control the volumetric flow rate of stock entering the refiner. In a still further preferred method, at least one measured temperature, e.g., the actual temperature, in the refining zone is the process variable and the controller output is a control signal that controls or is used to control the flow of dilution water. In one preferred embodiment, the refining zone temperature is a temperature of stock in the refining zone that can be actual or relative. In a still further embodiment, heat flux is the process variable.

If desired, refiner energy, or one of the aforementioned refiner energy related parameters, can be used as the process variable in the second or secondary controller depicted in FIG. 21. If desired, refining zone pressure, e.g. pressure of stock in the refining zone, or heat flux, e.g., heat flux of stock in the refining zone, also can be used as a process variable for the secondary controller.

Where the refiner is a twin refiner, the first controller arrangement 290 preferably is used to control the volumetric mass flow rate of stock entering a primary refiner of the twin refiner. The process variable measured is temperature in a refining zone of the primary refiner. The second controller arrangement 294 is used to control the flow rate of dilution water into a secondary refiner of the twin refiner. The process variable measured is the consistency of the stock at the output of the primary refiner or the inlet of the secondary refiner of the twin refiner. Where consistency is measured in the refining zone, it can be measured in a refining zone of the primary refiner or the secondary refiner. Where consistency is measured in a refining zone of the secondary refiner, it preferably is measured adjacent where the stock enters the refining zone.

Where consistency is the process variable, the consistency can be measured using a conventional consistency sensor, such as an inline consistency sensor. Examples of suitable consistency measurement sensors include an infrared consistency sensor, a mechanical consistency sensor, or another type of consistency sensor. Where consistency is measured and used as a process variable, the consistency measured preferably is the consistency of the stock entering the refiner. In such an instance, the consistency sensor is located upstream of the refiner or located in the refiner such that it can measure the consistency of the stock entering the refiner. Where the consistency sensor is located outside the refiner, the sensor can be an inline sensor.

In one preferred method of measuring consistency, refiner temperature or pressure measurements are used along with measurements of other refiner parameters to measure or determine consistency. This novel method of determining consistency and system used to determine consistency is based on an application of mass and energy balance to the pulp as it flows through the refiner. The moisture in the refiner is assumed to be an equilibrium mixture of water and steam and the temperature (and therefore, pressure) of the water-steam mixture that is assumed to vary with radial position through the refiner. The steam is assumed to be saturated throughout the refiner zone.

Inputs required for this determination include temperature (or pressure) within the refining zone, the distribution of the motor load (i.e., specific power) within the refining zone, and an initial consistency. As output, consistency is provided as a function of radial position in the refiner.

The consistency determination procedure set forth below is well suited for use in refiner control applications, since the refining zone temperature, refiner load, dilutions, hydraulics, and many other refiner parameters are measured in real time. Using this method of determining consistency in real time, monitoring and/or controlling refining zone consistency as a function of both time and space can be done.

The model is based on the following equations for conservation of mass and energy, respectively:

$$\frac{dC}{dr} = 2\pi r \frac{m_s}{\dot{m}} C^2 \qquad \text{(Equations XII - XIV)}$$

$$m_s = \frac{1}{L}\left(\overline{W} - \frac{\dot{m}}{2\pi r}\left[H_s + \frac{1-C}{C} H_l\right]\frac{dT}{dr}\right)$$

$$u(t) = K_c\left(e + \frac{1}{T_i}\int_0^t e\,dt + T_d\frac{de}{dt}\right)$$

The physical quantities that correspond to the variables above are listed in Table 1 below:

TABLE 1

| Symbol | Description | Units |
|---|---|---|
| C | Consistency | Dimensionless |
| $m_s$ | Specific steam generation rate | $Kg/m^2$-sec |
| $\dot{m}$ | Dry wood throughput | kg/sec |
| r | Radial position | m |
| L | Latent heat of steam | KJ/kg |
| $\overline{W}$ | Specific power | $KW/m^2$ |
| $H_s$ | Wood heat capacity | KJ/kg-° C. |
| $H_l$ | Water heat capacity | KJ/kg-° C. |
| T | Temperature | ° C. |

One or more of the following inputs preferably are used in the consistency determination: the refiner main motor power, the force exerted on the refiner disks urging them together (.e.g., hydraulic pressure or force), the dilution motor power of the refiner for each dilution pump, the refiner case pressure, the refiner inlet pressure, the chip washing water temperature, the dilution water temperature, as well as the gap between refiner disks.

The consistency, C, is determined as a function of radial position in the refining zone defined between the refiner disks. The temperature, T, is a temperature of stock preferably in the refining zone or upstream of the refining zone. Where the temperature, T, is measured upstream of the refining zone, it preferably is measured slightly upstream of the refining zone, such as immediately before the location in the refiner where stock enters the refining zone. If desired, the temperature, T, can be measured at the refiner inlet where stock enters the refiner. Where the temperature, T, is a temperature in the refining zone, it preferably is measured at or adjacent where stock enters the refining zone. The temperature, T, can be measured anywhere in the refining zone. Where a refiner has more than one opposed pair of refiner disks, the temperature, T, preferably is taken upstream of the radially innermost pair of refiner disks or in its refining zone.

Where a sensor refiner disk or sensor refiner disk segment is used, such as sensor refiner disk segments 142' or 142" shown respectively in FIGS. 7A and 7B, temperature, T, can be a temperature measurement from a single sensor, such as sensor 180, 186, or 194, or an average temperature determined from temperature measurements taken from a group of sensors, such as sensors 194, 192, and 190 (or all of the sensors 180–194). Where it is desired to measure temperature, T, in the refining zone adjacent where stock enters, sensor 190, 192, or 194 can be used. Preferably, the temperature measurement from sensor 194 is used in such a case.

If desired, the temperature, T, can be determined using a combination of a temperature of stock entering the refiner and a temperature of stock in the refining zone. One such example is an average temperature of the average of the temperature of stock entering the refiner obtained from a sensor (not shown) disposed in the refiner upstream of the refining zone and a temperature of stock in the refining zone obtained from one or more of sensors 180–194 of a sensor refiner disk segment 142' or 142".

The latent heat of steam, L, is obtained from steam tables known in the art. The latent heat, L, is obtained for the temperature, T, which is measured. The specific power, $\overline{W}$ is determined by dividing the power input into the refiner, typically in megawatts, by the refiner disk surface area, in square meters.

The specific steam generation rate, $m_s$, is determined using an energy balance that assumes that all energy inputted into the refiner is converted to heat. Thus, it is assumed that the specific power, $\overline{W}$, of the refiner is converted into heat and known steam tables (not shown) are used to determine the specific steam generation rate using this assumption. Where implemented as part of an algorithm that is executed by a processor, one or more steam tables are utilized as lookup tables.

The wood heat capacity, $H_s$, is taken from a known wood heat capacity table based on the temperature of the chips measured before the stock enters the refiner. The water heat capacity, $H_l$, is also taken from a known table of water heat capacities and is based on the temperature of the water in the stock measured before the stock enters the refiner.

If the temperature, T, and the specific power, $\overline{W}$, are known as functions of radial position, the two equations above can be combined to produce a non-linear ordinary differential equation (ODE) of first order for the consistency, C. This equation is:

$$\frac{dC}{dr} = \frac{2\pi r\overline{W}C^2}{\dot{m}L} - \frac{1}{L}\left(H_s + \frac{1-C}{C}H_l\right)\frac{dT}{dr}C^2 \quad \text{(Equations XV)}$$

This non-linear $1^{st}$ order ODE can be converted into a linear $1^{st}$ order ODE by noting that:

$$-\frac{1}{C^2}\frac{dC}{dr} = \frac{d}{dr}\left(\frac{1}{C}\right) = \frac{d}{dr}\left(\frac{1-C}{C}\right) \quad \text{(Equation XVI)}$$

Accordingly, by defining a new variable Z as (1−C)/C, the following linear order $1^{st}$ order ODE results:

$$\frac{dZ}{dr} = \frac{H_l}{L}\frac{dT}{dr}Z + \frac{1}{L}\left(H_s\frac{dT}{dr} - \frac{2\pi r}{\dot{m}}\overline{W}\right) \quad \text{(Equation XVII)}$$

This equation is of the general form:

$$\frac{dZ}{dr} = f(r)Z + g(r) \quad \text{(Equation XVIII)}$$

From ODE theory, a general solution to the above equation is:

$$Z(r)=Ae^{\int f(r)dr}+e^{\int f(r)dr}\int g(r)e^{-\int f(r)dr}dr \quad \text{(Equation XIX)}$$

The solution for this specific problem is easily obtained upon substitution of the appropriate functions f(r) and g(r) into the equation above. A is an arbitrary constant that is determined from the initial condition, i.e., the value of consistency (and therefore Z) at the inlet to the refiner. The final solution for Z is given below $$Z(r) = Z(r_i)\left(\frac{L(r)}{L(r_i)}\right)^{\frac{H_l}{\beta}} + \frac{H_s}{H_l}\left[\left(\frac{L(r)}{L(r_i)}\right)^{\frac{H_l}{\beta}} - 1\right] - \frac{2\pi}{\dot{m}}L(r)^{\frac{H_l}{\beta}}\int r\overline{W}(r)L(r)^{\left(-\frac{H_l}{\beta}-1\right)}dr \quad \text{(Equation XX)}$$

This solution is based on the assumption that the latent heat of steam is a linear function of temperature of the form:

$$L(r)=\alpha+\beta T(r) \quad \text{(Equation XXI)}$$

The inlet radius is $r_i$. Since the temperature and the specific power are obtained at discrete points, the quadrature (last term in the equation for Z) is a function of the fitting or interpolation procedure used to obtain the measured quantities as continuous functions of radial position. Once the fitting or interpolation functions are known, the integration can be carried out numerically.

Finally, the consistency can be obtained from Z(r) as:

$$C = \frac{1}{1+Z} \quad \text{(Equation XXII)}$$

This method preferably is implemented in software to compute the consistency. For example, the method can be implemented in MatLab or another type of suitable software. A piecewise linear interpolation function preferably is used for the temperature and specific power functions, which provides the advantage that the quadrature in the functional representation of Z(r) can be exactly evaluated. Doing so, assumes that both the temperature and specific power data is available at the same radial locations.

Such a software-implemented method preferably can compute the consistency as a function of radial position within the refining zone. Only one measurement of consistency, C, is needed by the controller shown in FIG. 21. In one preferred implementation of this method, the consistency, C, determined is the consistency at the inlet of the refining zone or adjacent a radial inward location of the refining zone. For example, where consistency is determined in the refining zone adjacent a radial inward location, it can be determined, for example, for a location at or adjacent radially innermost sensor 194.

Figure 22:
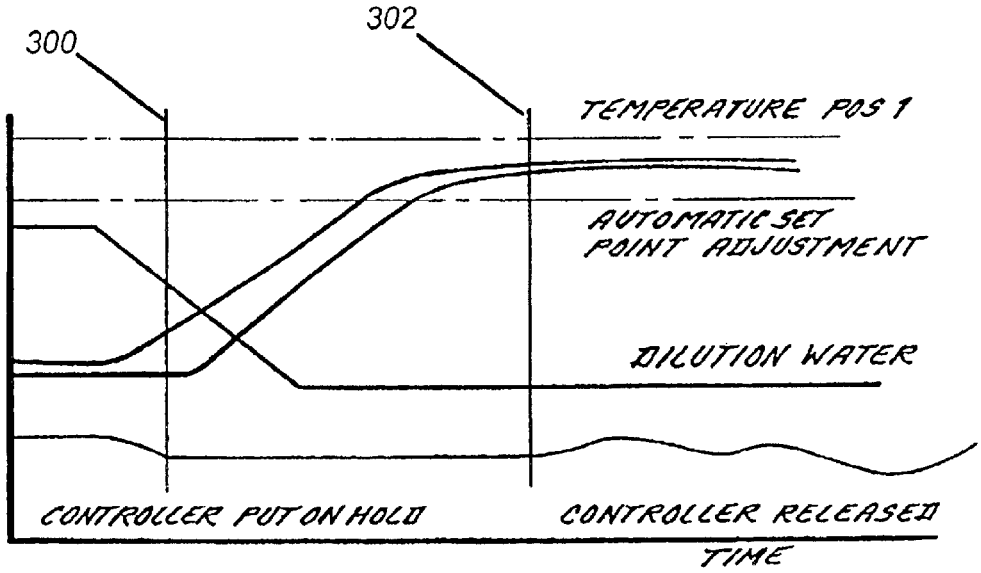
FIG. 22 is a graph illustrating a change in a refiner operating parameter putting a controller of the control method on hold and then releasing the controller when a process variable of the control method has stabilized.

FIG. 22 graphically illustrates a controller being put on hold when an operating parameter of the refiner is changed. The controller is released after the operating parameter has been changed and when the process variable has stabilized. For example, when the flow rate of the dilution water is changed, such as when an operator changes it or when a DCS changes it in response to a change in motor load, the controller is put on hold at the time, designated by line 300. A link between the DCS and the control computer can communicate when such a refiner operating parameter has been changed and thereby cause the controller to be put on hold.

After the operating parameter change has been made, the refiner begins to stabilize. For example, where refiner temperature is the process variable, the temperature will change and then stabilize in the manner shown in FIG. 22. Where consistency is the process variable, it too will stabilize. When the process variable has sufficiently stabilized, its value when the stabilization determination is made is adopted as the new setpoint and the controller is released, such as at the time indicated by line 302. When released, the controller resumes operation.

The control processor 34 preferably is configured with the control method of this invention or a preferred implementation of the control method. The control method preferably is implemented in software on board the control processor 34. Preferably, the control method is implemented in the form of a controller that preferably is a PI controller or a PID controller.

Figure 23:
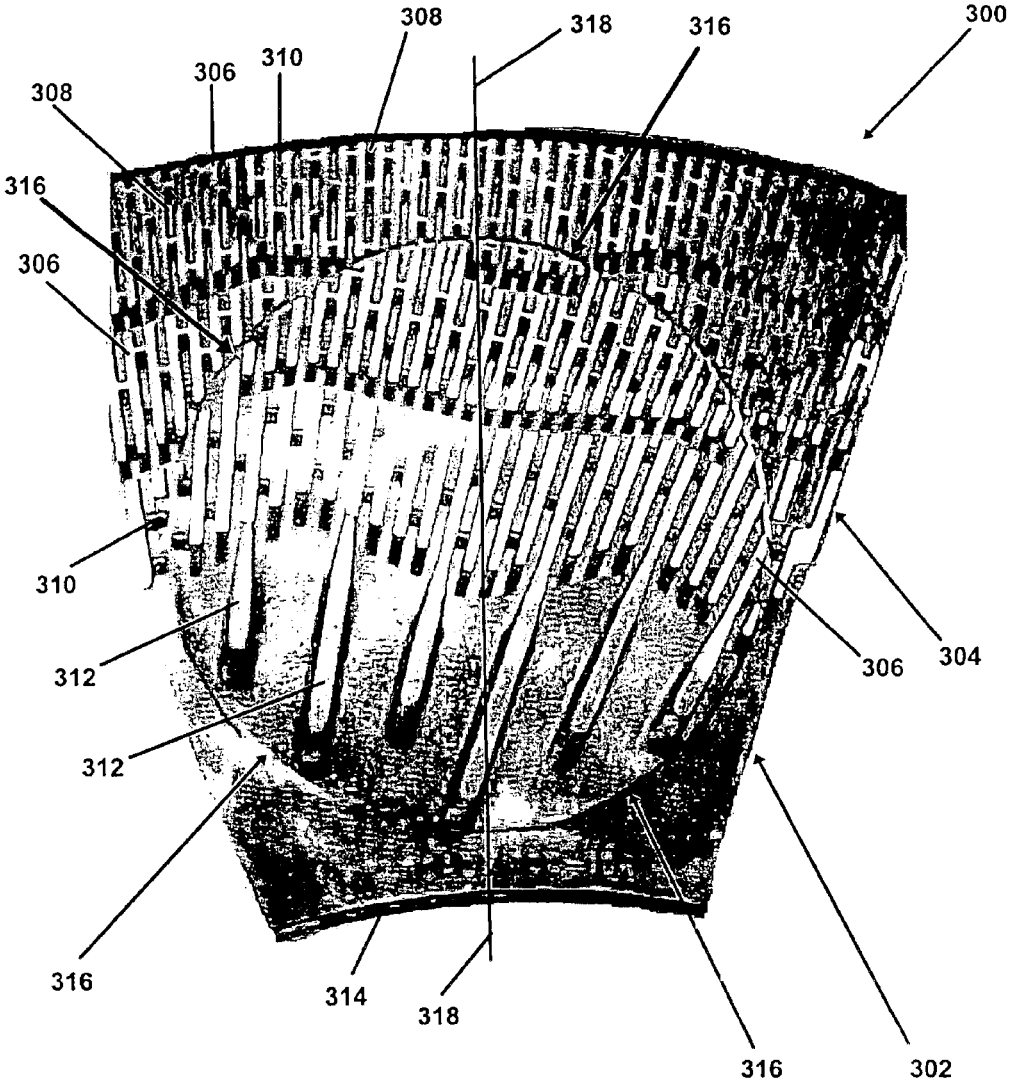
FIG. 23 is a top plan view of a refiner disk having a section with angularly inclined bars used in trialing to optimize refiner operation made using a casting process capable of producing a section of a refining surface with angled bars.

FIG. 23 illustrates a preferred embodiment of a refiner disk segment 300 that has a refining face 302 that includes a refining surface 304 comprised of upraised refiner bars 306 with grooves 308 disposed therebetween. If desired, surface or subsurface dams 310 can be disposed in grooves of the segment. The segment 300 also includes breaker bars 312 disposed adjacent the inner radial periphery 314 of the segment that help fling stock radially outwardly as stock enters a refining zone defined by the refining surfaces of a pair of opposed refiner plates. The refining surfaces 304 are disposed radially outwardly of the breaker bars 312.

The refining face 302 of the segment 300 has a section 316 disposed adjacent its inner radial periphery 314 that is angularly offset relative to part of the refining surface 304 and that includes a plurality of the breaker bars 312. In the preferred embodiment shown in FIG. 23, the angularly offset section 316 has a plurality of pairs of the breaker bars 312 and also includes a plurality of pairs of refiner bars 306. Thus, the angularly offset portion 316 of the segment 300 shown in FIG. 23 preferably includes part of the refining surface 304.

The angularly offset portion 316 preferably angularly offsets the breaker bars 312 at least 5° relative to radial 318. The angularly offset portion 316 preferably disposes the breaker bars 312 at an angle relative to radial between 5° and 45°. In the preferred segment embodiment shown in FIG. 23, the segment 300 has a single angularly offset section 316 that is circular in shape and that preferably encompasses at least 35% of the surface area of the refining face 302. The refining face 302 includes that refining surface 304 as well as that part of the front surface of the segment 300 that lacks refiner bars.

The circular shape of the section 316 is advantageous as it permits use of a reusable refiner disk segment casting pattern that has a rotatable insert that can be changed to change the angle of offset relative to radial of the section 316 as well as the angle of offset of the breaker bars 312 and refiner bars 306 of the section 316 of each finished cast segment. The use of such a pattern produces a refiner segment 300 having the offset section 316 integrally formed in its exterior surface (e.g. refining face 302) producing a segment 300 of one piece, unitary construction. Such a pattern and method of making refiner disk by casting is disclosed in copending and commonly assigned U.S. application Ser. No. 09/876,406, filed Jun. 7, 2001, now U.S. Patent Publication No. US 2002/0185560 A1. the disclosure of which is hereby expressly incorporated by reference herein.

Figure 24:
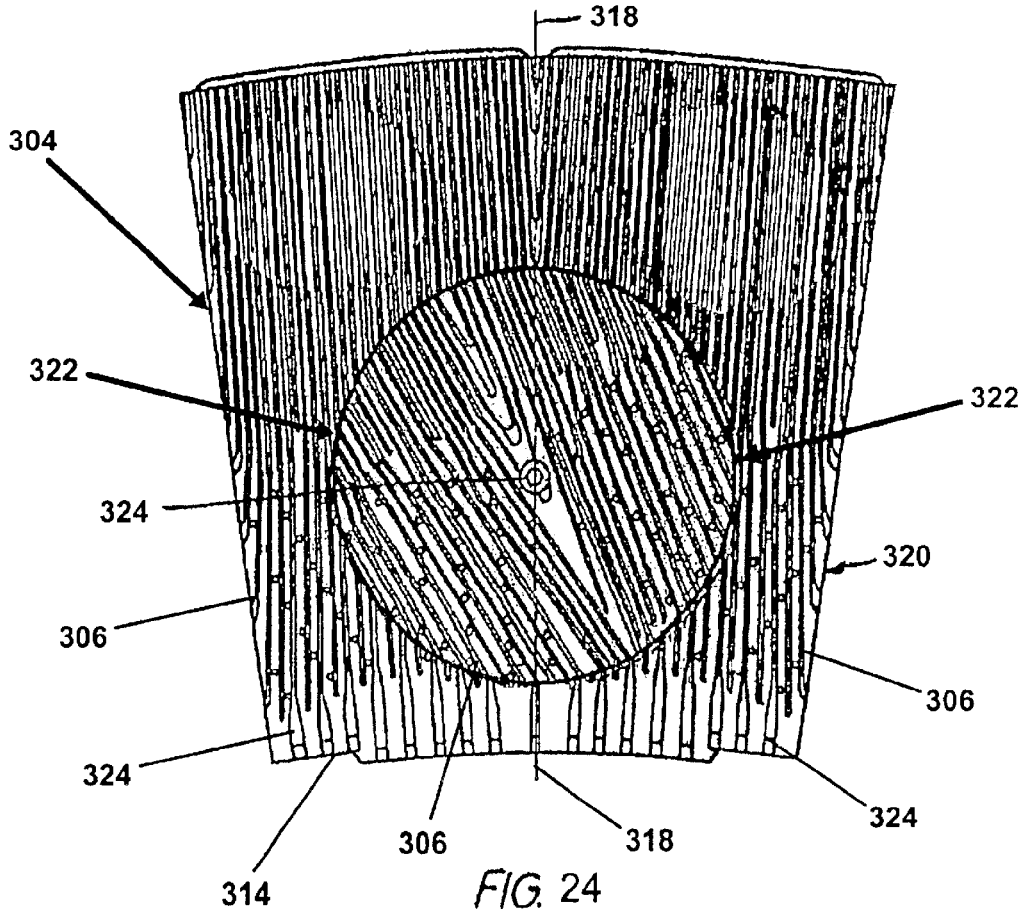
FIG. 24 is a top plan view of a refiner disk having a angularly adjusted refining surface section.

FIG. 24 illustrates a second preferred embodiment of a refiner disk segment 320 having a second section 322 that can be angularly offset relative to radial 318. In this preferred refiner plate segment embodiment, the angularly offset section 322 is disposed in at least a portion of the refining surface 304 of the segment 320 adjacent the inner radial periphery 314 of the segment 320. The angularly offset section 322 of the segment 320 shown in FIG. 24 is adjustable as it is constructed and arranged to be turned to change the angle of its refiner bars 306 relative to radial. The section 322 can also be equipped with breaker bars 312, if desired.

The section 322 is anchored to the segment 320, such as by a fastener 324 or the like, that extends through the section 322 toward the backside of the segment 320. In one preferred embodiment, the fastener 324 is threaded and is attached to a plate or nut (not shown) disposed along the backside of the segment 320. Preferably, the fastener 324 is tightened sufficiently such that the section 322 will not move during refiner operation. Other methods and mechanisms for securing the section 322 and making sure it does not rotate from its set position during refiner operation can be used. Such an adjustable refiner disk is disclosed in copending and commonly assigned U.S. application Ser. No. 09/735,853, filed Dec. 12, 2000, now U.S. Patent Publication No. US 2002/0070303 A1. the disclosure of which is hereby expressly incorporated by reference herein.

Figure 25:
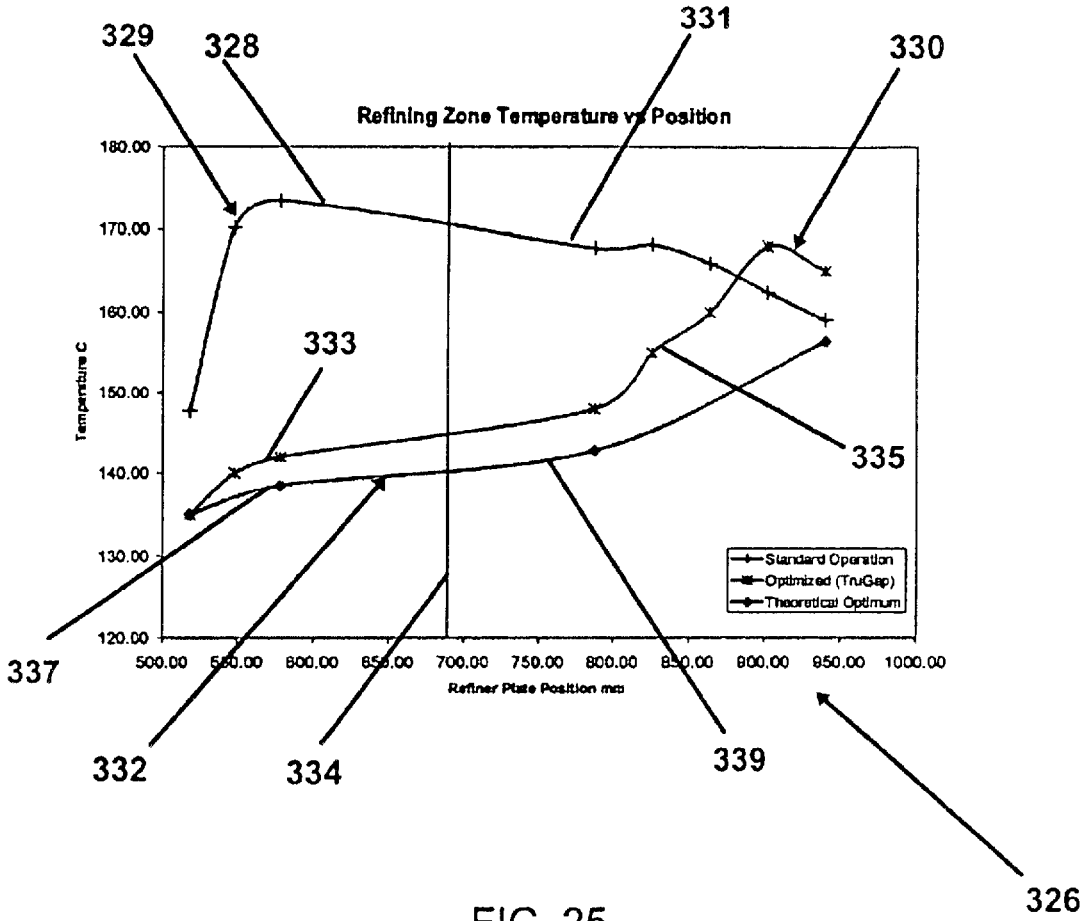
FIG. 25 is a graph of temperature profiles.

FIG. 25 illustrates a graph 326 of refining zone temperature profiles 328, 330, 332 for a CD refiner. Profile 332 represents a theoretical optimum or ideal temperature profile of a CD refiner across the refining zones of its flat refiner disks and its CD refiner disks. Profile 328 represents the temperature profile of the CD refiner that is equipped with conventional refiner disks in the flat refining zone section and conventional CD refiner disks in the CD section. Profile 330 represents the temperature profile of the CD refiner after refiner plate optimization has been performed to select plates having bar angles that produce the desired number of bar crossing per rotation such that the resultant temperature profile 330 approaches the optimum profile 332.

Each temperature profile has two sections. One portion of the graph 326, located to the left of line 334, represents the flat refiner plate part of the CD refiner and the other portion of the graph 326 located to the right of line 334, represents the inclined CD plate part of the refiner. The profiles on the left side of the graph 326 are also generally representative of a profile that would be produced by a flat plate refiner, one half of a twin refiner, or a conical refiner. These profiles would also be shaped approximately the same where pressures or heat flux in the refining zone are used to produce them. In such a case, the Y-axis of the graph would have an appropriate scale that relates to the parameter being profiled.

The section identified by reference numeral 328 of the top curve or profile 329 represents a part of the profile based on the measured or determined parameter, in this case, temperature in degrees Celsius, as a function of radial position, in millimeters, in the refining zone between conventional unoptimized flat refiner disks of the CD refiner. The portion identified by reference numeral 331 of the top profile 329 represents part of the profile based on the parameter, which in this case also is temperature, as a function of radial position, in millimeters, in the refining zone in the space between a pair of conventional unoptimized CD refiner disks of the refiner that are located radially outwardly of the flat disks.

Likewise, the section identified by reference numeral 333 of the intermediate profile 330 represents that part of the profile based on the measured or determined parameter as a function of radial refining zone position of optimized flat refiner disks of the CD refiner. The portion identified by reference numeral 335 represents that part of the profile based on the parameter as a function of position in the refining zone in the space between a pair of optimized CD refiner disks.

Finally, the section identified by reference numeral 337 of the intermediate profile 334 represents an estimated optimum profile based on the parameter as a function of radial refining zone position of theoretically optimum flat refiner disks. The portion identified by reference numeral 339 represents an estimated optimum profile based on the parameter as a function of radial refining zone position of theoretically optimum CD refiner disks.

As is shown by the portion 328 of profile 329, temperature increases dramatically adjacent the inner periphery of the refiner disk from the refining zone inlet (e.g. where stock enters the space between the opposed disks) until it begins slowly decreasing farther radially outwardly beyond approximately a radial midpoint of the refining zone. In the past, this temperature profile has been viewed as beneficial because increasing the temperature of fiber in stock being refined before it enters the refining zone was thought to soften the fiber to make it more pliable so it would better fibrillate during refining.

Through experimentation and testing it has been discovered that dramatically increased temperature adjacent the inner radial periphery is undesirable because it instead indicates that the refiner is expending a lot of energy along a region of the refining zone that extends from adjacent the inlet to just before the midpoint where not much refining is actually taking place. In fact, the amount of wasted energy can be approximated as being proportional to the surface area between section 328 of profile 329 and the section 337 of theoretically ideal profile 334.

It is believed that this energy loss occurs because fibers entering the space between the two opposed disks do not travel quickly enough to a part of the refining zone where their refining surfaces can contact, work, and fibrillate them. Instead, the fibers travel relatively slowly causing friction in this region of the refining zone to increases, which leads to increased temperature and is believed to lead to steam production. Formation of steam in this region of the refining zone adjacent the inlet is undesirable is at further obstructs fiber movement. Due to these and perhaps other factors as yet unknown, a great deal of energy is simply wasted during this part of the passage of the fibers through the refining zone.

Referring once again to FIG. 23, through the review of literature, experimentation and testing, it has been discovered that the use of refiner disks, such as refiner disk 300, that have at least one section 316 of their refining surface 302 located adjacent the inner radial periphery of the disk offset at an angle of at least 5°, and preferably at least 10°, relative to radial such that breaker bars 312 and/or refiner bars 306 in this section are correspondingly angularly offset, causes fiber entering the refining zone to more quickly accelerate radially outwardly toward a part of the refining zone where fibrillation more effectively occurs. As a result of fibers passing more quickly through this part of the refining zone, it is believed that less friction is created as evidenced by the lower temperatures of the profile 330 shown in FIG. 25. Lower temperature also means less steam buildup in this region, which is also believed to further speed radial outward fiber passage. As a result, a refiner equipped with optimized refiner disks uses significantly less energy to refine fiber to a desired quality and throughput is increased thereby increasing production. This translates into money saved and an increased return on investment.

In a preferred embodiment, a refiner disk made of segments having breaker bars 312 angularly offset at an angle of at least 5°, and preferably at least 10°, relative to radial 318 advantageously produces energy savings of at least 25%. Examples of suitable segments include the segment 300 shown in FIG. 23 and the segment 320 shown in FIG. 24. If desired, the segment or disk need not be equipped with breakers bars with the refiner bars of the angled section of its refining surface being angled in a desired manner so as to maximize the frequency of crossings with bars of an opposed disk or segment.

The use of an angularly offset section 316 or 322 adjacent the inner radial periphery in each of these segments helps increase the radial velocity of fiber in the stock, helping the fiber reach the heart of the refining zone 304 more quickly. As a result, temperature adjacent the radial inner periphery 314 of the segment is reduced and more closely approaches the temperature of stock at the refiner inlet or at the refining zone inlet 314. Additionally, by transporting the fiber in the stock is as quickly as possible to the refining zone 304, build up of fiber just radially outwardly of the radial inner periphery 314 decreases, which thereby reduces friction. Reduced friction decreases temperature and steam buildup in this region. As a result, throughput preferably is increased and energy usage is decreased. Preferably, this is all done without affecting the quality of the refined stock. In fact, refining quality preferably is improved.

In one preferred method of the invention, a plurality of pairs of sets of refiner disks are formed of segments that each have an angularly offset inlet section 316 or 322. Each set of segments has a different angular offset. Each set of segments is then tested in the refiner being optimized to generate a profile like the profiles shown in FIG. 25. To enable a profile to be generate, at least one of the segments of each set is a sensor refiner disk segment, such as sensor refiner disk segment 142' or 142".

In one preferred implementation of the refiner disk optimization method, a first pair of disks, having at least one of the disks comprised of segments having sections 316 or 322 angularly offset relative to radial 318 at a first angle, are installed in a refiner and trialed to obtain a first set of readings of a parameter in the refining zone from which a first profile is obtained. Preferably, both disks are comprised of segments that each has an angularly offset section 316 or 322 that preferably are offset at the same angle. Thereafter, a second pair of disks, having at least one of the disks comprised of segments having sections 316 or 322 angularly offset at a second angle that is greater than the first angle, are installed in then refiner and trialed to obtain a second set of readings from which a second profile is produced. If desired, a third pair of such disks having at least one disk comprised of segments having sections 316 or 322 angularly offset at a third angle that is greater than the second angle can be trialed in this same manner to produce a third profile. If desired, additional pairs of disks can be tried with increasing offset angles.

After testing is finished, the profiles are examined and compared against the theoretical optimum profile and the set of plates having the offset section with the bar angle come closest to the theoretical optimum profile is selected. Thereafter, refiner disk segments having that bar angle will be installed in the refiner and used in the refiner for the particular operating conditions or range of operating conditions for which optimization was performed. Optimization in the aforementioned manner may need to be performed where the operating conditions are significantly different or if a different disk geometry is going to be used.

In a preferred method, temperature is the parameter that is measured in the space between opposed plates. Preferably, radially spaced apart temperature measurements are taken along a segment of a plate for each pair of plates trialed to obtain a temperature profile to evaluate to determine which plates perform the best.

In one example of the method of determining bar angle by trialing plates with segments having different offset angles, a plate or pair of plates having segments with an inner peripheral section 316 or 322 with breaker bars 312 disposed at an angle of 5° is trialed in a refiner and a first temperature profile is obtained. A second plate or second pair of plates having segments with an inner peripheral section 316 or 322 with breaker bars 312 disposed at an angle of 10° is trialed in the refiner and a second temperature profile is obtained. A third plate or third pair of plates having segments with inner peripheral section 316 with breaker bars 312 disposed at an angle of 15° is trialed in the refiner and a third temperature profile is obtained. A fourth plate or fourth pair of plates having segments with inner peripheral section 316 or 322 with breaker bars disposed at an angle of 20° is trialed in the refiner and a fourth temperature profile is obtained. A fifth plate or fifth pair of plates having segments with inner peripheral section 316 or 322 with breaker bars disposed at an angle of 25° can be trialed in the refiner and a fifth temperature profile obtained. A sixth plate or sixth pair of plates having segments with inner peripheral section 316 or 322 with breaker bars 312 disposed at an angle of 30° is trialed in the refiner and a sixth temperature profile is obtained. If desired, additional plates or plate pairs with segments having sections 316 or 322 having even greater offset angles can be trialed. As previously discussed, disks having bar angles that produce the profile closest to optimum is selected and installed in the refiner for subsequent operation.

In a preferred implementation of a method of optimizing refiner performance, at least three disks or disk pairs each having segments with sections 316 or 322 with different offset angles are tried before making a determination as to which disk or pair of disk is closest to optimal. In a preferred implementation, each segment of at least one of the plates for each plate or plate pair being trialed has a section 316 or 322 offset at the angle being trialed.

After trials are complete, in one preferred implementation of the method, the plate or pair of plates that produce the lowest temperature profile are selected and disks having the angle of the disks installed in the refiner. If desired, other disks or segments having breaker bars 312 with the angle the same as the angle of the offset sections 316 or 322 of the plates selected as being closest to optimum can be installed where it is desired to use plates with segments that differ in construction somewhat from the segments 300 and 320 shown in FIGS. 23 and 24.

In another preferred implementation, after trials are complete, the disk or pair of disks that produces the lowest temperature adjacent the inner radial periphery are selected and installed in the refiner. In another preferred implementation, the disk or pair of disks that produce the lowest temperature at or adjacent the inner radial periphery and that produces the lowest temperature profile are selected and installed in the refiner.

In still another preferred implementation, the plate or plates selected have segments with angularly offset sections 316 or 322 that produce a temperature profile that has a maximum temperature that increases no more than 15° Celsius from the temperature at or adjacent the inner radial periphery. In still another preferred implementation, the plate or plates selected have segments with angularly offset sections 316 or 322 that produce a temperature profile that has a maximum temperature that increases no more than 10° Celsius from the temperature at or adjacent the inner radial periphery. Where a plate selected that has a profile generally like that depicted by reference numeral 330 in FIG. 25, the maximum temperature preferably occurs at or adjacent the radially outer edge of the plate or segment.

In a further preferred implementation, the plate or plates selected have segments with angularly offset sections 316 or 322 that produce a temperature profile, when approximated as being linear, that has a maximum positive slope of no more than 0.25° Celsius per millimeter at any point along its profile. In a still further preferred implementation, the plate or plates selected have segments with angularly offset sections 316 or 322 that produce a temperature profile, when approximated as being linear, that has a maximum positive slope of no more than 0.2° Celsius per millimeter at any point along its profile.

In a further preferred implementation, the plate or plates selected have segments with angularly offset sections 316 or 322 that produce a temperature profile along its longest straight section (approximated as being linear) that has a maximum positive slope of no more than 0.15° Celsius per millimeter at any point along that portion of its profile. In a further preferred implementation, the plate or plates selected have segments with angularly offset sections 316 or 322 that produce a temperature profile along its longest straight section (approximated as being linear) that has a maximum positive slope of no more than 0.1° Celsius per millimeter at any point along that portion of its profile. In a still further preferred implementation, the plate or plates selected have segments with angularly offset sections (316 or 322) that produces a temperature profile along its longest straight section (approximated as being linear) that has a maximum positive slope of no more than 0.075° Celsius per millimeter at any point along that portion of its profile. For example, referring to FIG. 25, the longest linear section of the temperature profile for the flat refiner plate starts at about the point, 141° C., 575 mm, and ends at its outer peripheral edge at about 145° C., 690 mm, for a slope of about 0.034° Celsius per mm.

In one preferred refiner plate embodiment, the refiner plate is comprised of segments that have breaker bars 312 adjacent the inner radial periphery 314 offset at an angle of at least 10° relative to radial 318 such that the resultant temperature profile has a maximum temperature that is no greater than 15° Celsius than the temperature at the refiner inlet and has a maximum positive slope of no greater than 0.25° per millimeter. In another preferred refiner plate embodiment, the refiner plate is comprised of segments that have breaker bars 312 adjacent the inner radial periphery offset at an angle of at least 10° relative to radial such that the resultant temperature profile has a maximum temperature that has a maximum positive slope of no greater than 0.25° Celsius per millimeter and a slope of no greater than 0.15° Celsius per millimeter along the longest linear portion of the profile. In still another preferred refiner plate embodiment, the refiner plate is comprised of segments that have breaker bars 312 adjacent the inner radial periphery offset at an angle of at least 10° relative to radial such that the resultant temperature profile has a maximum temperature that has a maximum positive slope of no greater than 0.2° Celsius per millimeter and a slope of no greater than 0.1° Celsius per millimeter along the longest linear portion of the profile.

In a preferred refiner plate embodiment, the refiner plate is comprised of segments that have breaker bars 312 and a plurality of refiner bars 306 adjacent the inner radial periphery 314 offset at an angle of at least 10° relative to radial 318 such that the resultant temperature profile has a maximum temperature that is no greater than 15° Celsius above the temperature at the refiner inlet and has a maximum positive slope of no greater than 0.25° per millimeter. In another preferred refiner plate embodiment, the refiner plate is comprised of segments that have breaker bars 312 and a plurality of refiner bars 306 adjacent the inner radial periphery offset at an angle of at least 10° relative to radial such that the resultant temperature profile has a maximum temperature that has a maximum positive slope of no greater than 0.25° Celsius per millimeter and a slope of no greater than 0.15° Celsius per millimeter along the longest linear portion of the profile. In still another preferred refiner plate embodiment, the refiner plate is comprised of segments that have breaker bars 312 and a plurality of refiner bars 306 adjacent the inner radial periphery 314 offset at an angle of at least 10° relative to radial such that the resultant temperature profile has a maximum temperature that has a maximum positive slope of no greater than 0.2° Celsius per millimeter and a slope of no greater than 0.1° Celsius per millimeter along the longest linear portion of the profile.

In a preferred refiner plate embodiment, the refiner plate is comprised of segments that have a plurality of refiner bars 306 adjacent the inner radial periphery 314 offset at an angle of at least 10° relative to radial such that the resultant temperature profile has a maximum temperature that is no greater than 15° Celsius than the temperature at the refiner inlet and has a maximum positive slope of no greater than 0.25° per millimeter. In another preferred refiner plate embodiment, the refiner plate is comprised of segments that have a plurality of refiner bars 306 adjacent the inner radial periphery offset at an angle of at least 10° relative to radial such that the resultant temperature profile has a maximum temperature that has a maximum positive slope of no greater than 0.25° Celsius per millimeter and a slope of no greater than 0.15° Celsius per millimeter along the longest linear portion of the profile. In still another preferred refiner plate embodiment, the refiner plate is comprised of segments that have a plurality of refiner bars 306 adjacent the inner radial periphery offset at an angle of at least 10° relative to radial such that the resultant temperature profile has a maximum temperature that has a maximum positive slope of no greater than 0.2° Celsius per millimeter and a slope of no greater than 0.1° Celsius per millimeter along the longest linear portion of the profile.

In another preferred method optimizing refiner performance, a theoretically optimum temperature profile 332 (FIG. 25) is determined for a given segment geometry. From a review of literature, it has been determined that the temperature of stock disposed between a pair of plates can be estimated to increase from the inlet temperature between about 7° and about 12° Celsius for each increase in order of magnitude of frequency, where frequency represents the frequency of impacts at a particular radial location that a fiber should experience for that particular geometry. In one method of determining frequency, bar density and speed of rotation are used to determine, for a particular radial location, how often a bar of one refiner plate will pass or cross a bar of its opposed counterpart. More specifically, one estimate of frequency involves multiplying the density of grooves at a particular radial segment location by the disk rotational speed in revolutions per minute. This is done at a number of radial locations along a segment. Preferably, it is done for at least three locations.

For each order of magnitude in frequency at a particular location, the temperature of the optimum temperature profile is estimated to increase between 7° and about 12° Celsius. For sake of convenience, any number in this range can be picked to use as the number by which temperature is increased for purposes of generating the theoretical optimum profile 332. For example, in one implementation, the temperature of the optimal profile can be increased by 10° Celsius for every increase in order of magnitude of frequency.

In another implementation, refining intensity at different locations can be used instead of frequency to determine the ideal or theoretically temperature profile 332.

In another method of optimizing refiner performance, plates with inner radial sections 316 or 322 with different angular offsets are trialed in the manner described above to obtain a temperature profile. The plates selected preferably have a temperature profile that is closest to the theoretical optimum temperature profile 332 plotted.

In another method of optimizing refiner performance, a temperature measurement of each plate trialed is taken a distance of a least 20 millimeters radially inwardly of the inner radial edge and the plate selected has a temperature at this location that is closest to or deviates the least from the inlet temperature.

In another preferred refiner plate embodiment, the refiner plate is made up of segments with angularly offset breaker bars 312 that have an offset angle of at least 10° relative to radial 318 and that produce a temperature between 20 and 25 millimeters from the radial inner peripheral edge 314 that is not more than 10° Celsius greater than the inlet temperature of the stock entering between the refiner plates. In still another preferred refiner plate embodiment, the refiner plate is made up of segments with angularly offset breaker bars that have an offset angle of at least 10° relative to radial and that produce a temperature between 20 and 25 millimeters from the radial inner peripheral edge that is not more than 7.5° Celsius greater than the inlet temperature of the stock entering between the refiner plates.

If desired, pressure can be used instead of temperature for the above methods and embodiments relating to FIGS. 23–25. Where pressure is used, the pressure corresponding to the above-identified temperature is used.

To determine temperature or pressure, at least one of the refiner plates is equipped with one or more sensors, such as sensors 180–194 depicted in FIGS. 7 and 8. If desired, the sensor can be embedded in a refiner face and/or refining surface of a segment. In one preferred embodiment where the refiner is a flat plate or conical refiner, at least one segment of each pair of opposed plates is equipped with a segment having a plurality of sensors capable of sensing temperature and/or pressure in the space between the plates. In another preferred embodiment where the refiner is a CD refiner, at least one segment of each pair of opposed flat plates is equipped with a plurality of sensors such that temperature and/or pressure can be sensed at a plurality of different radial locations in the space between the plates and at least one segment of each pair of opposed CD plates is equipped with a plurality of sensors such that temperature and/or pressure can be sensed at a plurality of different radial locations in the space between the plates.

In one preferred embodiment, each sensor refiner plate segment can have as many as eight radially spaced apart sensors. Signals from these sensors are used to determine the profile used to evaluate performance.

Figure 26:
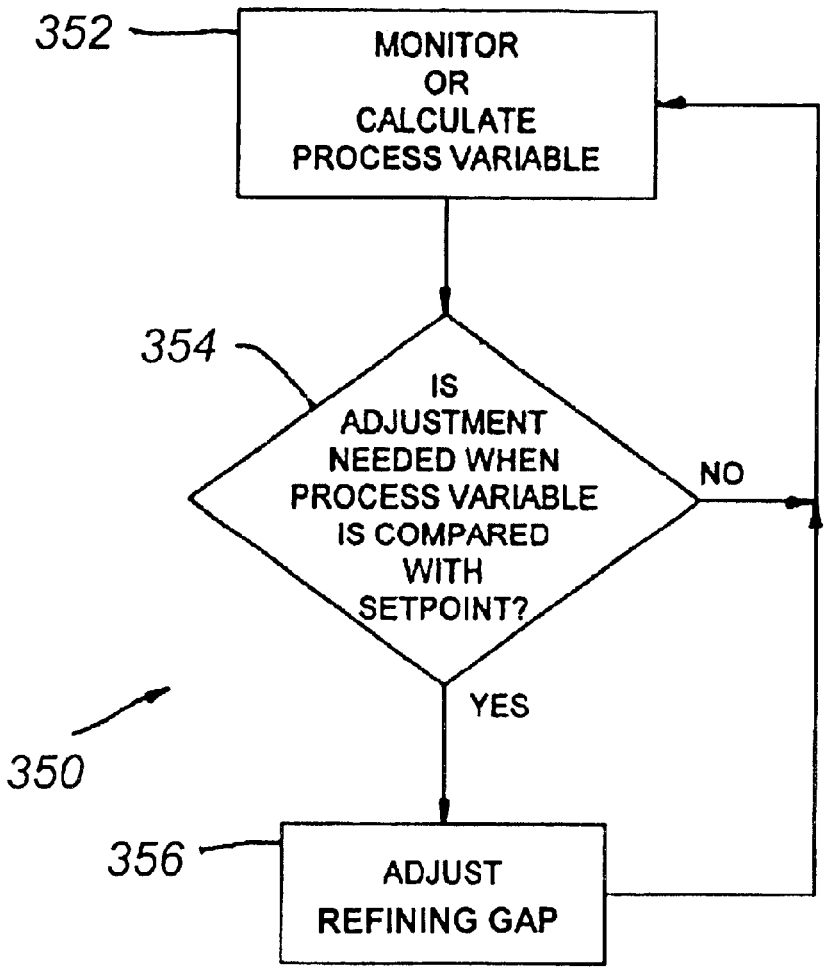
FIG. 26 is a preferred control method.

FIG. 26 illustrates a method of controlling refiner operation 350 through adjustment of the gap between a pair of opposed refiner disks using a process variable that relates to or is obtained from data from a sensor refiner disk segment, such as 142' or 142", which forms part of one of the disks. The gap is adjusted based on comparison of the process variable against a setpoint that can include a setpoint band or range having upper and lower limits tied to the setpoint.

During refiner operation, the process variable is monitored or calculated 352. The process variable is then compared against a setpoint 354. If no gap adjustment is needed, monitoring continues. If gap adjustment is needed 356, the disks are moved relative to each other to change the gap between them. Thereafter, monitoring 352 continues.

In one preferred implementation, the process variable relates, at least in part, to or is obtained, at least in part, from a temperature, a heat flux, or a pressure sensed or measured in the refining zone such as by using a sensor refiner disk segment 142' or 142" equipped with at least one sensor. Where the sensor segment includes a plurality of pairs of sensors, the process variable can relate to or be based on that which is sensed from or determined through receiving data from all of the sensors. For example, if desired, the process variable can represent some function, such as an average, of the temperatures from the sensors of the sensor segment.

Figure 27:
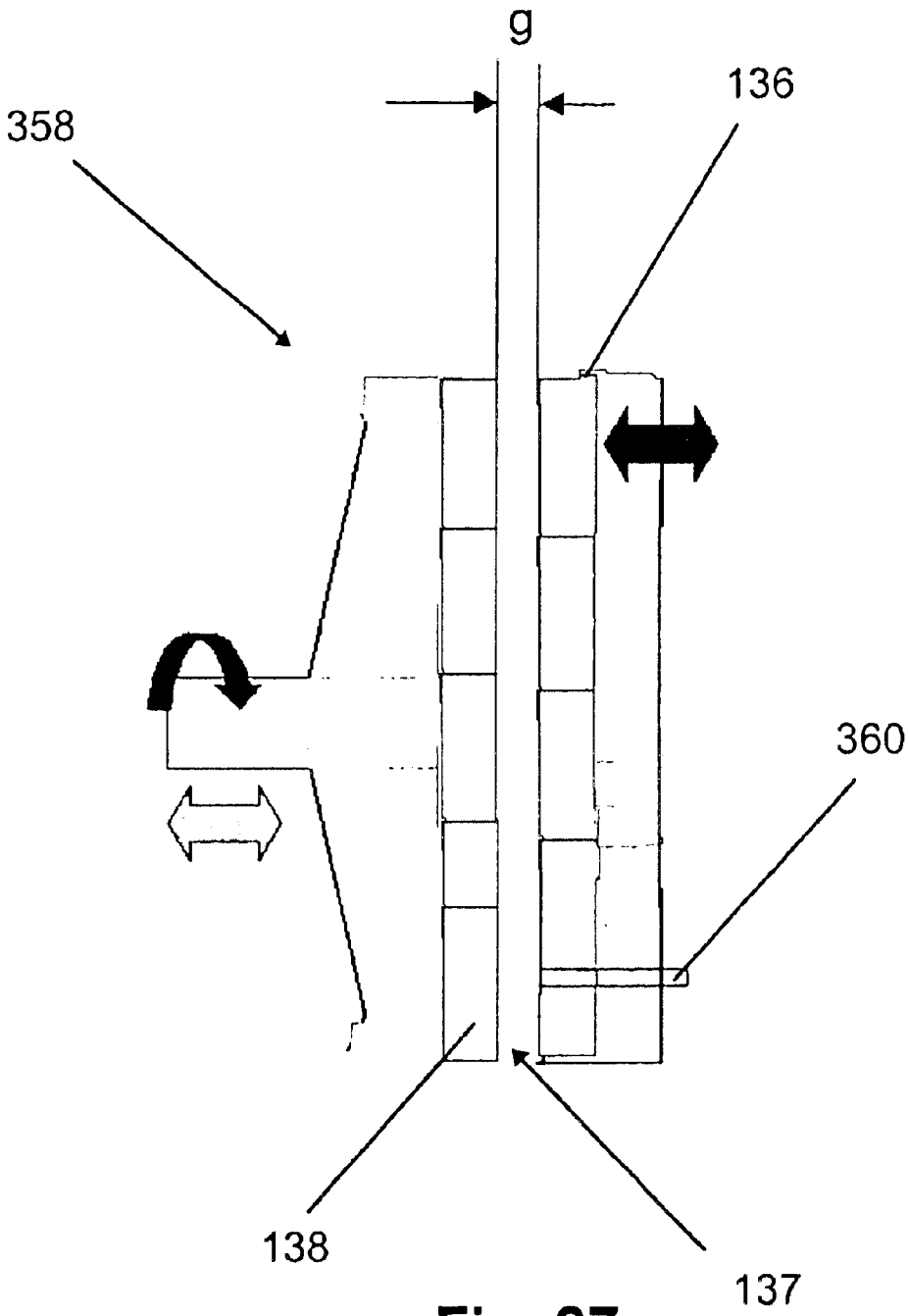
FIG. 27 depicts refiner gap adjustment in a flat plate refiner.

Referring to FIG. 27, in adjusting the gap, g, of a refiner 358 at least one refiner disk 138 is moved toward the other disk 136 where it is desired to increase the temperature, heat flux, or pressure in the refining zone 137 between the disks 136, 138, when it is determined that the temperature, heat flux, or pressure must be increased to cause the process variable to move back toward the setpoint or back within a desired setpoint band. In adjusting the gap, g, at least one disk 138 is moved away from the other disk 136 where it is desired to decrease the temperature, heat flux, or pressure in the refining zone, when it is determined that this must be decreased to cause the process variable to move toward the setpoint or back within a setpoint band. If desired, where it is desired to allow operation to stabilize, the method can include a time delay after changing the gap before another gap change can be made to allow refiner operation to stabilize. For example, a controller in which the method is implemented can be paused until the measured process variable stabilizes and then released, such as in the manner previously discussed.

Preferably, a gap sensor 360 is employed to measure the gap, g, of the refining zone 137 between the disks 136, 138 and to determine whether the gap is being narrowed or widened in accordance with what is desired or dictated by operation of the method 350 depicted in FIG. 26. Where the gap, g, must be adjusted 356, a DCS can be employed to move the disks relative to each other to change the gap where one is provided. For example, the DCS or controller can selectively operate the hydraulics of the refiner 358 being controlled to change the gap. Where other means are employed to change the gap, the DCS or controller preferably communicates a signal that moves one disk 138 relative to the other disk 138 as needed. For example, where the gap, g, can be changed mechanically, such as by a ballscrew, electric motor, or by another mechanism, the DCS or controller executing the algorithm depicted in FIG. 26 communicates a signal that causes the mechanism to move one disk 138 relative to the other disk 136.

Gap adjustments preferably are made in real time during refiner operation using the control method 350 of this invention. For example, in one preferred implementation, gap adjustments are capable of being made at least once per minute, as needed. In a preferred implementation, a plurality of gap adjustments per minute can be made. In another preferred implementation, gap adjustments can be made at a rate of at least one hertz.

In one preferred implementation of the method, temperature of stock in the refining zone is monitored in real time using at least one sensor carried by a refiner disk or segment thereof and the gap, g, is adjusted in response to changes in the temperature as compared against a setpoint temperature or setpoint temperature band.

Figure 28:
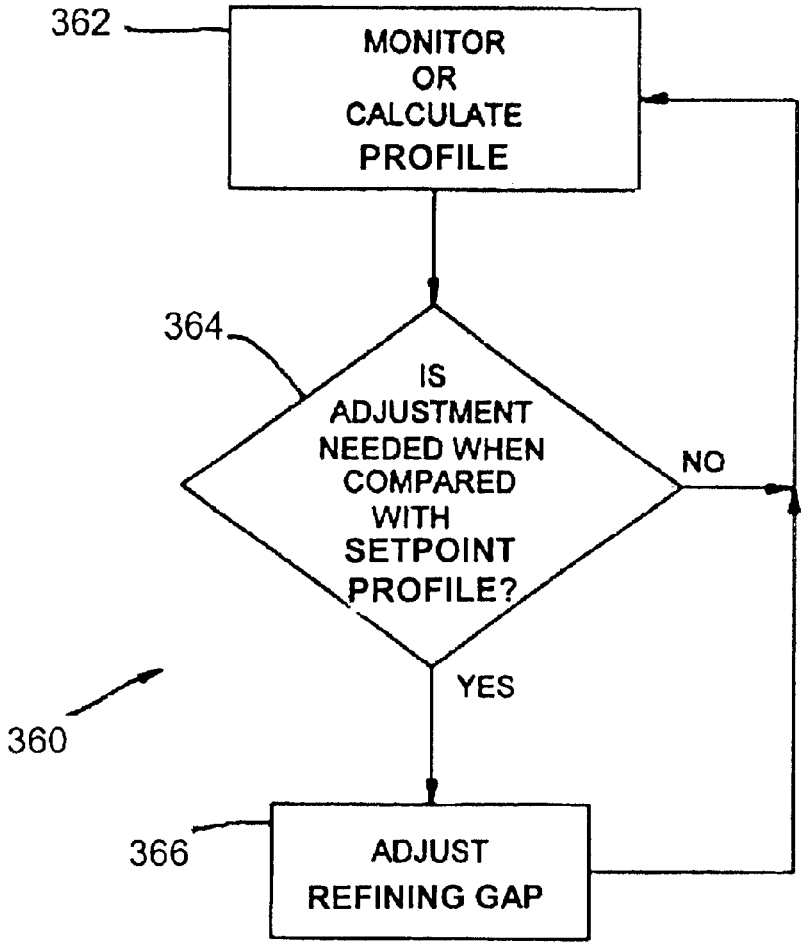
FIG. 28 illustrates another preferred control method.

FIG. 28 illustrates another method of controlling refiner operation 360 by adjusting the gap between a pair of opposed refiner disks using a process profile that is a curve that relates to or is obtained from data from a sensor refiner disk segment, such as 142' or 142", which is equipped with a plurality of pairs of sensors. The gap is adjusted based on comparison of the process profile against a setpoint profile that can comprise a setpoint profile band having upper and lower profile limits.

During refiner operation, the process profile is monitored or calculated 362. The process profile is then compared against a setpoint 364. If no gap adjustment is needed, monitoring continues. If gap adjustment is needed 366, the disks are moved relative to each other to change the gap between them. Thereafter, monitoring 362 continues. The method can include a time lag after the gap has been adjustment that suspends further gap adjustment using the method until refiner operation has stabilized by reaching a steady state operating condition.

In another preferred implementation of the method, a sensor disk segment, such as segment 142' or 142", equipped with a plurality of pairs of temperature sensors is used to obtain a temperature profile, such as profile 330, in real time during refiner operation using a plurality of pairs of refining zone temperatures. The profile obtained is then compared to a predetermined theoretical ideal profile, such as profile 332, based on the refiner disk geometry. The gap, g, is adjusted in response to the profile in a manner that preferably drives it toward the ideal profile or attempts to keep the profile within a certain range or band of the ideal profile. For example, in one preferred implementation, the gap, g, is adjusted so as to keep a profile obtained during real time monitoring within a band or range that is within 15% of the ideal profile.

In another preferred implementation, a plurality of spaced apart temperature sensors are employed to provide two temperature measurements at two different refining zone locations. The two temperatures obtained are then compared with two theoretically ideal temperatures predetermined for the same two refining zone locations for a disk of such geometry. Thereafter, the gap, g, is adjusted during refiner operation if either temperature increases beyond a temperature setpoint value that is the sum of the associated theoretical ideal temperature plus an added offset. In another preferred implementation, the gap, g, is adjusted if both temperatures rise during refiner operation beyond their respective setpoint temperature value. In one preferred implementation, the refiner disks are flat disks, the sensors are located at least 30 mm from the inner peripheral disk edge, and the offset applied is 20° Celsius. Where the disks are CD disks, the sensors preferably are located within the first 175 mm of the inner radial peripheral disk edge and the applied offset also is 20° Celsius.

Data from a plurality of pairs of sensors can be processed to provide a profile of pressure, heat flux, and/or temperature in the refining zone between the disks. This measured or sensed profile is compared with a setpoint profile and refiner gap is accordingly adjusted to help keep the measured profile within a band or window of the setpoint.

If desired, a second controller can be used in the manner depicted in FIGS. 17–19 to adjust to regulate stock or fiber mass flow or dilution water flow to help regulate temperature and/or pressure inside the refining zone. If desired, two additional controllers can be used with one of the controllers being used to regulate fiber mass flow or volumetric flow of stock and the other one of the controllers being used to regulate dilution water flow to help regulate temperature and/or pressure within the refining zone.

Figure 30:
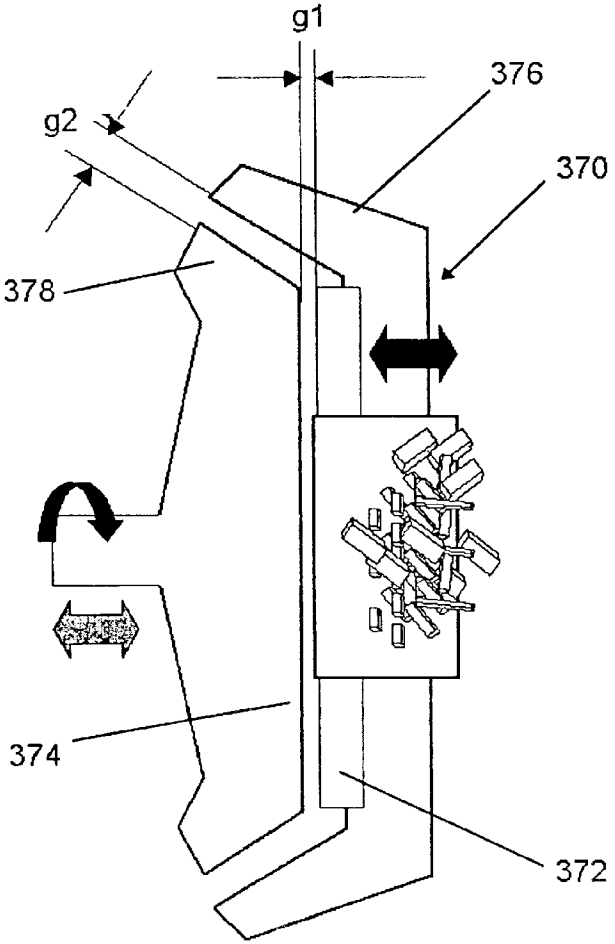
FIGS. 29 and 30 depict adjustment of refiner gaps of a CD refiner.
Figure 29:
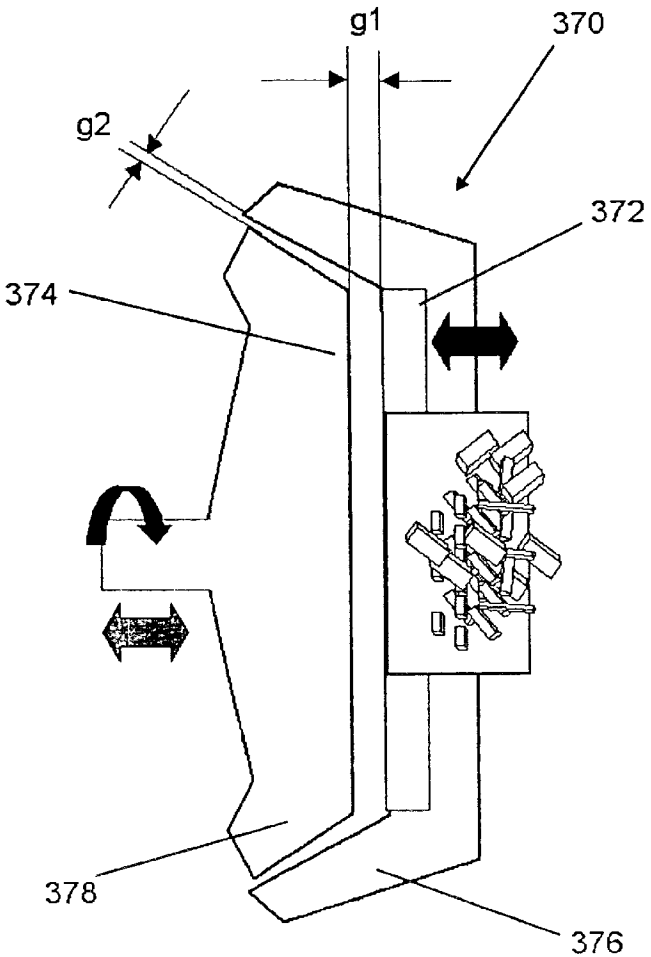

Referring to FIGS. 29 and 30, where the refiner is a CD refiner 370, a pair of controllers preferably can be used or a plurality of methods of the invention can be implemented to adjust the flat plate gap, $g_1$, located between disks 372 and 374, independently of the CD plate gap, $g_2$, located between CD disks 376 and 378, in response to a process variable that can be independently measured or determined pressure and/or temperature or which is based on measured or determined pressure and/or temperature. Preferably, each set of disks 372 and 374, 376 and 378, has at least sensor disk or sensor segment (not shown) equipped with a plurality of radially spaced apart sensors that sense some characteristic of stock in the refining zone.

In another preferred method, refiner quality is measured and adjustments made to the refiner until a desired quality is reached. Thereafter, temperature and/or pressure is measured to obtain a setpoint or setpoint profile. During refiner operation, temperature and/or pressure measurements are compared against the setpoint to determine what adjustment to make.

In one preferred embodiment, refining zone gap is adjusted in response to the pressure and/or temperature measurements made. In another preferred embodiment, refining zone gap is adjusted based on temperature and/or pressure measurements made. Refining zone gap is narrowed where it is desired to increase pressure or temperature in the refining zone to keep it at or within a desired band of its setpoint.

In one preferred embodiment, where temperature is used as a setpoint, the gap can be adjusted to keep the temperature within the refining zone within two degrees Celsius of the setpoint temperature. In another preferred implementation, the gap is adjusted by the controller to keep the measured temperature within one degree Celsius of the setpoint. In another preferred implementation, the gap is adjusted by the controller to keep the measured temperature within 10% of the setpoint.

In a preferred embodiment, the sensor refiner disk is comprised of temperature sensors and temperature in the refining zone is sensed, measured or determined using the sensors and used as the process variable. Quality is monitored and compared against the temperature measured at the time quality is measured to ensure that the correlation between quality and temperature in the refining zone remains valid.

In one preferred implementation, once a desired quality or quality range is achieved, such as by using conventional quality measurement apparatus and methods, a setpoint or setpoint profile is determined when the refiner is operating at the desired quality or quality range using one or more measurements of a characteristic of stock in the refining zone. Thereafter, adjustments to refiner operation are made using the measured refining zone stock characteristic(s) as a process variable or process variable profile to keep it at the setpoint or setpoint profile, close to the setpoint or setpoint profile, or within a certain band of the setpoint or setpoint profile. In one preferred implementation, dilution water flow rate is adjusted in response to unacceptable deviations of the process variable or process variable profile away from the setpoint or setpoint profile. In another preferred implementation, stock mass flow rate is adjusted, such as by controlling feed screw speed, in response to unacceptable deviations of the process variable or process variable profile. In a still further preferred embodiment, the gap is adjusted in response to unacceptable process variable or process variable profile deviations. Where the refiner is a CD refiner, each gap, $g_1$, and $g_2$, is independently adjustable based on separate process variable or process variable profile comparison with separately determined setpoints or setpoint profiles.

In another preferred implementation, the optimum temperature profile is used as a setpoint profile and the gap is adjusted in real time during refiner operation to help drive the actual temperature profile downwardly toward the optimum temperature profile. Preferably, the gap is adjusted to drive the temperature profile to within a preset band or range of the optimum profile. In one preferred embodiment, the gap is regulated in response to the actual temperature profile keep the actual temperature profile within 10% of the optimal temperature profile.

In another preferred implementation, a plurality of measurements of a characteristic of stock at spaced apart locations in the refining zone are made and used to calculate consistency that can be determined as a function of position in the refining zone. Thereafter, the consistency can be determined using measurements of the refining zone stock characteristics taken during refiner operation and compared against a setpoint consistency or setpoint consistency range that can be within±15% of the desired setpoint. One or more of dilution water flow rate, stock mass flow rate, and refiner gap can be adjusted to keep the measured consistency at the consistency setpoint or within a desired range of the setpoint.

In one preferred implementation, refiner operation is adjusted, such as through manual or automatic operation, until a desired quality is achieved. Consistency is measured while the refiner is operating at that desired quality or within an acceptable range of the desired quality using at least one measurement of a characteristic of stock in the refining zone during refiner operation. In one preferred embodiment, a temperature sensor is used to measure a temperature of stock in the refining zone that is used as one input to calculate consistency. In another preferred embodiment, a sensor disk or sensor segment, such as segment 142' or 142", is equipped with a plurality of pairs of temperature sensors that are used to calculate consistency as a function of refining zone position. A consistency at a particular refining zone position is used as the process variable and is compared against the consistency setpoint or setpoint range.

Quality preferably is monitored and compared with determined consistency. If the relationship between quality and consistency becomes inconsistent, the operator can be so notified. In one preferred implementation, should the relationship between quality and consistency become unpredictably inconsistent, quality can then be used as the process variable with the desired quality used as a setpoint. Adjustments to refiner operation can then be made as needed to bring the measured quality back within an acceptable range of the quality setpoint using measurements from one or more sensors, such as temperature sensors or the like, that sense a characteristic, such as temperature or the like, of stock in the refining zone.

In a preferred implementation of a method of the invention, quality of fiber being refined is regulated by adjusting refiner gap in response to changes in refining gone temperature. In one preferred embodiment, a segment of a disk of the refiner is equipped with one or more temperature sensors that sense temperature of stock in the refining zone. A temperature that can be a peak temperature, i.e., the highest temperature of the temperature measurements obtained from all of the sensors during a particular sensor reading, is used as a control variable and is compared against a desired setpoint that is set when the refiner is operating at the desired pulp quality. Refiner gap is adjusted to keep the temperature substantially constant with the setpoint or within a suitable range of the setpoint. As a result, quality is preferably is kept substantially constant.

Where the refiner is a CD refiner, one of the flat segments is a sensor segment equipped with temperature sensors and one of the CD segments is a sensor segment equipped with temperature sensors. The flat disk gap and CD gap are adjusted independently of one another in response to respective temperature changes in the respective refining zones to keep quality substantially constant by minimizing refining zone temperature variations.

In another preferred implementation of a control method suitable for use with a twin refiner, measurement of a characteristic of stock in each refining zone can be used as a control variable to control delivery of chips to each refining zone. In one preferred implementation, a sensor segment is used to monitor temperature of stock in each refining zone during refiner operation to adjust flow of wood chips to each refining zone in a manner that balances temperature. For example, temperature in each refining zone is monitored and the rate of flow of chips to each refining zone of the twin refiner is adjusted until the temperatures in both refining zones are substantially the same. If desired, a sensor segment equipped with a plurality of pairs of temperature sensors can be used for each refining zone to provide a temperature profile that is used to regulate chip flow to each refining zone until the profiles are substantially the same or within an acceptable range of each other. In this manner, production can also advantageously be balanced and more consistent refining achieved.

In one preferred embodiment, the method is implemented in a controller that ultimately controls operation of a Giri gari stream splitting device (not shown) to control chip flow to each refining zone of the twin refiner. If desired, this method and apparatus can be employed to control feed screw speed of two feed screws that supply chips to two different refiners so as to keep temperature or a temperature profile within the refining zone substantially constant. If desired, such a method can be implemented using heat flux or pressure as a process variable used to control operation.

In another preferred implementation of a control method of the invention, refiner operation is controlled in a manner so as to maintain a suitably constant specific energy that provides desired refining qualities and production rate. In order to keep specific energy of a refiner during operation constant or within an acceptable range, production and refiner load are kept at a constant ratio or within a suitable range of a desired ratio that preferably is determined or set when desired refining qualities and production rate is achieved during a startup or calibration period of operation. Thereafter, during operation using a control method of the invention, a peak refining zone temperature is determined using one or more sensors that sense a characteristic of stock in the refining zone from which peak temperature can be obtained. In one preferred embodiment, a sensor disk segment is equipped with a plurality of pairs of temperature sensors that measure temperature of stock in the refining zone during refiner operation. Peak temperature in the refining zone is monitored, preferably in real time during refiner operation, and feed screw speed is adjusted in response to peak temperature to keep production constant by keeping peak temperature close to a desired peak temperature setpoint or within a suitable peak temperature setpoint range. Refiner load also is monitored and dilution water flow rate is adjusted in response to refiner load to keep refiner load constant, preferably by keeping it close to a desired setpoint, or within a suitable range of a desired refiner load setpoint.

Thus, in a currently preferred method of controlling refiner operation so that specific energy is kept substantially constant by keeping the ratio of refiner production and refiner load substantially constant. To keep production substantially constant, feed screw speed is adjusted to keep peak temperature within a desired temperature setpoint or acceptable range of the setpoint. To keep refiner load substantially constant, dilution water flow rate is adjusted accordingly. Adjusting dilution water flow rate in response to monitored load to keep load substantially constant enables dilution water flow rate to be adjusted to account for changes in fiber moisture content, such as what can occur when wood chips having a different moisture are introduced into the refiner.

In one preferred method, control of high consistency refining operation is performed through refining zone temperature optimization. More specifically, a control method is implemented for high consistency refiner operation that controls energy applied and resultant pulp quality by controlling the temperature of stock in the refining zone.

In understanding the principle behind this method, it is noted that the principle of conservation of energy, also called the first law of thermodynamics, states $$Q+W=\Delta KE+\Delta PE+\Delta U \qquad \text{(Equation XXIII)}$$

This law applies to a closed system, i.e., a system with constant mass. Q is the heat transferred to the system, W is the work done on the system, KE is the kinetic energy, PE is the potential energy and the U is the internal energy. Δ represents change or increment.

The first law can be approximated for the wood-water system in the refiner. The changes in kinetic and potential energy are small relative to the internal energy and the heat transferred to/from the system is small compared to the work done by the refiner. This gives:

$$W=\Delta U \qquad \text{(Equation XXIV)}$$

In a process or flow-based system, it is much more convenient to operate in terms of time rates of change of work, heat and energy. Thus, if the power supplied to the refiner is P, then the work done by it in a time increment Δt is PΔt and the change in internal energy of the wood-water system will be $$P\Delta t = \Delta U \qquad \text{(Equation XXV)}$$

$$P = \frac{\Delta U}{\Delta t}$$

In the limit as time approaches zero, a true rate equation is obtained $$P = \frac{dU}{dt} = \dot{U} \qquad \text{(Equation XXIVI)}$$

Technically, the above equation applies to the pulping process, but it cannot be applied directly because the refining zone is an open system, defined by a fixed volume in space with material crossing the boundaries of the volume. Such an open system is also called a control volume. In order to use it, two corrective terms need to be added to account for the influx and outflux of energy across the boundaries of the refining zone. The corrected equation is:

$$P+\dot{U}_{in}=\dot{U}+\dot{U}_{out} \qquad \text{(Equation XXVII)}$$

The subscripts in and out refer to influx and efflux respectively. U now represents the internal energy within the refining zone. The equation above is applicable to any open system and this includes an open system of infinitesimal dimensions.

After putting the terms above in the energy equation and neglecting products of infinitesimals, it is reduced to the form $$2\pi r\overline{W}dr = 2\pi rLm_s dr + \dot{m}H_s dT + \dot{m}\frac{1-C}{C}H_l dT + 2\pi r m_s H_l T dr + \dot{m}H_l T d\frac{1-C}{C} \qquad \text{(Equation XXVIII)}$$

It can be shown that the last two terms in the equation above sum to zero because of conservation of mass. The remaining terms can be rearranged to give:

$$m_s = \frac{1}{L}\left(\overline{W} - \frac{\dot{m}}{2\pi r}\left[H_s + \frac{1-C}{C}H_l\right]\frac{dT}{dr}\right) \qquad \text{(Equation XXIX)}$$

Thus, the application of mass and energy conservation to an open system containing moist wood yields two equations for consistency and steam production rate, respectively, in the refining zone. These equations are:

$$\frac{dC}{dr} = 2\pi r\frac{m_s}{\dot{m}}C^2 \qquad \text{(Equations XXX and XXXI)}$$

$$m_s = \frac{1}{L}\left(\overline{W} - \frac{\dot{m}}{2\pi r}\left[H_s + \frac{1-C}{C}H_l\right]\frac{dT}{dr}\right)$$

Temperature and specific power can be obtained through direct measurement during refiner operation.

As previously discussed, temperature in the refining zone can be used to predict quality at a sampling rate of at least 0.5 hertz and preferably at about one hertz. Indeed, refining zone temperature can be similarly used to predict CSF, long fiber, fiber length, and other related refining variables used for qualitative analysis and comparison. Freeness can also be predicted in a similar fashion.

In one preferred control method, refining zone temperature is monitored and one or more of dilution water flow rate, mass flow rate, and/or refiner gap is adjusted to minimize steam production preferably using Equation XXXI. If desired, a steam mass flow rate can be determined when the refiner is operating in a desired fashion and the temperature in the refining zone thereafter monitored in real time during refiner operation. Thereafter, dilution water flow rate, screw speed, and/or refiner gap can be adjusted in response to changes in refining zone temperature to keep steam mass flow rate substantially constant at or near a steam mass flow rate setpoint or within a suitable range of the setpoint. Heat flux and pressure in the refining zone can also be used as a process variable used for refiner control to help determine mass flow rate.

In one preferred method, a refiner is evaluated by trialing disks having different bar angles until a relatively low temperature profile that is close to an ideal profile that is determined based on raw material that will be refined, refining surface pattern, and anticipated refiner operation conditions. After optimum bar angle is determined or selected, sets of disks having the optimum bar angle are installed in the refiner. The refiner is operated to establish a reference from which a setpoint or setpoint profile can be determined at which operation for a given material and consistency is optimized. Thereafter, at least one control method of the invention is employed to control operation of the refiner in response to a characteristic of stock in the refining zone measured in real time during operation.

In one preferred control method, operation of the refiner is controlled to maintain a substantially constant specific energy by maintaining a substantially constant ratio between load and production. Load is kept substantially constant by regulating dilution flow water rate in response to a characteristic of stock in the refining zone and production is kept substantially constant by controlling feed screw speed. In one preferred embodiment, a sensor disk segment equipped with one or more temperature sensors is employed to provide a controller running the control method with temperature of stock in the refining zone during refiner operation. Dilution water flow rate is regulated in response thereto. As a result, a temperature profile of a distribution of the temperature of stock over the radial distance of the refining zone is kept substantially constant during refiner operation, which advantageously decreases energy use, and reduces variation in pulp quality.

It is also to be understood that, although the foregoing description and drawings describe and illustrate in detail one or more preferred embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims.

What is claimed is:

1. A method of controlling operation of a rotary disk refiner, the method comprising the acts of:

providing a plurality of refiner disks having opposed refining surfaces spaced apart and defining a refining zone;

providing a sensor secured to one of the refiner disks;

directing a flow of stock through the refining zone at a mass flow rate, the stock having a fiber which is refined by the refiner disks;

measuring a process variable of one of the rotary disk refiner and the stock in the refining zone with the sensor;

setting a first desired range for the process variable;

adjusting the mass flow rate of stock entering the refiner when the process variable is outside the first desired range; and setting a second desired range different than the first desired range after the mass flow rate is adjusted.

2. The method of claim 1, wherein the process variable is a temperature or pressure of stock in the refining zone.

3. The method of claim 3, further comprising the acts of:

supplying a flow of a liquid to the stock to dilute the stock; and adjusting the flow of the liquid to the stock when the process variable is outside the second desired range.

* * * * *